US011473413B2

(12) United States Patent
Yeung et al.

(10) Patent No.: US 11,473,413 B2
(45) Date of Patent: Oct. 18, 2022

(54) SYSTEMS AND METHODS TO AUTONOMOUSLY OPERATE HYDRAULIC FRACTURING UNITS

(71) Applicant: BJ Energy Solutions, LLC, Houston, TX (US)

(72) Inventors: Tony Yeung, Tomball, TX (US); Ricardo Rodriguez-Ramon, Tomball, TX (US); Joseph Foster, Tomball, TX (US)

(73) Assignee: BJ Energy Solutions, LLC, Houston, TX (US)

( * ) Notice: Subject to any disclaimer, the term of this patent is extended or adjusted under 35 U.S.C. 154(b) by 0 days.

(21) Appl. No.: 17/173,320

(22) Filed: Feb. 11, 2021

(65) Prior Publication Data

US 2021/0396116 A1 Dec. 23, 2021

Related U.S. Application Data

(60) Provisional application No. 62/705,354, filed on Jun. 23, 2020.

(51) Int. Cl.
*E21B 43/26* (2006.01)
*F04B 23/04* (2006.01)
(Continued)

(52) U.S. Cl.
CPC ..... *E21B 43/2607* (2020.05); *F04B 17/05* (2013.01); *F04B 23/04* (2013.01);
(Continued)

(58) Field of Classification Search
CPC ..... F04B 23/04; F04B 49/02; F04B 49/022; F04B 2203/0604; F04B 17/05; F04B 2207/047; E21B 43/2607
See application file for complete search history.

(56) References Cited

U.S. PATENT DOCUMENTS 2,498,229 A 2/1950 Adler
2,535,703 A 12/1950 Smith et al.
(Continued)

FOREIGN PATENT DOCUMENTS

AU 9609498 7/1999
AU 737970 9/2001
(Continued)

OTHER PUBLICATIONS

AFGlobal Corporation, Durastim Hydraulic Fracturing Pump, A Revolutionary Design for Continuous Duty Hydraulic Fracturing, 2018.

(Continued)

*Primary Examiner* — Christopher S Bobish
(74) *Attorney, Agent, or Firm* — Womble Bond Dickinson (US) LLP

(57) ABSTRACT

Systems and methods for operating hydraulic fracturing units, each including a hydraulic fracturing pump to pump fracturing fluid into a wellhead and an internal combustion engine to drive the hydraulic fracturing pump, may include receiving signals indicative of operational parameters. The systems and methods also may include determining an amount of required fracturing power sufficient to perform the hydraulic fracturing operation, determining an available power to perform the hydraulic fracturing operation and a difference between the available power and the required power, and controlling operation of the hydraulic fracturing units based at least in part on the power difference. When the power difference is indicative of excess power available, the system and methods may include causing at least one of the hydraulic fracturing units to idle, and when the power difference is indicative of a power deficit, increasing a power output of at least one of the hydraulic fracturing units.

18 Claims, 10 Drawing Sheets

(51) Int. Cl.
*F04B 49/02* (2006.01)
*F04B 17/05* (2006.01)

(52) U.S. Cl.
CPC ..... *F04B 49/02* (2013.01); *F04B 49/022* (2013.01); *F04B 2203/0604* (2013.01); *F04B 2207/047* (2013.01)

(56) References Cited

U.S. PATENT DOCUMENTS 2,820,341 A 1/1958 Amann
2,868,004 A 1/1959 Runde
2,940,377 A 6/1960 Darnell et al.
2,947,141 A 8/1960 Russ
3,068,796 A * 12/1962 Pfluger ..... F04D 15/0072 137/8
3,191,517 A 6/1965 Solzman
3,257,031 A 6/1966 Dietz
3,274,768 A 9/1966 Klein
3,378,074 A 4/1968 Kiel
3,382,671 A 5/1968 Ehni, III
3,463,612 A 8/1969 Whitsel
3,550,696 A * 12/1970 Kenneday ..... E21B 21/08 175/25
3,586,459 A 6/1971 Zerlauth
3,632,222 A 1/1972 Cronstedt
3,656,582 A 4/1972 Alcock
3,739,872 A 6/1973 McNair
3,759,063 A 9/1973 Bendall
3,765,173 A 10/1973 Harris
3,771,916 A 11/1973 Flanigan et al.
3,773,438 A 11/1973 Hall et al.
3,786,835 A * 1/1974 Finger ..... G05D 16/2073 137/565.3
3,791,682 A 2/1974 Mitchell
3,796,045 A 3/1974 Foster
3,814,549 A 6/1974 Cronstedt
3,820,922 A 6/1974 Buse et al.
3,963,372 A 6/1976 McLain et al.
4,010,613 A 3/1977 McInerney
4,019,477 A 4/1977 Overton
4,031,407 A 6/1977 Reed
4,059,045 A 11/1977 McClain
4,086,976 A 5/1978 Holm et al.
4,117,342 A 9/1978 Melley, Jr.
4,173,121 A 11/1979 Yu
4,204,808 A * 5/1980 Reese ..... G05D 16/2073 417/2
4,209,079 A 6/1980 Marchal et al.
4,209,979 A 7/1980 Woodhouse et al.
4,222,229 A 9/1980 Uram
4,269,569 A 5/1981 Hoover
4,311,395 A 1/1982 Douthitt et al.
4,330,237 A * 5/1982 Battah ..... F04B 35/002 417/2
4,341,508 A 7/1982 Rambin, Jr.
4,357,027 A 11/1982 Zeitlow
4,383,478 A 5/1983 Jones
4,402,504 A 9/1983 Christian
4,457,325 A 7/1984 Green
4,470,771 A 9/1984 Hall et al.
4,483,684 A 11/1984 Black
4,505,650 A 3/1985 Hannett et al.
4,574,880 A 3/1986 Handke
4,584,654 A * 4/1986 Crane ..... E03F 7/00 702/44
4,672,813 A 6/1987 David
4,754,607 A 7/1988 Mackay
4,782,244 A 11/1988 Wakimoto
4,796,777 A 1/1989 Keller
4,869,209 A 9/1989 Young
4,913,625 A 4/1990 Gerlowski
4,983,259 A 1/1991 Duncan
4,990,058 A 2/1991 Eslinger
5,135,361 A * 8/1992 Dion ..... F04D 15/0072 417/2
5,245,970 A 9/1993 Iwaszkiewicz et al.
5,291,842 A 3/1994 Sallstrom et al.
5,362,219 A 11/1994 Paul et al.
5,537,813 A 7/1996 Davis et al.
5,553,514 A 9/1996 Walkowc
5,560,195 A 10/1996 Anderson et al.
5,586,444 A * 12/1996 Fung ..... F25B 49/022 62/117
5,622,245 A 4/1997 Reik
5,626,103 A 5/1997 Haws et al.
5,651,400 A 7/1997 Corts et al.
5,678,460 A 10/1997 Walkowc
5,717,172 A 2/1998 Griffin, Jr. et al.
5,720,598 A 2/1998 de Chizzelle
5,839,888 A 11/1998 Harrison
5,846,062 A 12/1998 Yanagisawa et al.
5,983,962 A 11/1999 Gerardot
6,041,856 A 3/2000 Thrasher et al.
6,050,080 A 4/2000 Horner
6,067,962 A 5/2000 Bartley et al.
6,071,188 A 6/2000 O'Neill et al.
6,074,170 A * 6/2000 Bert ..... F04B 13/00 417/415
6,123,751 A 9/2000 Nelson et al.
6,129,335 A 10/2000 Yokogi
6,145,318 A 11/2000 Kaplan et al.
6,230,481 B1 5/2001 Jahr
6,279,309 B1 8/2001 Lawlor, II et al.
6,321,860 B1 11/2001 Reddoch
6,334,746 B1 1/2002 Nguyen et al.
6,530,224 B1 3/2003 Conchier
6,543,395 B2 4/2003 Green
6,655,922 B1 12/2003 Flek
6,765,304 B2 7/2004 Baten et al.
6,786,051 B2 9/2004 Kristich et al.
6,851,514 B2 2/2005 Han et al.
6,859,740 B2 2/2005 Stephenson et al.
6,901,735 B2 6/2005 Lohn
6,962,057 B2 11/2005 Kurokawa et al.
7,007,966 B2 3/2006 Campion
7,065,953 B1 6/2006 Kopko
7,143,016 B1 * 11/2006 Discenzo ..... G05B 13/0265 703/3
7,222,015 B2 5/2007 Davis et al.
7,388,303 B2 6/2008 Seiver
7,404,294 B2 7/2008 Sundlin
7,442,239 B2 10/2008 Armstrong et al.
7,545,130 B2 6/2009 Latham
7,552,903 B2 6/2009 Dunn et al.
7,563,076 B2 7/2009 Brunet et al.
7,563,413 B2 7/2009 Naets et al.
7,574,325 B2 8/2009 Dykstra
7,594,424 B2 9/2009 Fazekas
7,614,239 B2 11/2009 Herzog et al.
7,627,416 B2 12/2009 Batenburg et al.
7,677,316 B2 3/2010 Butler et al.
7,721,521 B2 5/2010 Kunkle et al.
7,730,711 B2 6/2010 Kunkle et al.
7,779,961 B2 8/2010 Matte
7,789,452 B2 9/2010 Dempsey et al.
7,836,949 B2 11/2010 Dykstra
7,841,394 B2 11/2010 McNeel et al.
7,845,413 B2 12/2010 Shampine et al.
7,886,702 B2 2/2011 Jerrell et al.
7,900,724 B2 3/2011 Promersberger et al.
7,921,914 B2 4/2011 Bruins et al.
7,938,151 B2 5/2011 Höckner
7,980,357 B2 7/2011 Edwards
8,056,635 B2 11/2011 Shampine et al.
8,083,504 B2 12/2011 Williams et al.
8,186,334 B2 5/2012 Ooyama
8,196,555 B2 6/2012 Ikeda et al.
8,202,354 B2 6/2012 Iijima
8,316,936 B2 11/2012 Roddy et al.
8,336,631 B2 12/2012 Shampine et al.
8,414,673 B2 4/2013 Raje et al.
8,469,826 B2 6/2013 Brosowske

(56) References Cited

U.S. PATENT DOCUMENTS 8,506,267 B2 8/2013 Gambier et al.
8,575,873 B2 11/2013 Peterson et al.
8,616,005 B1 12/2013 Cousino, Sr. et al.
8,621,873 B2 1/2014 Robertson et al.
8,656,990 B2 2/2014 Kajaria et al.
8,672,606 B2 3/2014 Glynn et al.
8,707,853 B1 4/2014 Dille et al.
8,714,253 B2 5/2014 Sherwood et al.
8,757,918 B2 6/2014 Ramnarain et al.
8,770,329 B2 7/2014 Spitler
8,784,081 B1 7/2014 Blume
8,789,601 B2 7/2014 Broussard et al.
8,794,307 B2 8/2014 Coquilleau et al.
8,801,394 B2 8/2014 Anderson
8,851,186 B2 10/2014 Shampine et al.
8,851,441 B2 10/2014 Acuna et al.
8,905,056 B2 12/2014 Kendrick
8,951,019 B2 2/2015 Hains et al.
8,973,560 B2 3/2015 Krug
8,997,904 B2 4/2015 Cryer et al.
9,016,383 B2 4/2015 Shampine et al.
9,032,620 B2 5/2015 Frassinelli et al.
9,057,247 B2 6/2015 Kumar et al.
9,103,193 B2 8/2015 Coli et al.
9,121,257 B2 9/2015 Coli et al.
9,140,110 B2 9/2015 Coli et al.
9,187,982 B2 11/2015 Dehring et al.
9,206,667 B2 12/2015 Khvoshchev et al.
9,212,643 B2 12/2015 Deliyski
9,222,346 B1 12/2015 Walls
9,324,049 B2 4/2016 Thomeer et al.
9,341,055 B2 5/2016 Weightman et al.
9,346,662 B2 5/2016 Van Vliet et al.
9,366,114 B2 6/2016 Coli et al.
9,376,786 B2 6/2016 Numasawa
9,394,829 B2 7/2016 Cabeen et al.
9,395,049 B2 7/2016 Vicknair et al.
9,401,670 B2 7/2016 Minato et al.
9,410,410 B2 8/2016 Broussard et al.
9,410,546 B2 8/2016 Jaeger et al.
9,429,078 B1 8/2016 Crowe et al.
9,435,333 B2 9/2016 McCoy et al.
9,488,169 B2 * 11/2016 Cochran ..... F04B 49/065
9,493,997 B2 11/2016 Liu et al.
9,512,783 B2 12/2016 Veilleux et al.
9,534,473 B2 1/2017 Morris et al.
9,546,652 B2 1/2017 Yin
9,550,501 B2 1/2017 Ledbetter
9,556,721 B2 1/2017 Jang et al.
9,562,420 B2 2/2017 Morris et al.
9,570,945 B2 2/2017 Fischer
9,579,980 B2 2/2017 Cryer et al.
9,587,649 B2 3/2017 Oehring
9,611,728 B2 4/2017 Oehring
9,617,808 B2 4/2017 Liu et al.
9,638,101 B1 5/2017 Crowe et al.
9,638,194 B2 5/2017 Wiegman et al.
9,650,871 B2 5/2017 Oehring et al.
9,656,762 B2 5/2017 Kamath et al.
9,689,316 B1 6/2017 Crom
9,739,130 B2 8/2017 Young
9,764,266 B1 9/2017 Carter
9,777,748 B2 10/2017 Lu et al.
9,803,467 B2 10/2017 Tang et al.
9,803,793 B2 10/2017 Davi et al.
9,809,308 B2 11/2017 Aguilar et al.
9,829,002 B2 11/2017 Crom
9,840,897 B2 12/2017 Larson
9,840,901 B2 12/2017 Oering et al.
9,845,730 B2 12/2017 Betti et al.
9,850,422 B2 12/2017 Lestz et al.
9,856,131 B1 1/2018 Moffitt
9,863,279 B2 1/2018 Laing et al.
9,869,305 B1 1/2018 Crowe et al.
9,879,609 B1 1/2018 Crowe et al.
RE46,725 E 2/2018 Case et al.
9,893,500 B2 2/2018 Oehring et al.
9,893,660 B2 2/2018 Peterson et al.
9,897,003 B2 2/2018 Motakef et al.
9,920,615 B2 3/2018 Zhang et al.
9,945,365 B2 4/2018 Hernandez et al.
9,964,052 B2 5/2018 Millican et al.
9,970,278 B2 5/2018 Broussard et al.
9,981,840 B2 5/2018 Shock
9,995,102 B2 6/2018 Dillie et al.
9,995,218 B2 6/2018 Oehring et al.
10,008,880 B2 6/2018 Vicknair et al.
10,008,912 B2 6/2018 Davey et al.
10,018,096 B2 7/2018 Wallimann et al.
10,020,711 B2 7/2018 Oehring et al.
10,024,123 B2 7/2018 Steffenhagen et al.
10,029,289 B2 7/2018 Wendorski et al.
10,030,579 B2 7/2018 Austin et al.
10,036,238 B2 7/2018 Oehring
10,040,541 B2 * 8/2018 Wilson ..... B64C 13/42
10,060,293 B2 8/2018 Del Bono
10,060,349 B2 8/2018 Álvarez et al.
10,077,933 B2 9/2018 Nelson et al.
10,082,137 B2 9/2018 Graham et al.
10,094,366 B2 10/2018 Marica
10,100,827 B2 10/2018 Devan et al.
10,107,084 B2 10/2018 Coli et al.
10,107,085 B2 10/2018 Coli et al.
10,114,061 B2 10/2018 Frampton et al.
10,119,381 B2 11/2018 Oehring et al.
10,134,257 B2 11/2018 Zhang et al.
10,138,098 B2 11/2018 Sorensen et al.
10,151,244 B2 12/2018 Giancotti et al.
10,174,599 B2 1/2019 Shampine et al.
10,184,397 B2 1/2019 Austin et al.
10,196,258 B2 2/2019 Kalala et al.
10,221,856 B2 3/2019 Hernandez et al.
10,227,854 B2 3/2019 Glass
10,227,855 B2 3/2019 Coli et al.
10,246,984 B2 4/2019 Payne et al.
10,247,182 B2 4/2019 Zhang et al.
10,254,732 B2 4/2019 Oehring et al.
10,267,439 B2 4/2019 Pryce et al.
10,280,724 B2 5/2019 Hinderliter
10,287,943 B1 5/2019 Schiltz
10,288,519 B2 5/2019 De La Cruz
10,303,190 B2 5/2019 Shock
10,305,350 B2 5/2019 Johnson et al.
10,316,832 B2 6/2019 Byrne
10,317,875 B2 6/2019 Pandurangan et al.
10,337,402 B2 7/2019 Austin et al.
10,358,035 B2 7/2019 Cryer
10,371,012 B2 8/2019 Davis et al.
10,374,485 B2 8/2019 Morris et al.
10,378,326 B2 8/2019 Morris et al.
10,393,108 B2 8/2019 Chong et al.
10,407,990 B2 9/2019 Oehring et al.
10,408,031 B2 9/2019 Oehring et al.
10,415,348 B2 9/2019 Zhang et al.
10,415,557 B1 9/2019 Crowe et al.
10,415,562 B2 9/2019 Kajita et al.
RE47,695 E 11/2019 Case et al.
10,465,689 B2 11/2019 Crom
10,478,753 B1 11/2019 Elms et al.
10,526,882 B2 1/2020 Oehring et al.
10,563,649 B2 2/2020 Zhang et al.
10,577,910 B2 3/2020 Stephenson
10,584,645 B2 3/2020 Nakagawa et al.
10,590,867 B2 3/2020 Thomassin et al.
10,598,258 B2 3/2020 Oehring et al.
10,610,842 B2 4/2020 Chong
10,662,749 B1 5/2020 Hill et al.
10,711,787 B1 7/2020 Darley
10,738,580 B1 8/2020 Fischer et al.
10,753,153 B1 8/2020 Fischer et al.
10,753,165 B1 8/2020 Fischer et al.
10,760,556 B1 9/2020 Crom et al.
10,794,165 B2 10/2020 Fischer et al.
10,794,166 B2 10/2020 Reckels et al.

(56) References Cited

U.S. PATENT DOCUMENTS 10,801,311 B1 10/2020 Cui et al.
10,815,764 B1 10/2020 Yeung et al.
10,815,978 B2 10/2020 Glass
10,830,032 B1 11/2020 Zhang et al.
10,859,203 B1 12/2020 Cui et al.
10,864,487 B1 12/2020 Han et al.
10,865,624 B1 12/2020 Cui et al.
10,865,631 B1 12/2020 Zhang et al.
10,870,093 B1 12/2020 Zhong et al.
10,871,045 B2 12/2020 Fischer et al.
10,895,202 B1 1/2021 Yeung et al.
10,907,459 B1 2/2021 Yeung et al.
10,927,774 B2 * 2/2021 Cai ..... F02D 41/1406
10,954,770 B1 3/2021 Yeung et al.
10,954,855 B1 3/2021 Ji et al.
10,961,908 B1 3/2021 Yeung et al.
10,961,912 B1 3/2021 Yeung et al.
10,961,914 B1 3/2021 Yeung et al.
10,961,993 B1 3/2021 Ji et al.
10,982,523 B1 4/2021 Hill et al.
10,989,019 B2 4/2021 Cai et al.
10,995,564 B2 5/2021 Miller et al.
11,002,189 B2 5/2021 Yeung et al.
11,008,950 B2 5/2021 Ethier et al.
11,015,423 B1 5/2021 Yeung et al.
11,035,213 B2 6/2021 Dusterhoft et al.
11,035,214 B2 6/2021 Cui et al.
11,047,379 B1 6/2021 Li et al.
11,053,853 B2 7/2021 Li et al.
11,060,455 B1 7/2021 Yeung et al.
11,085,281 B1 8/2021 Yeung et al.
11,085,282 B2 8/2021 Mazrooee et al.
11,105,250 B1 8/2021 Zhang et al.
11,105,266 B2 8/2021 Zhou et al.
11,125,156 B2 9/2021 Zhang et al.
11,143,000 B2 10/2021 Li et al.
11,143,006 B1 10/2021 Zhang et al.
11,236,739 B2 2/2022 Yeung et al.
11,242,737 B2 2/2022 Zhang et al.
11,243,509 B2 2/2022 Cai et al.
11,251,650 B1 2/2022 Liu et al.
11,268,346 B2 3/2022 Yeung et al.
RE49,083 E 5/2022 Case et al.
11,346,200 B2 5/2022 Cai et al.
11,373,058 B2 6/2022 Jaaskelainen et al.
RE49,140 E 7/2022 Case et al.
11,377,943 B2 7/2022 Kriebel et al.
RE49,155 E 8/2022 Case et al.
RE49,156 E 8/2022 Sase et al.
11,401,927 B2 8/2022 Li et al.
2002/0126922 A1 9/2002 Cheng et al.
2003/0061819 A1 4/2003 Kuroki et al.
2004/0016245 A1 1/2004 Pierson
2004/0074238 A1 4/2004 Wantanabe et al.
2004/0076526 A1 4/2004 Fukano et al.
2004/0187950 A1 9/2004 Cohen et al.
2004/0219040 A1 11/2004 Kugelev et al.
2005/0051322 A1 3/2005 Speer
2005/0056081 A1 3/2005 Gocho
2005/0139286 A1 6/2005 Poulter
2005/0196298 A1 9/2005 Manning
2005/0226754 A1 10/2005 Orr et al.
2005/0274134 A1 12/2005 Ryu et al.
2006/0061091 A1 3/2006 Osterloh
2006/0062914 A1 3/2006 Garg et al.
2006/0196251 A1 9/2006 Richey
2006/0211356 A1 9/2006 Grassman
2006/0260331 A1 11/2006 Andreychuk
2006/0272333 A1 12/2006 Sundin
2007/0029090 A1 2/2007 Andreychuk et al.
2007/0066406 A1 3/2007 Keller et al.
2007/0107981 A1 5/2007 Sicotte
2007/0125544 A1 6/2007 Robinson et al.
2007/0169543 A1 7/2007 Fazekas
2007/0181212 A1 8/2007 Fell
2007/0277982 A1 12/2007 Shampine et al.
2007/0295569 A1 12/2007 Manzoor et al.
2008/0006089 A1 1/2008 Adnan et al.
2008/0098891 A1 5/2008 Feher
2008/0161974 A1 7/2008 Alston
2008/0264625 A1 10/2008 Ochoa
2008/0264649 A1 10/2008 Crawford
2009/0064685 A1 3/2009 Busekros et al.
2009/0068031 A1 3/2009 Gambier et al.
2009/0092510 A1 4/2009 Williams et al.
2009/0124191 A1 5/2009 Van Becelaere et al.
2009/0178412 A1 7/2009 Spytek
2009/0249794 A1 * 10/2009 Wilkes ..... H02P 9/04 60/773
2009/0252616 A1 10/2009 Brunet et al.
2009/0308602 A1 12/2009 Bruins et al.
2010/0019626 A1 1/2010 Stout et al.
2010/0071899 A1 3/2010 Coquilleau et al.
2010/0218508 A1 9/2010 Brown et al.
2010/0300683 A1 12/2010 Looper et al.
2010/0310384 A1 12/2010 Stephenson et al.
2011/0052423 A1 3/2011 Gambier et al.
2011/0054704 A1 3/2011 Karpman et al.
2011/0085924 A1 4/2011 Shampine et al.
2011/0146244 A1 6/2011 Farman et al.
2011/0146246 A1 6/2011 Farman et al.
2011/0173991 A1 7/2011 Dean
2011/0197988 A1 8/2011 Van Vliet et al.
2011/0241888 A1 10/2011 Lu et al.
2011/0265443 A1 11/2011 Ansari
2011/0272158 A1 11/2011 Neal
2012/0048242 A1 3/2012 Sumilla et al.
2012/0085541 A1 4/2012 Love et al.
2012/0137699 A1 6/2012 Montagne et al.
2012/0179444 A1 7/2012 Ganguly et al.
2012/0192542 A1 8/2012 Chillar et al.
2012/0199001 A1 8/2012 Chillar et al.
2012/0204627 A1 8/2012 Anderl et al.
2012/0255734 A1 10/2012 Coli et al.
2012/0310509 A1 12/2012 Pardo et al.
2012/0324903 A1 12/2012 Dewis et al.
2013/0068307 A1 3/2013 Hains et al.
2013/0087045 A1 4/2013 Sullivan et al.
2013/0087945 A1 4/2013 Kusters et al.
2013/0134702 A1 5/2013 Boraas et al.
2013/0189915 A1 7/2013 Hazard
2013/0255953 A1 10/2013 Tudor
2013/0259707 A1 10/2013 Yin
2013/0284455 A1 10/2013 Kajaria et al.
2013/0300341 A1 11/2013 Gillette
2013/0306322 A1 11/2013 Sanborn
2014/0010671 A1 1/2014 Cryer et al.
2014/0013768 A1 1/2014 Laing et al.
2014/0032082 A1 1/2014 Gehrke et al.
2014/0044517 A1 2/2014 Saha et al.
2014/0048253 A1 2/2014 Andreychuk
2014/0090729 A1 4/2014 Coulter et al.
2014/0090742 A1 4/2014 Coskrey et al.
2014/0094105 A1 * 4/2014 Lundh ..... G05D 7/0617 454/168
2014/0095114 A1 4/2014 Thomeer et al.
2014/0095554 A1 4/2014 Thomeer et al.
2014/0123621 A1 5/2014 Driessens et al.
2014/0130422 A1 5/2014 Laing et al.
2014/0138079 A1 5/2014 Broussard et al.
2014/0144641 A1 5/2014 Chandler
2014/0147291 A1 5/2014 Burnette
2014/0158345 A1 6/2014 Jang et al.
2014/0196459 A1 7/2014 Futa et al.
2014/0216736 A1 8/2014 Leugemors et al.
2014/0219824 A1 8/2014 Burnette
2014/0250845 A1 9/2014 Jackson et al.
2014/0251623 A1 9/2014 Lestz et al.
2014/0277772 A1 9/2014 Lopez et al.
2014/0290266 A1 10/2014 Veilleux, Jr. et al.
2014/0318638 A1 10/2014 Harwood et al.
2015/0027730 A1 1/2015 Hall et al.
2015/0078924 A1 3/2015 Zhang et al.
2015/0101344 A1 4/2015 Jarrier et al.

(56) References Cited

U.S. PATENT DOCUMENTS

2015/0114652 A1 4/2015 Lestz et al.
2015/0129210 A1 5/2015 Chong et al.
2015/0135659 A1 5/2015 Jarrier et al.
2015/0159553 A1 6/2015 Kippel et al.
2015/0192117 A1 7/2015 Bridges
2015/0204148 A1 7/2015 Liu et al.
2015/0204322 A1 7/2015 Iund et al.
2015/0211512 A1* 7/2015 Wiegman ..... F04B 23/06 417/2
2015/0214816 A1 7/2015 Raad
2015/0217672 A1 8/2015 Shampine et al.
2015/0226140 A1 8/2015 Zhang et al.
2015/0252661 A1 9/2015 Glass
2015/0275891 A1 10/2015 Chong et al.
2015/0337730 A1 11/2015 Kupiszewski et al.
2015/0340864 A1 11/2015 Compton
2015/0345385 A1 12/2015 Santini
2015/0369351 A1 12/2015 Hermann et al.
2016/0032703 A1 2/2016 Broussard et al.
2016/0032836 A1 2/2016 Hawkinson et al.
2016/0102581 A1 4/2016 Del Bono
2016/0105022 A1 4/2016 Oehring et al.
2016/0108713 A1 4/2016 Dunaeva et al.
2016/0168979 A1 6/2016 Zhang et al.
2016/0177675 A1 6/2016 Morris et al.
2016/0177945 A1 6/2016 Byrne et al.
2016/0186671 A1 6/2016 Austin et al.
2016/0195082 A1 7/2016 Wiegman et al.
2016/0215774 A1 7/2016 Oklejas et al.
2016/0230525 A1 8/2016 Lestz et al.
2016/0244314 A1 8/2016 Van Vliet et al.
2016/0248230 A1 8/2016 Fawy et al.
2016/0253634 A1 9/2016 Thomeer et al.
2016/0258267 A1 9/2016 Payne et al.
2016/0273328 A1 9/2016 Oehring
2016/0273346 A1 9/2016 Tang et al.
2016/0290114 A1 10/2016 Oehring et al.
2016/0319650 A1 11/2016 Oehring et al.
2016/0326845 A1 11/2016 Djikpesse et al.
2016/0348479 A1 12/2016 Oehring et al.
2016/0369609 A1 12/2016 Morris et al.
2017/0009905 A1 1/2017 Arnold
2017/0016433 A1 1/2017 Chong et al.
2017/0030177 A1 2/2017 Oehring et al.
2017/0038137 A1 2/2017 Turney
2017/0045055 A1 2/2017 Hoefel et al.
2017/0074074 A1 3/2017 Joseph et al.
2017/0074076 A1 3/2017 Joseph et al.
2017/0074089 A1 3/2017 Agarwal et al.
2017/0082110 A1 3/2017 Lammers
2017/0089189 A1 3/2017 Norris et al.
2017/0114613 A1 4/2017 Lecerf et al.
2017/0114625 A1 4/2017 Norris et al.
2017/0122310 A1 5/2017 Ladron de Guevara
2017/0131174 A1 5/2017 Enev et al.
2017/0145918 A1 5/2017 Oehring et al.
2017/0191350 A1 7/2017 Johns et al.
2017/0218727 A1 8/2017 Oehring et al.
2017/0226839 A1 8/2017 Broussard et al.
2017/0226998 A1 8/2017 Zhang et al.
2017/0227002 A1 8/2017 Mikulski et al.
2017/0233103 A1 8/2017 Teicholz et al.
2017/0234165 A1 8/2017 Kersey et al.
2017/0234308 A1 8/2017 Buckley
2017/0241336 A1 8/2017 Jones et al.
2017/0248034 A1 8/2017 Dzieciol et al.
2017/0248308 A1 8/2017 Makarychev-Mikhailov et al.
2017/0275149 A1 9/2017 Schmidt
2017/0288400 A1 10/2017 Williams
2017/0292409 A1 10/2017 Aguilar et al.
2017/0302135 A1 10/2017 Cory
2017/0305736 A1 10/2017 Haile et al.
2017/0306847 A1 10/2017 Suciu et al.
2017/0322086 A1 11/2017 Luharuka
2017/0333086 A1 11/2017 Jackson
2017/0334448 A1 11/2017 Schwunk
2017/0335842 A1 11/2017 Robinson et al.
2017/0350471 A1 12/2017 Steidl et al.
2017/0370199 A1 12/2017 Witkowski et al.
2017/0370480 A1 12/2017 Witkowski et al.
2018/0034280 A1 2/2018 Pedersen
2018/0038328 A1 2/2018 Louven et al.
2018/0041093 A1 2/2018 Miranda
2018/0045202 A1 2/2018 Crom
2018/0038216 A1 3/2018 Zhang et al.
2018/0058171 A1 3/2018 Roesner et al.
2018/0087499 A1 3/2018 Zhang et al.
2018/0087996 A1 3/2018 De La Cruz
2018/0156210 A1 6/2018 Oehring et al.
2018/0172294 A1 6/2018 Owen
2018/0183219 A1 6/2018 Oehring et al.
2018/0186442 A1 7/2018 Maier
2018/0187662 A1 7/2018 Hill et al.
2018/0209415 A1 7/2018 Zhang et al.
2018/0223640 A1 8/2018 Keihany et al.
2018/0224044 A1 8/2018 Penney
2018/0229998 A1 8/2018 Shock
2018/0258746 A1 9/2018 Broussard et al.
2018/0266412 A1 9/2018 Stokkevag et al.
2018/0278124 A1 9/2018 Oehring et al.
2018/0283102 A1 10/2018 Cook
2018/0283618 A1 10/2018 Cook
2018/0284817 A1 10/2018 Cook et al.
2018/0290877 A1 10/2018 Shock
2018/0291781 A1 10/2018 Pedrini
2018/0298731 A1* 10/2018 Bishop ..... H02J 3/381
2018/0298735 A1 10/2018 Conrad
2018/0307255 A1* 10/2018 Bishop ..... E21B 43/26
2018/0313456 A1 11/2018 Bayyouk et al.
2018/0328157 A1 11/2018 Bishop
2018/0334893 A1 11/2018 Oehring
2018/0363435 A1 12/2018 Coli et al.
2018/0363436 A1 12/2018 Coli et al.
2018/0363437 A1 12/2018 Coli et al.
2018/0363438 A1 12/2018 Coli et al.
2019/0003272 A1 1/2019 Morris et al.
2019/0003329 A1 1/2019 Morris et al.
2019/0010793 A1 1/2019 Hinderliter
2019/0011051 A1 1/2019 Yeung
2019/0048993 A1 2/2019 Akiyama et al.
2019/0063263 A1 2/2019 Davis et al.
2019/0063341 A1 2/2019 Davis
2019/0067991 A1 2/2019 Davis et al.
2019/0071992 A1 3/2019 Feng
2019/0072005 A1 3/2019 Fisher et al.
2019/0078471 A1 3/2019 Braglia et al.
2019/0091619 A1 3/2019 Huang
2019/0106316 A1 4/2019 Van Vliet et al.
2019/0106970 A1 4/2019 Oehring
2019/0112908 A1 4/2019 Coli et al.
2019/0112910 A1 4/2019 Oehring et al.
2019/0119096 A1 4/2019 Haile et al.
2019/0120024 A1 4/2019 Oehring et al.
2019/0120031 A1 4/2019 Gilje
2019/0120134 A1 4/2019 Goleczka et al.
2019/0128247 A1 5/2019 Douglas, III
2019/0128288 A1 5/2019 Konada et al.
2019/0131607 A1 5/2019 Gillette
2019/0136677 A1* 5/2019 Shampine ..... E21B 43/26
2019/0153843 A1 5/2019 Headrick et al.
2019/0153938 A1 5/2019 Hammoud
2019/0154020 A1 5/2019 Glass
2019/0155318 A1 5/2019 Meunier
2019/0264667 A1 5/2019 Byrne
2019/0178234 A1 6/2019 Beisel
2019/0178235 A1 6/2019 Coskrey et al.
2019/0185312 A1 6/2019 Bush et al.
2019/0203572 A1 7/2019 Morris et al.
2019/0204021 A1 7/2019 Morris et al.
2019/0211661 A1 7/2019 Reckies et al.
2019/0211814 A1 7/2019 Weightman et al.
2019/0217258 A1 7/2019 Bishop
2019/0226317 A1 7/2019 Payne et al.
2019/0245348 A1 8/2019 Hinderliter et al.

(56) References Cited

U.S. PATENT DOCUMENTS

| | | | |
|---|---|---|---|
| 2019/0249652 | A1 | 8/2019 | Stephenson et al. |
| 2019/0249754 | A1 | 8/2019 | Oehring et al. |
| 2019/0257297 | A1 | 8/2019 | Botting et al. |
| 2019/0277279 | A1 | 9/2019 | Byrne et al. |
| 2019/0277295 | A1 | 9/2019 | Clyburn et al. |
| 2019/0309585 | A1 | 10/2019 | Miller et al. |
| 2019/0316447 | A1 | 10/2019 | Oehring et al. |
| 2019/0316456 | A1 | 10/2019 | Beisel et al. |
| 2019/0323337 | A1 | 10/2019 | Glass et al. |
| 2019/0330923 | A1 | 10/2019 | Gable et al. |
| 2019/0331117 | A1 | 10/2019 | Gable et al. |
| 2019/0337392 | A1 | 11/2019 | Joshi et al. |
| 2019/0338762 | A1 | 11/2019 | Curry et al. |
| 2019/0345920 | A1 | 11/2019 | Surjaatmadja et al. |
| 2019/0353103 | A1 | 11/2019 | Roberge |
| 2019/0356199 | A1 | 11/2019 | Morris et al. |
| 2019/0376449 | A1 | 12/2019 | Carrell |
| 2019/0383123 | A1 | 12/2019 | Hinderliter |
| 2020/0003205 | A1 | 1/2020 | Stokkevag et al. |
| 2020/0011165 | A1 | 1/2020 | George et al. |
| 2020/0040878 | A1 | 2/2020 | Morris |
| 2020/0049136 | A1 | 2/2020 | Stephenson |
| 2020/0049153 | A1 | 2/2020 | Headrick et al. |
| 2020/0071998 | A1 | 3/2020 | Oehring et al. |
| 2020/0072201 | A1 | 3/2020 | Marica |
| 2020/0088202 | A1 | 3/2020 | Sigmar et al. |
| 2020/0095854 | A1 | 3/2020 | Hinderliter |
| 2020/0109610 | A1 | 4/2020 | Husoy et al. |
| 2020/0132058 | A1 | 4/2020 | Mollatt |
| 2020/0141219 | A1 | 5/2020 | Oehring et al. |
| 2020/0141907 | A1 | 5/2020 | Meek et al. |
| 2020/0166026 | A1 | 5/2020 | Marica |
| 2020/0206704 | A1 | 7/2020 | Chong |
| 2020/0208733 | A1 | 7/2020 | Kim |
| 2020/0223648 | A1 | 7/2020 | Herman et al. |
| 2020/0224645 | A1 | 7/2020 | Buckley |
| 2020/0232454 | A1 | 7/2020 | Chretien et al. |
| 2020/0256333 | A1 | 8/2020 | Surjaatmadja |
| 2020/0263498 | A1 | 8/2020 | Fischer et al. |
| 2020/0263525 | A1 | 8/2020 | Reid |
| 2020/0263526 | A1 | 8/2020 | Fischer et al. |
| 2020/0263527 | A1 | 8/2020 | Fischer et al. |
| 2020/0263528 | A1 | 8/2020 | Fischer et al. |
| 2020/0267888 | A1 | 8/2020 | Putz |
| 2020/0291731 | A1 | 9/2020 | Haiderer et al. |
| 2020/0295574 | A1 | 9/2020 | Batsch-Smith |
| 2020/0309113 | A1 | 10/2020 | Hunter et al. |
| 2020/0325752 | A1 | 10/2020 | Clark et al. |
| 2020/0325760 | A1 | 10/2020 | Markham |
| 2020/0325761 | A1 | 10/2020 | Williams |
| 2020/0325893 | A1 | 10/2020 | Kraige et al. |
| 2020/0332784 | A1 | 10/2020 | Zhang et al. |
| 2020/0332788 | A1 | 10/2020 | Cui et al. |
| 2020/0340313 | A1 | 10/2020 | Fischer et al. |
| 2020/0340340 | A1 | 10/2020 | Oehring et al. |
| 2020/0340344 | A1 | 10/2020 | Reckels et al. |
| 2020/0340404 | A1 | 10/2020 | Stockstill |
| 2020/0347725 | A1 | 11/2020 | Morris et al. |
| 2020/0354928 | A1 | 11/2020 | Wehler et al. |
| 2020/0362760 | A1 | 11/2020 | Morenko et al. |
| 2020/0362764 | A1 | 11/2020 | Saintignan et al. |
| 2020/0370394 | A1 | 11/2020 | Cai et al. |
| 2020/0370408 | A1 | 11/2020 | Cai et al. |
| 2020/0370429 | A1 | 11/2020 | Cai et al. |
| 2020/0371490 | A1 | 11/2020 | Cai et al. |
| 2020/0340322 | A1 | 12/2020 | Sizemore et al. |
| 2020/0386222 | A1 | 12/2020 | Ham et al. |
| 2020/0392826 | A1 | 12/2020 | Cui et al. |
| 2020/0392827 | A1 | 12/2020 | George et al. |
| 2020/0393088 | A1 | 12/2020 | Sizemore et al. |
| 2020/0398238 | A1 | 12/2020 | Zhong et al. |
| 2020/0400000 | A1 | 12/2020 | Ghasripoor et al. |
| 2020/0400005 | A1 | 12/2020 | Han et al. |
| 2020/0407625 | A1 | 12/2020 | Stephenson |
| 2020/0408071 | A1 | 12/2020 | Li et al. |
| 2020/0408144 | A1 | 12/2020 | Feng et al. |
| 2020/0408147 | A1 | 12/2020 | Zhang et al. |
| 2020/0408149 | A1 | 12/2020 | Li et al. |
| 2021/0025324 | A1 | 1/2021 | Morris et al. |
| 2021/0025383 | A1 | 1/2021 | Bodishbaugh et al. |
| 2021/0032961 | A1 | 2/2021 | Hinderliter et al. |
| 2021/0054727 | A1 | 2/2021 | Floyd |
| 2021/0071503 | A1 | 3/2021 | Ogg et al. |
| 2021/0071574 | A1 | 3/2021 | Feng et al. |
| 2021/0071579 | A1 | 3/2021 | Li et al. |
| 2021/0071654 | A1 | 3/2021 | Brunson |
| 2021/0071752 | A1 | 3/2021 | Cui et al. |
| 2021/0079758 | A1 | 3/2021 | Yeung et al. |
| 2021/0079851 | A1 | 3/2021 | Yeung et al. |
| 2021/0086851 | A1 | 3/2021 | Zhang et al. |
| 2021/0087883 | A1 | 3/2021 | Zhang et al. |
| 2021/0087916 | A1 | 3/2021 | Zhang et al. |
| 2021/0087925 | A1 | 3/2021 | Heidari et al. |
| 2021/0087943 | A1 | 3/2021 | Cui et al. |
| 2021/0088042 | A1 | 3/2021 | Zhang et al. |
| 2021/0123425 | A1 | 4/2021 | Cui et al. |
| 2021/0123434 | A1 | 4/2021 | Cui et al. |
| 2021/0123435 | A1 | 4/2021 | Cui et al. |
| 2021/0131409 | A1 | 5/2021 | Cui et al. |
| 2021/0156240 | A1 | 5/2021 | Cicci et al. |
| 2021/0156241 | A1 | 5/2021 | Cook |
| 2021/0172282 | A1 | 6/2021 | Wang et al. |
| 2021/0180517 | A1 | 6/2021 | Zhou et al. |
| 2021/0199110 | A1 | 7/2021 | Albert et al. |
| 2021/0222690 | A1 | 7/2021 | Beisel |
| 2021/0246774 | A1 | 8/2021 | Cui et al. |
| 2021/0285311 | A1 | 9/2021 | Ji et al. |
| 2021/0285432 | A1 | 9/2021 | Ji et al. |
| 2021/0301807 | A1 | 9/2021 | Cui et al. |
| 2021/0306720 | A1 | 9/2021 | Sandoval et al. |
| 2021/0308638 | A1 | 10/2021 | Zhong et al. |
| 2021/0348475 | A1 | 11/2021 | Yeung et al. |
| 2021/0348476 | A1 | 11/2021 | Yeung et al. |
| 2021/0348477 | A1 | 11/2021 | Yeung et al. |
| 2021/0355927 | A1 | 11/2021 | Jian et al. |
| 2021/0372395 | A1 | 12/2021 | Li et al. |
| 2021/0388760 | A1 | 12/2021 | Feng et al. |
| 2022/0082007 | A1 | 3/2022 | Zhang et al. |
| 2022/0090476 | A1 | 3/2022 | Zhang et al. |
| 2022/0090477 | A1 | 3/2022 | Zhang et al. |
| 2022/0090478 | A1 | 3/2022 | Zhang et al. |
| 2022/0112892 | A1 | 4/2022 | Cui et al. |
| 2022/0120262 | A1 | 4/2022 | Ji et al. |
| 2022/0145740 | A1 | 5/2022 | Yuan et al. |
| 2022/0154775 | A1 | 5/2022 | Liu et al. |
| 2022/0155373 | A1 | 5/2022 | Liu et al. |
| 2022/0162931 | A1 | 5/2022 | Zhong et al. |
| 2022/0162991 | A1 | 5/2022 | Zhang et al. |
| 2022/0181859 | A1 | 6/2022 | Ji et al. |
| 2022/0186724 | A1 | 6/2022 | Chang et al. |
| 2022/0213777 | A1 | 7/2022 | Cui et al. |
| 2022/0220836 | A1 | 7/2022 | Zhang et al. |
| 2022/0224087 | A1 | 7/2022 | Ji et al. |
| 2022/0228468 | A1 | 7/2022 | Cui et al. |
| 2022/0228469 | A1 | 7/2022 | Zhang et al. |
| 2022/0235639 | A1 | 7/2022 | Zhang et al. |
| 2022/0235640 | A1 | 7/2022 | Mao et al. |
| 2022/0235641 | A1 | 7/2022 | Zhang et al. |
| 2022/0235642 | A1 | 7/2022 | Zhang et al. |
| 2022/0235802 | A1 | 7/2022 | Jiang et al. |
| 2022/0242297 | A1 | 8/2022 | Tian et al. |
| 2022/0243613 | A1 | 8/2022 | Ji et al. |
| 2022/0243724 | A1 | 8/2022 | Li et al. |
| 2022/0250000 | A1 | 8/2022 | Zhang et al. |
| 2022/0255319 | A1 | 8/2022 | Liu et al. |
| 2022/0258659 | A1 | 8/2022 | Cui et al. |
| 2022/0259947 | A1 | 8/2022 | Li et al. |
| 2022/0259964 | A1 | 8/2022 | Zhang et al. |
| 2022/0268201 | A1 | 8/2022 | Feng et al. |

(56) References Cited

U.S. PATENT DOCUMENTS

| | | |
|---|---|---|
| 2022/0282606 | 9/2022 | Zhong et al. |
| 2022/0282726 | 9/2022 | Zhang et al. |

FOREIGN PATENT DOCUMENTS

| | | | |
|---|---|---|---|
| CA | 2043184 | | 8/1994 |
| CA | 2829762 | | 9/2012 |
| CA | 2876687 | A1 | 5/2014 |
| CA | 2693567 | | 9/2014 |
| CA | 2964597 | | 10/2017 |
| CA | 2876687 | C | 4/2019 |
| CA | 2919175 | | 3/2021 |
| CN | 2622404 | | 6/2004 |
| CN | 2779054 | | 5/2006 |
| CN | 2890325 | | 4/2007 |
| CN | 200964929 | Y | 10/2007 |
| CN | 101323151 | A | 12/2008 |
| CN | 201190660 | Y | 2/2009 |
| CN | 201190892 | Y | 2/2009 |
| CN | 201190893 | Y | 2/2009 |
| CN | 101414171 | A | 4/2009 |
| CN | 201215073 | Y | 4/2009 |
| CN | 201236650 | Y | 5/2009 |
| CN | 201275542 | Y | 7/2009 |
| CN | 201275801 | Y | 7/2009 |
| CN | 201333385 | Y | 10/2009 |
| CN | 201443300 | U | 4/2010 |
| CN | 201496415 | U | 6/2010 |
| CN | 201501365 | U | 6/2010 |
| CN | 201507271 | U | 6/2010 |
| CN | 101323151 | B | 7/2010 |
| CN | 201560210 | U | 8/2010 |
| CN | 201581862 | U | 9/2010 |
| CN | 201610728 | U | 10/2010 |
| CN | 201610751 | U | 10/2010 |
| CN | 201618530 | U | 11/2010 |
| CN | 201661255 | U | 12/2010 |
| CN | 101949382 | | 1/2011 |
| CN | 201756927 | U | 3/2011 |
| CN | 101414171 | B | 5/2011 |
| CN | 102128011 | A | 7/2011 |
| CN | 102140898 | A | 8/2011 |
| CN | 102155172 | A | 8/2011 |
| CN | 102182904 | | 9/2011 |
| CN | 202000930 | U | 10/2011 |
| CN | 202055781 | U | 11/2011 |
| CN | 202082265 | U | 12/2011 |
| CN | 202100216 | U | 1/2012 |
| CN | 202100217 | U | 1/2012 |
| CN | 202100815 | U | 1/2012 |
| CN | 202124340 | U | 1/2012 |
| CN | 202140051 | U | 2/2012 |
| CN | 202140080 | U | 2/2012 |
| CN | 202144789 | U | 2/2012 |
| CN | 202144943 | U | 2/2012 |
| CN | 202149354 | U | 2/2012 |
| CN | 102383748 | A | 3/2012 |
| CN | 202156297 | U | 3/2012 |
| CN | 202158355 | U | 3/2012 |
| CN | 202163504 | U | 3/2012 |
| CN | 202165236 | U | 3/2012 |
| CN | 202180866 | U | 4/2012 |
| CN | 202181875 | U | 4/2012 |
| CN | 202187744 | U | 4/2012 |
| CN | 202191854 | U | 4/2012 |
| CN | 202250008 | U | 5/2012 |
| CN | 101885307 | | 7/2012 |
| CN | 102562020 | A | 7/2012 |
| CN | 202326156 | U | 7/2012 |
| CN | 202370773 | U | 8/2012 |
| CN | 202417397 | U | 9/2012 |
| CN | 202417461 | U | 9/2012 |
| CN | 102729335 | A | 10/2012 |
| CN | 202463955 | U | 10/2012 |
| CN | 202463957 | U | 10/2012 |
| CN | 202467739 | U | 10/2012 |
| CN | 202467801 | U | 10/2012 |
| CN | 202531016 | U | 11/2012 |
| CN | 202544794 | U | 11/2012 |
| CN | 102825039 | A | 12/2012 |
| CN | 202578592 | U | 12/2012 |
| CN | 202579164 | U | 12/2012 |
| CN | 202594808 | U | 12/2012 |
| CN | 202594928 | U | 12/2012 |
| CN | 202596615 | U | 12/2012 |
| CN | 202596616 | U | 12/2012 |
| CN | 102849880 | A | 1/2013 |
| CN | 102889191 | A | 1/2013 |
| CN | 202641535 | U | 1/2013 |
| CN | 202645475 | U | 1/2013 |
| CN | 202666716 | U | 1/2013 |
| CN | 202669645 | U | 1/2013 |
| CN | 202669944 | U | 1/2013 |
| CN | 202671336 | U | 1/2013 |
| CN | 202673269 | U | 1/2013 |
| CN | 202751982 | U | 2/2013 |
| CN | 102963629 | A | 3/2013 |
| CN | 202767964 | U | 3/2013 |
| CN | 202789791 | U | 3/2013 |
| CN | 202789792 | U | 3/2013 |
| CN | 202810717 | U | 3/2013 |
| CN | 202827276 | U | 3/2013 |
| CN | 202833093 | U | 3/2013 |
| CN | 202833370 | U | 3/2013 |
| CN | 102140898 | B | 4/2013 |
| CN | 202895467 | U | 4/2013 |
| CN | 202926404 | U | 5/2013 |
| CN | 202935216 | U | 5/2013 |
| CN | 202935798 | U | 5/2013 |
| CN | 202935816 | U | 5/2013 |
| CN | 202970631 | U | 6/2013 |
| CN | 103223315 | A | 7/2013 |
| CN | 203050598 | U | 7/2013 |
| CN | 103233714 | A | 8/2013 |
| CN | 103233715 | A | 8/2013 |
| CN | 103245523 | A | 8/2013 |
| CN | 103247220 | A | 8/2013 |
| CN | 103253839 | A | 8/2013 |
| CN | 103277290 | A | 9/2013 |
| CN | 103321782 | A | 9/2013 |
| CN | 203170270 | U | 9/2013 |
| CN | 203172509 | U | 9/2013 |
| CN | 203175778 | U | 9/2013 |
| CN | 203175787 | U | 9/2013 |
| CN | 102849880 | B | 10/2013 |
| CN | 203241231 | U | 10/2013 |
| CN | 203244941 | U | 10/2013 |
| CN | 203244942 | U | 10/2013 |
| CN | 203303798 | U | 11/2013 |
| CN | 102155172 | B | 12/2013 |
| CN | 102729335 | B | 12/2013 |
| CN | 103420532 | A | 12/2013 |
| CN | 203321792 | U | 12/2013 |
| CN | 203412658 | | 1/2014 |
| CN | 203420697 | U | 2/2014 |
| CN | 203480755 | U | 3/2014 |
| CN | 103711437 | A | 4/2014 |
| CN | 203531815 | U | 4/2014 |
| CN | 203531871 | U | 4/2014 |
| CN | 203531883 | U | 4/2014 |
| CN | 203556164 | U | 4/2014 |
| CN | 203558809 | U | 4/2014 |
| CN | 203559861 | U | 4/2014 |
| CN | 203559893 | U | 4/2014 |
| CN | 203560189 | U | 4/2014 |
| CN | 102704870 | B | 5/2014 |
| CN | 203611843 | U | 5/2014 |
| CN | 203612531 | U | 5/2014 |
| CN | 203612843 | U | 5/2014 |
| CN | 203614062 | U | 5/2014 |
| CN | 203614388 | U | 5/2014 |
| CN | 203621045 | U | 6/2014 |
| CN | 203621046 | U | 6/2014 |
| CN | 203621051 | U | 6/2014 |

(56) References Cited

FOREIGN PATENT DOCUMENTS

| | | | |
|---|---|---|---|
| CN | 203640993 | U | 6/2014 |
| CN | 203655221 | U | 6/2014 |
| CN | 103899280 | A | 7/2014 |
| CN | 103923670 | A | 7/2014 |
| CN | 203685052 | U | 7/2014 |
| CN | 203716936 | U | 7/2014 |
| CN | 103990410 | A | 8/2014 |
| CN | 103993869 | A | 8/2014 |
| CN | 203754009 | U | 8/2014 |
| CN | 203754025 | U | 8/2014 |
| CN | 203754341 | U | 8/2014 |
| CN | 203756614 | U | 8/2014 |
| CN | 203770264 | U | 8/2014 |
| CN | 203784519 | U | 8/2014 |
| CN | 203784520 | U | 8/2014 |
| CN | 104057864 | A | 9/2014 |
| CN | 203819819 | U | 9/2014 |
| CN | 203823431 | U | 9/2014 |
| CN | 203835337 | U | 9/2014 |
| CN | 104074500 | A | 10/2014 |
| CN | 203876633 | U | 10/2014 |
| CN | 203876636 | U | 10/2014 |
| CN | 203877364 | U | 10/2014 |
| CN | 203877365 | U | 10/2014 |
| CN | 203877375 | U | 10/2014 |
| CN | 203877424 | U | 10/2014 |
| CN | 203879476 | U | 10/2014 |
| CN | 203879479 | U | 10/2014 |
| CN | 203890292 | U | 10/2014 |
| CN | 203899476 | U | 10/2014 |
| CN | 203906206 | U | 10/2014 |
| CN | 104150728 | A | 11/2014 |
| CN | 104176522 | A | 12/2014 |
| CN | 104196464 | A | 12/2014 |
| CN | 104234651 | A | 12/2014 |
| CN | 203971841 | U | 12/2014 |
| CN | 203975450 | U | 12/2014 |
| CN | 204020788 | U | 12/2014 |
| CN | 204021980 | U | 12/2014 |
| CN | 204024625 | U | 12/2014 |
| CN | 204051401 | U | 12/2014 |
| CN | 204060661 | U | 12/2014 |
| CN | 104260672 | A | 1/2015 |
| CN | 104314512 | A | 1/2015 |
| CN | 204077478 | U | 1/2015 |
| CN | 204077526 | U | 1/2015 |
| CN | 204078307 | U | 1/2015 |
| CN | 204083051 | U | 1/2015 |
| CN | 204113168 | U | 1/2015 |
| CN | 104340682 | A | 2/2015 |
| CN | 104358536 | A | 2/2015 |
| CN | 104369687 | A | 2/2015 |
| CN | 104402178 | A | 3/2015 |
| CN | 104402185 | A | 3/2015 |
| CN | 104402186 | A | 3/2015 |
| CN | 204209819 | U | 3/2015 |
| CN | 204224560 | U | 3/2015 |
| CN | 204225813 | U | 3/2015 |
| CN | 204225839 | U | 3/2015 |
| CN | 104533392 | A | 4/2015 |
| CN | 104563938 | A | 4/2015 |
| CN | 104563994 | A | 4/2015 |
| CN | 104563995 | A | 4/2015 |
| CN | 104563998 | A | 4/2015 |
| CN | 104564033 | A | 4/2015 |
| CN | 204257122 | U | 4/2015 |
| CN | 204283610 | U | 4/2015 |
| CN | 204283782 | U | 4/2015 |
| CN | 204297682 | U | 4/2015 |
| CN | 204299810 | U | 4/2015 |
| CN | 103223315 | B | 5/2015 |
| CN | 104594857 | A | 5/2015 |
| CN | 104595493 | A | 5/2015 |
| CN | 104612647 | A | 5/2015 |
| CN | 104612928 | A | 5/2015 |
| CN | 104632126 | A | 5/2015 |
| CN | 204325094 | U | 5/2015 |
| CN | 204325098 | U | 5/2015 |
| CN | 204326983 | U | 5/2015 |
| CN | 204326985 | U | 5/2015 |
| CN | 204344040 | U | 5/2015 |
| CN | 204344095 | U | 5/2015 |
| CN | 104727797 | A | 6/2015 |
| CN | 204402414 | U | 6/2015 |
| CN | 204402423 | U | 6/2015 |
| CN | 204402450 | U | 6/2015 |
| CN | 103247220 | B | 7/2015 |
| CN | 104803568 | A | 7/2015 |
| CN | 204436360 | U | 7/2015 |
| CN | 204457524 | U | 7/2015 |
| CN | 204472485 | U | 7/2015 |
| CN | 204473625 | U | 7/2015 |
| CN | 204477303 | U | 7/2015 |
| CN | 204493095 | U | 7/2015 |
| CN | 204493309 | U | 7/2015 |
| CN | 103253839 | B | 8/2015 |
| CN | 104820372 | A | 8/2015 |
| CN | 104832093 | A | 8/2015 |
| CN | 104863523 | A | 8/2015 |
| CN | 204552723 | U | 8/2015 |
| CN | 204553866 | U | 8/2015 |
| CN | 204571831 | U | 8/2015 |
| CN | 204703814 | U | 10/2015 |
| CN | 204703833 | U | 10/2015 |
| CN | 204703834 | U | 10/2015 |
| CN | 105092401 | A | 11/2015 |
| CN | 103233715 | B | 12/2015 |
| CN | 103790927 | | 12/2015 |
| CN | 105207097 | | 12/2015 |
| CN | 204831952 | U | 12/2015 |
| CN | 204899777 | U | 12/2015 |
| CN | 102602323 | | 1/2016 |
| CN | 105240064 | A | 1/2016 |
| CN | 204944834 | | 1/2016 |
| CN | 205042127 | U | 2/2016 |
| CN | 205172478 | U | 4/2016 |
| CN | 103993869 | B | 5/2016 |
| CN | 105536299 | A | 5/2016 |
| CN | 105545207 | A | 5/2016 |
| CN | 205260249 | | 5/2016 |
| CN | 103233714 | B | 6/2016 |
| CN | 104340682 | B | 6/2016 |
| CN | 205297518 | U | 6/2016 |
| CN | 205298447 | U | 6/2016 |
| CN | 205391821 | U | 7/2016 |
| CN | 205400701 | U | 7/2016 |
| CN | 103277290 | B | 8/2016 |
| CN | 104260672 | B | 8/2016 |
| CN | 205477370 | U | 8/2016 |
| CN | 205479153 | U | 8/2016 |
| CN | 205503058 | U | 8/2016 |
| CN | 205503068 | U | 8/2016 |
| CN | 205503089 | U | 8/2016 |
| CN | 105958098 | A | 9/2016 |
| CN | 205599180 | | 9/2016 |
| CN | 205599180 | U | 9/2016 |
| CN | 106121577 | A | 11/2016 |
| CN | 205709587 | | 11/2016 |
| CN | 104612928 | B | 12/2016 |
| CN | 106246120 | A | 12/2016 |
| CN | 205805471 | | 12/2016 |
| CN | 106321045 | A | 1/2017 |
| CN | 205858306 | | 1/2017 |
| CN | 106438310 | A | 2/2017 |
| CN | 205937833 | | 2/2017 |
| CN | 104563994 | B | 3/2017 |
| CN | 206129196 | | 4/2017 |
| CN | 104369687 | B | 5/2017 |
| CN | 106715165 | | 5/2017 |
| CN | 106761561 | A | 5/2017 |
| CN | 105240064 | B | 6/2017 |
| CN | 206237147 | | 6/2017 |
| CN | 206287832 | | 6/2017 |
| CN | 206346711 | | 7/2017 |

(56) References Cited

FOREIGN PATENT DOCUMENTS

| | | | |
|---|---|---|---|
| CN | 104563995 | B | 9/2017 |
| CN | 107120822 | | 9/2017 |
| CN | 107143298 | A | 9/2017 |
| CN | 107159046 | A | 9/2017 |
| CN | 107188018 | A | 9/2017 |
| CN | 206496016 | | 9/2017 |
| CN | 104564033 | B | 10/2017 |
| CN | 107234358 | A | 10/2017 |
| CN | 107261975 | A | 10/2017 |
| CN | 206581929 | | 10/2017 |
| CN | 104820372 | B | 12/2017 |
| CN | 105092401 | B | 12/2017 |
| CN | 107476769 | A | 12/2017 |
| CN | 107520526 | A | 12/2017 |
| CN | 206754664 | | 12/2017 |
| CN | 107605427 | A | 1/2018 |
| CN | 106438310 | B | 2/2018 |
| CN | 107654196 | A | 2/2018 |
| CN | 107656499 | A | 2/2018 |
| CN | 107728657 | A | 2/2018 |
| CN | 206985503 | | 2/2018 |
| CN | 207017968 | | 2/2018 |
| CN | 107859053 | A | 3/2018 |
| CN | 207057867 | | 3/2018 |
| CN | 207085817 | | 3/2018 |
| CN | 105545207 | B | 4/2018 |
| CN | 107883091 | A | 4/2018 |
| CN | 107902427 | A | 4/2018 |
| CN | 107939290 | A | 4/2018 |
| CN | 107956708 | | 4/2018 |
| CN | 207169595 | | 4/2018 |
| CN | 207194873 | | 4/2018 |
| CN | 207245674 | | 4/2018 |
| CN | 108034466 | A | 5/2018 |
| CN | 108036071 | A | 5/2018 |
| CN | 108087050 | A | 5/2018 |
| CN | 207380566 | | 5/2018 |
| CN | 108103483 | A | 6/2018 |
| CN | 108179046 | A | 6/2018 |
| CN | 108254276 | A | 7/2018 |
| CN | 108311535 | A | 7/2018 |
| CN | 207583576 | | 7/2018 |
| CN | 207634064 | | 7/2018 |
| CN | 207648054 | | 7/2018 |
| CN | 207650621 | | 7/2018 |
| CN | 108371894 | A | 8/2018 |
| CN | 207777153 | | 8/2018 |
| CN | 108547601 | A | 9/2018 |
| CN | 108547766 | A | 9/2018 |
| CN | 108555826 | A | 9/2018 |
| CN | 108561098 | A | 9/2018 |
| CN | 108561750 | A | 9/2018 |
| CN | 108590617 | A | 9/2018 |
| CN | 207813495 | | 9/2018 |
| CN | 207814698 | | 9/2018 |
| CN | 207862275 | | 9/2018 |
| CN | 108687954 | A | 10/2018 |
| CN | 207935270 | | 10/2018 |
| CN | 207961582 | | 10/2018 |
| CN | 207964530 | | 10/2018 |
| CN | 108789848 | A | 11/2018 |
| CN | 108799473 | | 11/2018 |
| CN | 108868675 | A | 11/2018 |
| CN | 208086829 | | 11/2018 |
| CN | 208089263 | | 11/2018 |
| CN | 208169068 | | 11/2018 |
| CN | 108979569 | A | 12/2018 |
| CN | 109027662 | A | 12/2018 |
| CN | 109058092 | A | 12/2018 |
| CN | 208179454 | | 12/2018 |
| CN | 208179502 | | 12/2018 |
| CN | 208253147 | | 12/2018 |
| CN | 208260574 | | 12/2018 |
| CN | 109114418 | A | 1/2019 |
| CN | 109141990 | A | 1/2019 |
| CN | 208313120 | | 1/2019 |
| CN | 208330319 | | 1/2019 |
| CN | 208342730 | | 1/2019 |
| CN | 208430982 | | 1/2019 |
| CN | 208430986 | | 1/2019 |
| CN | 109404274 | A | 3/2019 |
| CN | 109429610 | A | 3/2019 |
| CN | 109491318 | A | 3/2019 |
| CN | 109515177 | A | 3/2019 |
| CN | 109526523 | A | 3/2019 |
| CN | 109534737 | A | 3/2019 |
| CN | 208564504 | | 3/2019 |
| CN | 208564516 | | 3/2019 |
| CN | 208564525 | | 3/2019 |
| CN | 208564918 | | 3/2019 |
| CN | 208576026 | | 3/2019 |
| CN | 208576042 | | 3/2019 |
| CN | 208650818 | | 3/2019 |
| CN | 208669244 | | 3/2019 |
| CN | 109555484 | A | 4/2019 |
| CN | 109682881 | A | 4/2019 |
| CN | 208730959 | | 4/2019 |
| CN | 208735264 | | 4/2019 |
| CN | 208746733 | | 4/2019 |
| CN | 208749529 | | 4/2019 |
| CN | 208750405 | | 4/2019 |
| CN | 208764658 | | 4/2019 |
| CN | 109736740 | A | 5/2019 |
| CN | 109751007 | A | 5/2019 |
| CN | 208868428 | | 5/2019 |
| CN | 208870761 | | 5/2019 |
| CN | 109869294 | A | 6/2019 |
| CN | 109882144 | A | 6/2019 |
| CN | 109882372 | A | 6/2019 |
| CN | 209012047 | | 6/2019 |
| CN | 209100025 | | 7/2019 |
| CN | 110080707 | A | 8/2019 |
| CN | 110118127 | A | 8/2019 |
| CN | 110124574 | A | 8/2019 |
| CN | 110145277 | A | 8/2019 |
| CN | 110145399 | A | 8/2019 |
| CN | 110152552 | A | 8/2019 |
| CN | 110155193 | A | 8/2019 |
| CN | 110159225 | A | 8/2019 |
| CN | 110159432 | | 8/2019 |
| CN | 110159432 | A | 8/2019 |
| CN | 110159433 | A | 8/2019 |
| CN | 110208100 | A | 9/2019 |
| CN | 110252191 | A | 9/2019 |
| CN | 110284854 | A | 9/2019 |
| CN | 110284972 | A | 9/2019 |
| CN | 209387358 | | 9/2019 |
| CN | 110374745 | A | 10/2019 |
| CN | 209534736 | | 10/2019 |
| CN | 110425105 | A | 11/2019 |
| CN | 110439779 | A | 11/2019 |
| CN | 110454285 | A | 11/2019 |
| CN | 110454352 | A | 11/2019 |
| CN | 110467298 | A | 11/2019 |
| CN | 110469312 | A | 11/2019 |
| CN | 110469314 | A | 11/2019 |
| CN | 110469405 | A | 11/2019 |
| CN | 110469654 | A | 11/2019 |
| CN | 110485982 | A | 11/2019 |
| CN | 110485983 | A | 11/2019 |
| CN | 110485984 | A | 11/2019 |
| CN | 110486249 | A | 11/2019 |
| CN | 110500255 | A | 11/2019 |
| CN | 110510771 | A | 11/2019 |
| CN | 110513097 | A | 11/2019 |
| CN | 209650738 | | 11/2019 |
| CN | 209653968 | | 11/2019 |
| CN | 209654004 | | 11/2019 |
| CN | 209654022 | | 11/2019 |
| CN | 209654128 | | 11/2019 |
| CN | 209656622 | | 11/2019 |
| CN | 107849130 | B | 12/2019 |
| CN | 108087050 | B | 12/2019 |
| CN | 110566173 | A | 12/2019 |

(56) References Cited

FOREIGN PATENT DOCUMENTS

| | | | |
|---|---|---|---|
| CN | 110608030 | A | 12/2019 |
| CN | 110617187 | A | 12/2019 |
| CN | 110617188 | A | 12/2019 |
| CN | 110617318 | A | 12/2019 |
| CN | 209740823 | | 12/2019 |
| CN | 209780827 | | 12/2019 |
| CN | 209798631 | | 12/2019 |
| CN | 209799942 | | 12/2019 |
| CN | 209800178 | | 12/2019 |
| CN | 209855723 | | 12/2019 |
| CN | 209855742 | | 12/2019 |
| CN | 209875063 | | 12/2019 |
| CN | 110656919 | A | 1/2020 |
| CN | 107520526 | B | 2/2020 |
| CN | 110787667 | A | 2/2020 |
| CN | 110821464 | A | 2/2020 |
| CN | 110833665 | A | 2/2020 |
| CN | 110848028 | A | 2/2020 |
| CN | 210049880 | | 2/2020 |
| CN | 210049882 | | 2/2020 |
| CN | 210097596 | | 2/2020 |
| CN | 210105817 | | 2/2020 |
| CN | 210105818 | | 2/2020 |
| CN | 210105993 | | 2/2020 |
| CN | 110873093 | A | 3/2020 |
| CN | 210139911 | | 3/2020 |
| CN | 110947681 | A | 4/2020 |
| CN | 111058810 | A | 4/2020 |
| CN | 111075391 | A | 4/2020 |
| CN | 210289931 | | 4/2020 |
| CN | 210289932 | | 4/2020 |
| CN | 210289933 | | 4/2020 |
| CN | 210303516 | | 4/2020 |
| CN | 211412945 | | 4/2020 |
| CN | 111089003 | A | 5/2020 |
| CN | 111151186 | A | 5/2020 |
| CN | 111167769 | A | 5/2020 |
| CN | 111169833 | A | 5/2020 |
| CN | 111173476 | A | 5/2020 |
| CN | 111185460 | A | 5/2020 |
| CN | 111185461 | A | 5/2020 |
| CN | 111188763 | A | 5/2020 |
| CN | 111206901 | A | 5/2020 |
| CN | 111206992 | A | 5/2020 |
| CN | 111206994 | A | 5/2020 |
| CN | 210449044 | | 5/2020 |
| CN | 210460875 | | 5/2020 |
| CN | 210522432 | | 5/2020 |
| CN | 210598943 | | 5/2020 |
| CN | 210598945 | | 5/2020 |
| CN | 210598946 | | 5/2020 |
| CN | 210599194 | | 5/2020 |
| CN | 210599303 | | 5/2020 |
| CN | 210600110 | | 5/2020 |
| CN | 111219326 | A | 6/2020 |
| CN | 111350595 | A | 6/2020 |
| CN | 210660319 | | 6/2020 |
| CN | 210714569 | | 6/2020 |
| CN | 210769168 | | 6/2020 |
| CN | 210769169 | | 6/2020 |
| CN | 210769170 | | 6/2020 |
| CN | 210770133 | | 6/2020 |
| CN | 210825844 | | 6/2020 |
| CN | 210888904 | | 6/2020 |
| CN | 210888905 | | 6/2020 |
| CN | 210889242 | | 6/2020 |
| CN | 111397474 | A | 7/2020 |
| CN | 111412064 | A | 7/2020 |
| CN | 111441923 | A | 7/2020 |
| CN | 111441925 | A | 7/2020 |
| CN | 111503517 | A | 8/2020 |
| CN | 111515898 | A | 8/2020 |
| CN | 111594059 | A | 8/2020 |
| CN | 111594062 | A | 8/2020 |
| CN | 111594144 | A | 8/2020 |
| CN | 211201919 | | 8/2020 |
| CN | 211201920 | | 8/2020 |
| CN | 211202218 | | 8/2020 |
| CN | 111608965 | A | 9/2020 |
| CN | 111664087 | A | 9/2020 |
| CN | 111677476 | A | 9/2020 |
| CN | 111677647 | A | 9/2020 |
| CN | 111692064 | A | 9/2020 |
| CN | 111692065 | A | 9/2020 |
| CN | 211384571 | | 9/2020 |
| CN | 211397553 | | 9/2020 |
| CN | 211397677 | | 9/2020 |
| CN | 211500955 | | 9/2020 |
| CN | 211524765 | | 9/2020 |
| DE | 4004854 | | 8/1991 |
| DE | 4241614 | | 6/1994 |
| DE | 102012018825 | | 3/2014 |
| DE | 102013111655 | | 12/2014 |
| DE | 102015103872 | | 10/2015 |
| DE | 102013114335 | | 12/2020 |
| EP | 0835983 | | 4/1998 |
| EP | 1378683 | | 1/2004 |
| EP | 2143916 | | 1/2010 |
| EP | 2613023 | | 7/2013 |
| EP | 3095989 | | 11/2016 |
| EP | 3211766 | | 8/2017 |
| EP | 3049642 | | 4/2018 |
| EP | 3354866 | | 8/2018 |
| EP | 3075946 | | 5/2019 |
| FR | 2795774 | | 6/1999 |
| GB | 474072 | | 10/1937 |
| GB | 1438172 | | 6/1976 |
| JP | S57135212 | | 2/1984 |
| KR | 20020026398 | | 4/2002 |
| RU | 13562 | | 4/2000 |
| WO | 1993020328 | | 10/1993 |
| WO | 2006025886 | | 3/2006 |
| WO | 2009023042 | | 2/2009 |
| WO | 20110133821 | | 10/2011 |
| WO | 2012139380 | | 10/2012 |
| WO | 2013158822 | | 10/2013 |
| WO | PCT/CN2012/074945 | | 11/2013 |
| WO | 2013185399 | | 12/2013 |
| WO | 2015158020 | | 10/2015 |
| WO | 2016/014476 | | 1/2016 |
| WO | 2016033983 | | 3/2016 |
| WO | 2016078181 | | 5/2016 |
| WO | 2016101374 | | 6/2016 |
| WO | 2016112590 | | 7/2016 |
| WO | 2017123656 | A | 7/2017 |
| WO | 2017146279 | | 8/2017 |
| WO | 2017213848 | | 12/2017 |
| WO | 2018031029 | | 2/2018 |
| WO | 2018038710 | | 3/2018 |
| WO | 2018044293 | | 3/2018 |
| WO | 2018044307 | | 3/2018 |
| WO | 2018071738 | | 4/2018 |
| WO | 2018101909 | | 6/2018 |
| WO | 2018101912 | | 6/2018 |
| WO | 2018106210 | | 6/2018 |
| WO | 2018106225 | | 6/2018 |
| WO | 2018106252 | | 6/2018 |
| WO | 2018/132106 | | 7/2018 |
| WO | 2018156131 | | 8/2018 |
| WO | 2018075034 | | 10/2018 |
| WO | 2018187346 | | 10/2018 |
| WO | 2018031031 | | 2/2019 |
| WO | 2019045691 | | 3/2019 |
| WO | 2019046680 | | 3/2019 |
| WO | 2019060922 | | 3/2019 |
| WO | 2019117862 | | 6/2019 |
| WO | 2019126742 | | 6/2019 |
| WO | 2019147601 | | 8/2019 |
| WO | 2019169366 | | 9/2019 |
| WO | 2019195651 | | 10/2019 |
| WO | 2019200510 | | 10/2019 |
| WO | 2019210417 | | 11/2019 |
| WO | 2020018068 | | 1/2020 |
| WO | 2020046866 | | 3/2020 |

(56) References Cited

FOREIGN PATENT DOCUMENTS

| | | | | |
|---|---|---|---|---|
| WO | 2020072076 | | 4/2020 | |
| WO | 2020076569 | | 4/2020 | |
| WO | 2020097060 | | 5/2020 | |
| WO | 2020104088 | | 5/2020 | |
| WO | WO-2020097060 | A2 * | 5/2020 | ..... F04B 23/04 |
| WO | 2020131085 | | 6/2020 | |
| WO | 2020211083 | | 10/2020 | |
| WO | 2020211086 | | 10/2020 | |
| WO | 2021/038604 | | 3/2021 | |
| WO | 2021038604 | | 3/2021 | |
| WO | 2021041783 | | 3/2021 | |

OTHER PUBLICATIONS

Europump and Hydrualic Institute, Variable Speed Pumping: A Guide to Successful Applications, Elsevier Ltd, 2004.
Capstone Turbine Corporation, Capstone Receives Three Megawatt Order from Large Independent Oil & Gas Company in Eagle Ford Shale Play, Dec. 7, 2010.
Wikipedia, Westinghouse Combustion Turbine Systems Division, https://en.wikipedia.org/wiki/Westinghouse_Combustion_Turbine_Systems_Division, circa 1960.
Wikipedia,Union Pacific GTELs, https://en.wikipedia.org/wiki/Union_Pacific_GTELs, circa 1950.
HCI JET Frac, Screenshots from YouTube, Dec. 11, 2010. https://www.youtube.com/watch?v=6HjXkdbFaFQ.
AFD Petroleum Ltd., Automated Hot Zone, Frac Refueling System, Dec. 2018.
Eygun, Christiane, et al., URTeC: 2687987, Mitigating Shale Gas Developments Carbon Footprint: Evaluating and Implementing Solutions in Argentina, Copyright 2017, Unconventional Resources Technology Conference.
Walzel, Brian, Hart Energy, Oil, Gas Industry Discovers Innovative Solutions to Environmental Concerns, Dec. 10, 2018.
Frac Shack, Bi-Fuel FracFueller brochure, 2011.
Pettigrew, Dana, et al., High Pressure Multi-Stage Centrifugal Pump for 10,000 psi Frac Pump—HPHPS Frac Pump, Copyright 2013, Society of Petroleum Engineers, SPE 166191.
Elle Seybold, et al., Evolution of Dual Fuel Pressure Pumping for Fracturing: Methods, Economics, Field Trial Results and Improvements in Availability of Fuel, Copyright 2013, Society of Petroleum Engineers, SPE 166443.
Wallace, E.M., Associated Shale Gas: From Flares to Rig Power, Copyright 2015, Society of Petroleum Engineers, SPE-173491-MS.
Williams, C.W. (Gulf Oil Corp. Odessa Texas), The Use of Gas-turbine Engines in an Automated High-Pressure Water-Injection Stations; American Petroleum Institute; API-63-144 (Jan. 1, 1963).
Neal, J.C. (Gulf Oil Corp. Odessa Texas), Gas Turbine Driven Centrifugal Pumps for High Pressure Water Injection American Institute of Mining, Metallurgical and Petroleum Engineers, Inc.; SPE-1888 (1967).
Porter, John A. (SOLAR Division International Harvester Co.), Modem Industrial Gas Turbines for the Oil Field American Petroleum Institute; Drilling and Production Practice; API-67-243 (Jan. 1, 1967).
Cooper et al., Jet Frac Porta-Skid—A New Concept in Oil Field Service Pump Equipments[sic]; Halliburton Services; SPE-2706 (1969).
Ibragimov, É.S., Use of gas-turbine engines in oil field pumping units; Chem Petrol Eng; (1994) 30: 530. https://doi.org/10.1007/BF01154919. (Translated from Khimicheskaya i Neftyanoe Mashinostroenie, No. 11, pp. 24-26, Nov. 1994.).
Kas'yanov et al., Application of gas-turbine engines in pumping units complexes of hydraulic fracturing of oil and gas reservoirs; Exposition Oil & Gas; (Oct. 2012) (published in Russian).
Researchgate, Answer by Byron Woolridge, found at https://www.researchgate.net/post/How_can_we_improve_the_efficiency_of_the_gas_turbine_cycles, Jan. 1, 2013.
Filipović, Ivan, Preliminary Selection of Basic Parameters of Different Torsional Vibration Dampers Intended for use in Medium-Speed Diesel Engines, Transactions of Famena XXXVI-3 (2012).
Marine Turbine Technologies, 1 MW Power Generation Package, http://marineturbine.com/power-generation, 2017.
Business Week: Fiber-optic cables help fracking, cablinginstall.com. Jul. 12, 2013. https://www.cablinginstall.com/cable/article/16474208/businessweek-fiberoptic-cables-help-fracking.
Fracking companies switch to electric motors to power pumps, iadd-intl.org. Jun. 27, 2019. https://www.iadd-intl.org/articles/fracking-companies-switch-to-electric-motors-to-power-pumps/.
The Leader in Frac Fueling, suncoastresources.com. Jun. 29, 2015. https://web.archive.org/web/20150629220609/https://www.suncoastresources.com/oilfield/fueling-services/.
Mobile Fuel Delivery, atlasoil.com. Mar. 6, 2019. https://www.atlasoil.com/nationwide-fueling/onsite-and-mobile-fueling.
Frac Tank Hose (FRAC), 4starhose.com. Accessed: Nov. 10, 2019. http://www.4starhose.com/product/frac_tank_hose_frac.aspx.
Plos One, Dynamic Behavior of Reciprocating Plunger Pump Discharge Valve Based on Fluid Structure Interaction and Experimental Analysis. Oct. 21, 2015.
FMC Technologies, Operation and Maintenance Manual, L06 Through L16 Triplex Pumps Doc No. OMM50000903 Rev: E p. 1 of 66. Aug. 27, 2009.
Gardner Denver Hydraulic Fracturing Pumps GD 3000 https://www.gardnerdenver.com/en-us/pumps/triplex-fracking-pump-gd-3000.
Lekontsev, Yu M., et al. "Two-side sealer operation." Journal of Mining Science 49.5 (2013): 757-762.
Tom Hausfeld, GE Power & Water, and Eldon Schelske, Evolution Well Services, TM2500+ Power for Hydraulic Fracturing.
FTS International'S Dual Fuel Hydraulic Fracturing Equipment Increases Operational Efficiencies, Provides Cost Benefits, Jan. 3, 2018.
CNG Delivery, Fracturing with natural gas, dual-fuel drilling with CNG, Aug. 22, 2019.
PbNG, Natural Gas Fuel for Drilling and Hydraulic Fracturing, Diesel Displacement / Dual Fuel & Bi-Fuel, May 2014.
Integrated Flow, Skid-mounted Modular Process Systems, https://ifsolutions.com/.
Cameron, A Schlumberger Company, Frac Manifold Systems, 2016.
ZSi-Foster, Energy | Solar | Fracking | Oil and Gas, https://www.zsi-foster.com/energy-solar-fracking-oil-and-gas.html.
JBG Enterprises, Inc., WS-Series Blowout Prevention Safety Coupling—Quick Release Couplings, http://www.jgbhose.com/products/WS-Series-Blowout-Prevention-Safety-Coupling.asp.
Halliburton, Vessel-based Modular Solution (VMS), 2015.
Chun, M. K., H. K. Song, and R. Lallemand. "Heavy duty gas turbines in petrochemical plants: Samsung's Daesan plant (Korea) beats fuel flexibility records with over 95% hydrogen in process gas." Proceedings of PowerGen Asia Conference, Singapore. 1999.
Wolf, Jurgen J., and Marko A. Perkavec. "Safety Aspects and Environmental Considerations for a 10 MW Cogeneration Heavy Duty Gas Turbine Burning Coke Oven Gas with 60% Hydrogen Content." ASME 1992 International Gas Turbine and Aeroengine Congress and Exposition. American Society of Mechanical Engineers Digital Collection, 1992.
Ginter, Timothy, and Thomas Bouvay. "Uprate options for the MS7001 heavy duty gas turbine." GE paper GER-3808C, GE Energy 12 (2006).
Chaichan, Miqdam Tariq. "The impact of equivalence ratio on performance and emissions of a hydrogen-diesel dual fuel engine with cooled exhaust gas recirculation." International Journal of Scientific & Engineering Research 6.6 (2015): 938-941.
Ecob, David J., et al. "Design and Development of a Landfill Gas Combustion System for the Typhoon Gas Turbine." ASME 1996 International Gas Turbine and Aeroengine Congress and Exhibition. American Society of Mechanical Engineers Digital Collection, 1996.
II-VI Marlow Industries, Thermoelectric Technologies in Oil, Gas, and Mining Industries, blog.marlow.com (Jul. 24, 2019).
B.M. Mahlalela, et al., Electric Power Generation Potential Based on Waste Heat and Geothermal Resources in South Africa, pangea.stanford.edu (Feb. 11, 2019).

(56) References Cited

OTHER PUBLICATIONS

Department of Energy, United States of America, The Water-Energy Nexus: Challenges and Opportunities purenergypolicy.org (Jun. 2014).
Ankit Tiwari, Design of a Cooling System for a Hydraulic Fracturing Equipment, The Pennsylvania State University, The Graduate School, College of Engineering, 2015.
Jp Yadav et al., Power Enhancement of Gas Turbine Plant by Intake Air Fog Cooling, Jun. 2015.
Mee Industries: Inlet Air Fogging Systems for Oil, Gas and Petrochemical Processing, Verdict Media Limited Copyright 2020.
M. Ahmadzadehtalatapeh et al.Performance enhancement of gas turbine units by retrofitting with inlet air cooling technologies (IACTs): an hour-by-hour simulation study, Journal of the Brazilian Society of Mechanical Sciences and Engineering, Mar. 2020.
Advances in Popular Torque-Link Solution Offer OEMs Greater Benefit, Jun. 21, 2018.
Emmanuel Akita et al., Mewbourne College of Earth & Energy, Society of Petroleum Engineers; Drilling Systems Automation Technical Section (DSATS); 2019.
PowerShelter Kit II, nooutage.com, Sep. 6, 2019.
EMPengineering.com, HEMP Resistant Electrical Generators / Hardened Structures HEMP/GMD Shielded Generators, Virginia.
Blago Minovski, Coupled Simulations of Cooling and Engine Systems for Unsteady Analysis of the Benefits of Thermal Engine Encapsulation, Department of Applied Mechanics, Chalmers University of Technology G'oteborg, Sweden 2015.
J. Porteiro et al., Feasibility of a new domestic CHP trigeneration with heat pump: II. Availability analysis. Design and development, Applied Thermal Engineering 24 (2004) 1421-1429.
American Petroleum Institute. API 674: Positive Displacement Pumps—Reciprocating. 3rd ed. Washington, DC: API Publishing Services, 2010.
American Petroleum Institute. API 616: Gas Turbines for the Petroleum, Chemical, and Gas Industry Services. 5th ed. Washington, DC: API Publishing Services, 2011.
Karassik, Igor, Joseph Messina, Paul Cooper, and Charles Heald. Pump Handbook. 4th ed. New York: McGraw-Hill Education, 2008.
Weir SPM. Weir SPM General Catalog: Well Service Pumps, Flow Control Products, Manifold Trailers, Safety Products, Post Sale Services. Ft. Worth, TX: Weir Oil & Gas. May 28, 2016. https://www.pumpfundamentals.com/pumpdatabase2/weir-spm-general.pdf.
The Weir Group, Inc. Weir SPM Pump Product Catalog. Ft. Worth, TX: S.P.M. Flow Control, Inc. Oct. 30, 2017. https://manage.global.weir/assets/files/product%20brochures/SPM_2P140706_Pump_Product_Catalogue_View.pdf.
Shandong Saigao Group Corporation. Q4 (5W115) Quintuplex Plunger Pump. Jinan City, Shandong Province, China: Saigao. Oct. 20, 2014. https://www.saigaogroup.com/product/q400-5w115-quintuplex-plunger-pump.html.
Marine Turbine. Turbine Powered Frac Units. Franklin, Louisiana: Marine Turbine Technologies, 2020.
Rotating Right. Quintuplex Power Pump Model Q700. Edmonton, Alberta, Canada: Weatherford International Ltd. https://www.rotatingright.com/pdf/weatherford/RR%2026-Weatherford%20Model%20Q700.pdf, 2021.
CanDyne Pump Services, Inc. Weatherford Q700 Pump. Calgary, Alberta, Canada: CanDyne Pump Services. Aug. 15, 2015. http://candyne.com/wp-content/uploads/2014/10/181905-94921.q700-quintuplex-pump.pdf.
Arop, Julius Bankong. Geomechanical review of hydraulic fracturing technology. Thesis (M. Eng.). Cambridge, MA: Massachusetts Institute of Technology, Dept. of Civil and Environmental Engineering. Oct. 29, 2013. https://dspace.mit.edu/handle/1721.1/82176.
SPM® QEM 5000 E-Frac Pump Specification Sheet, Weir Group (2019) ("Weir 5000").
Green Field Energy Services Natural Gas Driven Turbine Frac Pumps HHP Summit Presentation, Yumpu (Sep. 2012), https://www.yumpu.com/en/document/read/49685291/turbine-frac-pump-assembly-hhp ("Green Field").
Dowell B908 "Turbo-Jet" Operator's Manual.
Jereh Debut's Super power Turbine Fracturing Pump, Leading the Industrial Revolution, Jereh Oilfield Services Group (Mar. 19, 2014), https://www.pmewswire.com/news-releases/jereh-debuts-super-power-turbine-fracturing-pump-leading-the-industrial-revolution-250992111.html.
Jereh Apollo 4500 Turbine Frac Pumper Finishes Successful Field Operation in China, Jereh Group (Feb. 13, 2015), as available on Apr. 20, 2015, https://web.archive.org/web/20150420220625/https://www.prnewswire.com/news-releases/jereh-apollo-4500-turbine-frac-pumper-finishes-successful-field-operation-in-china-300035829.html.
35% Economy Increase, Dual-fuel System Highlighting Jereh Apollo Frac Pumper, Jereh Group (Apr. 13, 2015), https://www.jereh.com/en/news/press-release/news-detail-7345.htm.
Hydraulic Fracturing: Gas turbine proves successful in shale gasfield operations, Vericor (2017), https://www.vericor.com/wp-content/uploads/2020/02/7.-Fracing-4500hp-Pump-China-En.pdf ("Vericor Case Study").
Jereh Apollo Turbine Fracturing Pumper Featured on China Central Television, Jereh Group (Mar. 9, 2018), https://www.jereh.com/en/news/press-release/news-detail-7267.htm.
Jereh Unveiled New Electric Fracturing Solution at OTC 2019, Jereh Group (May 7, 2019), as available on May 28, 2019, https://web.archive.org/web/20190528183906/https://www.prnewswire .com/news-releases/jereh-unveiled-new-electric-fracturing-solution-at-otc-2019-300845028.html.
Jereh Group, Jereh Fracturing Unit, Fracturing Spread, YouTube (Mar. 30, 2015), https://www.youtube.com/watch?v=PIkDbU5dE0o.
Transcript of Jereh Group, Jereh Fracturing Unit, Fracturing Spread, YouTube (Mar. 30, 2015).
Jereh Group, Jereh Fracturing Equipment. YouTube (Jun. 8, 2015), https://www.youtube.com/watch?v=m0vMiq84P4Q.
Transcript of Jereh Group, Jereh Fracturing Equipment, YouTube (Jun. 8, 2015), https://www.youtube.com/watch?v=m0vMiq84P4Q.
Ferdinand P. Beer et al., Mechanics of Materials (6th ed. 2012).
Weir Oil & Gas Introduces Industry's First Continuous Duty 5000-Horsepower Pump, Weir Group (Jul. 25, 2019), https://www.global. weir/newsroom/news-articles/weir-oil-and-gas-introduces-industrys-first-continuous-duty-5000-horsepower-pump/.
2012 High Horsepower Summit Agenda, Natural Gas for High Horsepower Applications (Sep. 5, 2012).
Review of HHP Summit 2012, Gladstein, Neandross & Associates https://www.gladstein.org/gna-conferences/high-horsepower-summit-2012/.
Green Field Energy Services Deploys Third New Hydraulic Fracturing System, Green Field Energy Services, Inc. (Jul. 11, 2012), https://www.prnewswire.com/news-releases/green-field-energy-services-deploys-third-new-hydraulic-fracturing-sp read-162113425.
Karen Boman, Turbine Technology Powers Green Field Multi-Fuel Frack Pump, Rigzone (Mar. 7, 2015), as available on Mar. 14, 2015, https://web.archive.org/web/20150314203227/https://www.rigzone.co m/news/oil-gas/a/124883/Turbine_Technology_Powers_Green_Field_ MultiFuel_Frack_Pump.
"Turbine Frac Units," WMD Squared (2012), https://wmdsquared.com/ work/gfes-turbine-frac-units/.
Leslie Turj, Green Field asset sale called 'largest disposition industry has seen,' The INDsider Media (Mar. 19, 2014), http://theind.com/ article-16497-green-field-asset-sale-called-%E2%80%98largest-disposition-industry-has-seen%60.html.
ISM, What is Cracking Pressure, 2019.
Swagelok, The right valve for controlling flow direction? Check, 2016.
Technology.org, Check valves how do they work and what are the main type, 2018.
De Gevigney et al., "Analysis of no-load dependent power losses in a planetary gear train by using thermal network method", International Gear Conference 2014: Aug. 26-18, 2014, Lyon, pp. 615-624.

(56) References Cited

OTHER PUBLICATIONS

"Honghua developing new-generation shale-drilling rig, plans testing of frac pump"; Katherine Scott; Drilling Contractor; May 23, 2013; accessed at https://www.drillingcontractor.org/honghua-developing-new-generation-shale-drilling-rig-plans-testing-of-frac-pump-23278.
Special-Purpose Couplings for Petroleum, Chemical, and Gas Industry Services, API Standard 671 (4th Edition) (2010.
The Application of Flexible Couplings for Turbomachinery, Jon R.Mancuso et al., Proceedings of the Eighteenthturbomachinery Symposium (1989).
Pump Control With Variable Frequency Drives, Kevin Tory, Pumps & Systems: Advances in Motors and Drives, Reprint from Jun. 2008.
Fracture Design and Stimulation, Mike Eberhard, P.E., Wellconstruction & Operations Technical Workshop Insupport of the EPA Hydraulic Fracturing Study, Mar. 10-11, 2011.
General Purpose vs. Special Purpose Couplings, Jon Mancuso, Proceedings of the Twenty-Third Turbomachinerysymposium (1994).
Overview of Industry Guidance/Best Practices on Hydraulic Fracturing (HF), American Petroleum Institute, © 2012.
API Member Companies, American Petroleum Institute, WaybackMachine Capture, https://web.archive.org/web/20130424080625/http://api.org/globalitems/globalheaderpages/membership/api-member-companies, accessed Jan. 4, 2021.
API's Global Industry Services, American Petroleum Institute, © Aug. 2020.
About API, American Petroleum Institute, https://www.api.org /about, accessed Dec. 30, 2021.
About API, American Petroleum Institute, WaybackMachine Capture, https://web archive.org/web/20110422104346 /http://api.org/aboutapi/, captured Apr. 22, 2011.
Publications, American Petroleum Institute, WaybackMachine Capture, https://web.archive.org/web/20110427043936 /http://www.api.org:80/Publications/, captured Apr. 27, 2011.
Procedures for Standards Development, American Petroleum Institute, Third Edition (2006).
WorldCat Library Collections Database Records for API Standard 671 and API Standard 674, https://www.worldcat.org/title/positive-displacement-pumps-reciprocating/oclc/ 858692269&referer=brief_results, accessed Dec. 30, 2021; and https://www.worldcat.org/title/special-purpose-couplings-for-petroleum-chemical-and-gas-industry-services/oclc/871254217&referer=brief_results, accessed Dec. 22, 2021.
2011 Publications and Services, American Petroleum Institute (2011).
Standards, American Petroleum Institute, WaybackMachine Capture, https://web.archive.org/web/20110207195046/http:/www.api.org/Standards/, captured Feb. 7, 2011; and https://web.archive.org/web/20110204112554/http://global.ihs.com/?RID=API1, captured Feb. 4, 2011.
IHS Markit Standards Store, https://global.ihs.com/doc_ detail.cfm?document_name=API%20STD%20674&item_s_key=00010672#doc-detail-history-anchor, accessed Dec. 30, 2021; and https://global.ihs.com/doc_detail.cfm?&input_doc _number=671 &input_doc_title=&document_name=API%20STD%20671&item_s_key=00010669&item_key_date=890331&origin=DSSC, accessed Dec. 30, 2021.
Dziubak, Tadeusz, "Experimental Studies of Dust Suction Irregularity from Multi-Cyclone Dust Collector of Two-Stage Air Filter", Energies 2021, 14, 3577, 28 pages.

* cited by examiner

SYSTEMS AND METHODS TO AUTONOMOUSLY OPERATE HYDRAULIC FRACTURING UNITS

PRIORITY CLAIM

This U.S. Non-Provisional patent application claims priority to and the benefit of, under 35 U.S.C. § 119(e), U.S. Provisional Application No. 62/705,354, filed Jun. 23, 2020, titled "SYSTEMS AND METHODS TO AUTONOMOUSLY OPERATE HYDRAULIC FRACTURING UNITS," the disclosure of which is incorporated herein by reference in its entirety.

TECHNICAL FIELD

The present disclosure relates to systems and methods for operating hydraulic fracturing units and, more particularly, to systems and methods for autonomously operating hydraulic fracturing units to pump fracturing fluid into a wellhead.

BACKGROUND

Hydraulic fracturing is an oilfield operation that stimulates the production of hydrocarbons, such that the hydrocarbons may more easily or readily flow from a subsurface formation to a well. For example, a hydraulic fracturing system may be configured to fracture a formation by pumping a fracturing fluid into a well at high pressure and high flow rates. Some fracturing fluids may take the form of a slurry including water, proppants, and/or other additives, such as thickening agents and/or gels. The slurry may be forced via one or more pumps into the formation at rates faster than can be accepted by the existing pores, fractures, faults, or other spaces within the formation. As a result, pressure may build rapidly to the point where the formation may fail and may begin to fracture. By continuing to pump the fracturing fluid into the formation, existing fractures in the formation are caused to expand and extend in directions away from a well bore, thereby creating additional flow paths to the well bore. The proppants may serve to prevent the expanded fractures from closing or may reduce the extent to which the expanded fractures contract when pumping of the fracturing fluid is ceased. Once the formation is fractured, large quantities of the injected fracturing fluid may be allowed to flow out of the well, and the production stream of hydrocarbons may be obtained from the formation.

Prime movers may be used to supply power to hydraulic fracturing pumps for pumping the fracturing fluid into the formation. For example, a plurality of gas turbine engines and/or reciprocating-piston engines may each be mechanically connected to a corresponding hydraulic fracturing pump via a transmission and operated to drive the hydraulic fracturing pump. The prime mover, hydraulic fracturing pump, transmission, and auxiliary components associated with the prime mover, hydraulic fracturing pump, and transmission may be connected to a common platform or trailer for transportation and set-up as a hydraulic fracturing unit at the site of a fracturing operation, which may include up to a dozen or more of such hydraulic fracturing units operating together to perform the fracturing operation.

Partly due to the large number of components of a hydraulic fracturing system, it may be difficult to efficiently and effectively control the output of the numerous hydraulic fracturing units and related components. For example, at times during a fracturing operation, there may be an excess or deficit of power available to perform the fracturing operation. Thus, when excess power exists, efficiency may be reduced by operating more of the hydraulic fracturing units than necessary to perform the fracturing operation. Alternatively, an operator of the hydraulic fracturing system may idle one or more of the hydraulic fracturing units to save energy. However, operating the prime movers at idle for an extended period of time may result in premature wear of the prime mover requiring more frequent maintenance. If, alternatively, a deficit of available power exists, an operator may cause the prime movers to operate at maximum power (or close to maximum power), which may lead to premature wear or failure of the prime mover, resulting in maintenance or replacement, as well as undesirable down time for the fracturing operation. In addition, because the conditions associated with a fracturing operation may often change during the fracturing operation, the power necessary to continue the fracturing operation may change over time, resulting in changes in the required power output to perform the fracturing operation. In such situations, it may be difficult for an operator to continuously monitor and change the outputs of the prime movers according to the changing conditions.

Accordingly, Applicant has recognized a need for systems and methods that provide improved operation of hydraulic fracturing units during hydraulic fracturing operations. The present disclosure may address one or more of the above-referenced drawbacks, as well as other possible drawbacks.

SUMMARY

As referenced above, due to the complexity of a hydraulic fracturing operation and the high number of machines involved, it may be difficult to efficiently and effectively control the power output of the prime movers and related components to perform the hydraulic fracturing operation, particularly during changing conditions. In addition, manual control of the hydraulic fracturing units by an operator may result in delayed or ineffective responses to instances of excesses and deficits of available power of the prime movers occurring during the hydraulic fracturing operation. Insufficiently prompt responses to such events may lead to inefficiencies or premature equipment wear or damage, which may reduce efficiency and lead to delays in completion of a hydraulic fracturing operation.

The present disclosure generally is directed to systems and methods for semi- or fully-autonomously operating hydraulic fracturing units to pump fracturing fluid into a wellhead. For example, in some embodiments, the systems and methods may provide semi- or fully-autonomous operation of a plurality of hydraulic fracturing units, for example, including controlling the power output of prime movers of the hydraulic fracturing units during operation of the plurality of hydraulic fracturing units for completion of a hydraulic fracturing operation.

According to some embodiments, a method of operating a plurality of hydraulic fracturing units, each of the hydraulic fracturing units including a hydraulic fracturing pump to pump fracturing fluid into a wellhead and an internal combustion engine to drive the hydraulic fracturing pump, may include receiving, at a power output controller, one or more operational signals indicative of operational parameters associated with pumping fracturing fluid into a wellhead according to performance of a hydraulic fracturing operation. The method also may include determining, via the power output controller based at least in part on the one or more operational signals, an amount of required fracturing power sufficient to perform the hydraulic fracturing operation. The method further may include receiving, at the power output controller, one or more characteristic signals indicative of fracturing unit characteristics associated with at least some of the plurality of hydraulic fracturing units. The method still further may include determining, via the power output controller based at least in part on the one or more characteristic signals, an available power to perform the hydraulic fracturing operation. The method also may include determining, via the power output controller, a power difference between the available power and the required power, and controlling operation of the at least some of the plurality of hydraulic fracturing units based at least in part on the power difference.

According some embodiments, a hydraulic fracturing control assembly to operate a plurality of hydraulic fracturing units, each of the hydraulic fracturing units including a hydraulic fracturing pump to pump fracturing fluid into a wellhead and an internal combustion engine to drive the hydraulic fracturing pump, may include an input device configured to facilitate communication of one or more operational signals indicative of operational parameters associated with pumping fracturing fluid into a wellhead according to performance of a hydraulic fracturing operation. The hydraulic fracturing control assembly also may include one or more sensors configured to generate one or more sensor signals indicative of one or more of a flow rate of fracturing fluid or a pressure associated with fracturing fluid. The hydraulic fracturing control assembly further may include a power output controller in communication with one or more of the plurality of hydraulic fracturing units, the input device, or the one or more sensors. The power output controller may be configured to receive the one or more operational signals indicative of operational parameters associated with pumping fracturing fluid into a wellhead according to performance of a hydraulic fracturing operation. The power output controller also may be configured to determine, based at least in part on the one or more operational signals, an amount of required fracturing power sufficient to perform the hydraulic fracturing operation. The power output controller further may be configured to receive one or more characteristic signals indicative of fracturing unit characteristics associated with at least some of the plurality of hydraulic fracturing units. The power output controller still further may be configured to determine, based at least in part on the one or more characteristic signals, an available power to perform the hydraulic fracturing operation, and determine a power difference between the available power and the required power. The power output controller also may be configured to control operation of the at least some of the plurality of hydraulic fracturing units based at least in part on the power difference.

According to some embodiments, a hydraulic fracturing system may include a plurality of hydraulic fracturing units. Each of the hydraulic fracturing units may include a hydraulic fracturing pump to pump fracturing fluid into a wellhead and an internal combustion engine to drive the hydraulic fracturing pump. The hydraulic fracturing system also may include an input device configured to facilitate communication of one or more operational signals indicative of operational parameters associated with pumping fracturing fluid into a wellhead according to performance of a hydraulic fracturing operation, and one or more sensors configured to generate one or more sensor signals indicative of one or more of a flow rate of fracturing fluid or a pressure associated with fracturing fluid. The hydraulic fracturing system also may include a power output controller in communication with one or more of the plurality of hydraulic fracturing units, the input device, or the one or more sensors. The power output controller may be configured to receive the one or more operational signals indicative of operational parameters associated with pumping fracturing fluid into a wellhead according to performance of a hydraulic fracturing operation. The power output controller also may be configured to determine, based at least in part on the one or more operational signals, an amount of required fracturing power sufficient to perform the hydraulic fracturing operation. The power output controller further may be configured to receive one or more characteristic signals indicative of fracturing unit characteristics associated with at least some of the plurality of hydraulic fracturing units. The power output controller still further may be configured to determine, based at least in part on the one or more characteristic signals, an available power to perform the hydraulic fracturing operation. The power output controller also may be configured to determine a power difference between the available power and the required power, and control operation of the at least some of the plurality of hydraulic fracturing units based at least in part on the power difference.

Still other aspects and advantages of these exemplary embodiments and other embodiments, are discussed in detail herein. Moreover, it is to be understood that both the foregoing information and the following detailed description provide merely illustrative examples of various aspects and embodiments, and are intended to provide an overview or framework for understanding the nature and character of the claimed aspects and embodiments. Accordingly, these and other objects, along with advantages and features of the present invention herein disclosed, will become apparent through reference to the following description and the accompanying drawings. Furthermore, it is to be understood that the features of the various embodiments described herein are not mutually exclusive and may exist in various combinations and permutations.

BRIEF DESCRIPTION OF THE DRAWINGS

The accompanying drawings, which are included to provide a further understanding of the embodiments of the present disclosure, are incorporated in and constitute a part of this specification, illustrate embodiments of the present disclosure, and together with the detailed description, serve to explain principles of the embodiments discussed herein. No attempt is made to show structural details of this disclosure in more detail than can be necessary for a fundamental understanding of the embodiments discussed herein and the various ways in which they can be practiced. According to common practice, the various features of the drawings discussed below are not necessarily drawn to scale. Dimensions of various features and elements in the drawings can be expanded or reduced to more clearly illustrate embodiments of the disclosure.

DETAILED DESCRIPTION

The drawings include like numerals to indicate like parts throughout the several views, the following description is provided as an enabling teaching of exemplary embodiments, and those skilled in the relevant art will recognize that many changes may be made to the embodiments described. It also will be apparent that some of the desired benefits of the embodiments described can be obtained by selecting some of the features of the embodiments without utilizing other features. Accordingly, those skilled in the art will recognize that many modifications and adaptations to the embodiments described are possible and may even be desirable in certain circumstances. Thus, the following description is provided as illustrative of the principles of the embodiments and not in limitation thereof.

The phraseology and terminology used herein is for the purpose of description and should not be regarded as limiting. As used herein, the term "plurality" refers to two or more items or components. The terms "comprising," "including," "carrying," "having," "containing," and "involving," whether in the written description or the claims and the like, are open-ended terms, i.e., to mean "including but not limited to," unless otherwise stated. Thus, the use of such terms is meant to encompass the items listed thereafter, and equivalents thereof, as well as additional items. The transitional phrases "consisting of" and "consisting essentially of," are closed or semi-closed transitional phrases, respectively, with respect to any claims. Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish claim elements.

Figure 1:
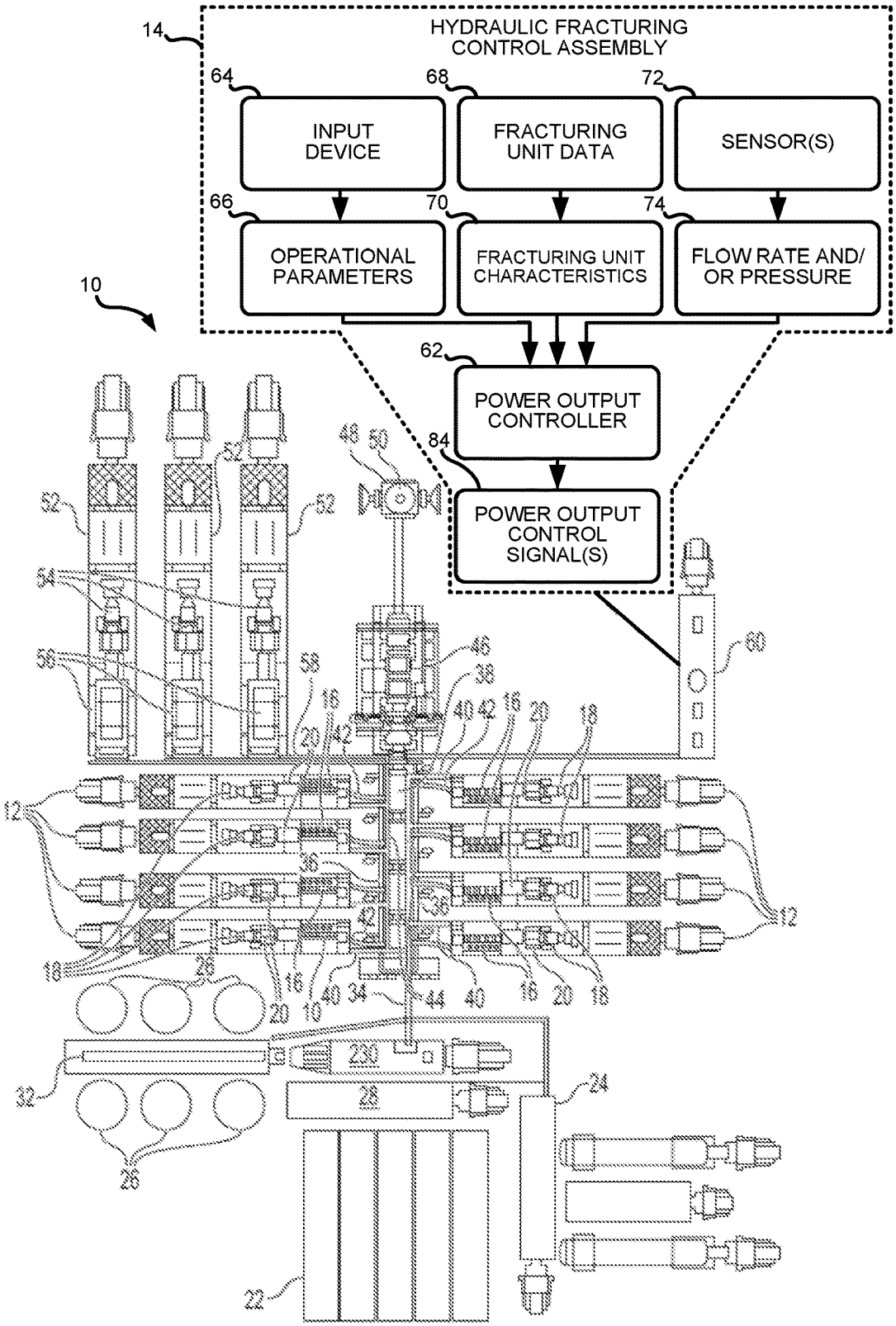
FIG. 1 schematically illustrates an example hydraulic fracturing system including a plurality of hydraulic fracturing units, and including a block diagram of a hydraulic fracturing control assembly according to embodiments of the disclosure.

FIG. 1 schematically illustrates a top view of an example hydraulic fracturing system 10 including a plurality of hydraulic fracturing units 12, and including a block diagram of a hydraulic fracturing control assembly 14 according to embodiments of the disclosure. In some embodiments, one or more of the hydraulic fracturing units 12 may include a hydraulic fracturing pump 16 driven by an internal combustion engine 18, such as a gas turbine engine or a reciprocating-piston engine and/or a non-gas turbine engine, such as a reciprocating-piston diesel engine. For example, in some embodiments, each of the hydraulic fracturing units 12 may include a directly-driven turbine (DDT) hydraulic fracturing pump 16, in which the hydraulic fracturing pump 16 is connected to one or more GTEs that supply power to the respective hydraulic fracturing pump 16 for supplying fracturing fluid at high pressure and high flow rates to a formation. For example, the GTE may be connected to a respective hydraulic fracturing pump 16 via a transmission 20 (e.g., a reduction transmission) connected to a drive shaft, which, in turn, is connected to a driveshaft or input flange of a respective hydraulic fracturing pump 16, which may be a reciprocating hydraulic fracturing pump. Other types of engine-to-pump coupling arrangements are contemplated.

In some embodiments, one or more of the GTEs may be a dual-fuel or bi-fuel GTE, for example, capable of being operated using of two or more different types of fuel, such as natural gas and diesel fuel, although other types of fuel are contemplated. For example, a dual-fuel or bi-fuel GTE may be capable of being operated using a first type of fuel, a second type of fuel, and/or a combination of the first type of fuel and the second type of fuel. For example, the fuel may include gaseous fuels, such as, for example, compressed natural gas (CNG), natural gas, field gas, pipeline gas, methane, propane, butane, and/or liquid fuels, such as, for example, diesel fuel (e.g., #2 diesel), bio-diesel fuel, bio-fuel, alcohol, gasoline, gasohol, aviation fuel, and other fuels as will be understood by those skilled in the art. Gaseous fuels may be supplied by CNG bulk vessels, a gas compressor, a liquid natural gas vaporizer, line gas, and/or well-gas produced natural gas. Other types and associated fuel supply sources are contemplated. The one or more internal combustion engines 18 may be operated to provide horsepower to drive the transmission 20 connected to one or more of the hydraulic fracturing pumps 16 to safely and successfully fracture a formation during a well stimulation project or fracturing operation.

In some embodiments, the fracturing fluid may include, for example, water, proppants, and/or other additives, such as thickening agents and/or gels. For example, proppants may include grains of sand, ceramic beads or spheres, shells, and/or other particulates, and may be added to the fracturing fluid, along with gelling agents to create a slurry as will be understood by those skilled in the art. The slurry may be forced via the hydraulic fracturing pumps 16 into the formation at rates faster than can be accepted by the existing pores, fractures, faults, or other spaces within the formation. As a result, pressure may build rapidly to the point where the formation fails and begins to fracture. By continuing to pump the fracturing fluid into the formation, existing fractures in the formation may be caused to expand and extend in directions away from a well bore, thereby creating additional flow paths to the well. The proppants may serve to prevent the expanded fractures from closing or may reduce the extent to which the expanded fractures contract when pumping of the fracturing fluid is ceased. Once the well is fractured, large quantities of the injected fracturing fluid may be allowed to flow out of the well, and the water and any proppants not remaining in the expanded fractures may be separated from hydrocarbons produced by the well to protect downstream equipment from damage and corrosion.

In some instances, the production stream may be processed to neutralize corrosive agents in the production stream resulting from the fracturing process.

In the example shown in FIG. 1, the hydraulic fracturing system 10 may include one or more water tanks 22 for supplying water for fracturing fluid, one or more chemical additive units 24 for supplying gels or agents for adding to the fracturing fluid, and one or more proppant tanks 26 (e.g., sand tanks) for supplying proppants for the fracturing fluid. The example fracturing system 10 shown also includes a hydration unit 28 for mixing water from the water tanks 22 and gels and/or agents from the chemical additive units 24 to form a mixture, for example, gelled water. The example shown also includes a blender 30, which receives the mixture from the hydration unit 28 and proppants via conveyers 32 from the proppant tanks 26. The blender 30 may mix the mixture and the proppants into a slurry to serve as fracturing fluid for the hydraulic fracturing system 10. Once combined, the slurry may be discharged through low-pressure hoses 34, which convey the slurry into two or more low-pressure lines 36 in a frac manifold 38. In the example shown, the low-pressure lines 36 in the frac manifold 38 feed the slurry to the hydraulic fracturing pumps 16 through low-pressure suction hoses 40.

The hydraulic fracturing pumps 16, driven by the respective internal combustion engines 18, discharge the slurry (e.g., the fracturing fluid including the water, agents, gels, and/or proppants) at high flow rates and/or high pressures through individual high-pressure discharge lines 42 into two or more high-pressure flow lines 44, sometimes referred to as "missiles," on the fracturing manifold 38. The flow from the high-pressure flow lines 44 is combined at the fracturing manifold 38, and one or more of the high-pressure flow lines 44 provide fluid flow to a manifold assembly 46, sometimes referred to as a "goat head." The manifold assembly 46 delivers the slurry into a wellhead manifold 48. The wellhead manifold 48 may be configured to selectively divert the slurry to, for example, one or more wellheads 50 via operation of one or more valves. Once the fracturing process is ceased or completed, flow returning from the fractured formation discharges into a flowback manifold, and the returned flow may be collected in one or more flowback tanks as will be understood by those skilled in the art.

As schematically depicted in FIG. 1, one or more of the components of the fracturing system 10 may be configured to be portable, so that the hydraulic fracturing system 10 may be transported to a well site, quickly assembled, operated for a relatively short period of time until completion of a fracturing operation, at least partially disassembled, and transported to another location of another well site for use. For example, the components may be carried by trailers and/or incorporated into trucks, so that they may be easily transported between well sites.

As shown in FIG. 1, some embodiments of the hydraulic fracturing system 10 may include one or more electrical power sources 52 configured to supply electrical power for operation of electrically powered components of the hydraulic fracturing system 10. For example, one or more of the electrical power sources 52 may include an internal combustion engine 54 (e.g., a GTE or a non-GTE engine, such as a reciprocating-piston engine) provided with a source of fuel (e.g., gaseous fuel and/or liquid fuel) and configured to drive a respective electrical power generation device 56 to supply electrical power to the hydraulic fracturing system 10. In some embodiments, one or more of the hydraulic fracturing units 12 may include electrical power generation capability, such as an auxiliary internal combustion engine and an auxiliary electrical power generation device driven by the auxiliary internal combustion engine. As shown is FIG. 1, some embodiments of the hydraulic fracturing system 10 may include electrical power lines 56 for supplying electrical power from the one or more electrical power sources 52 to one or more of the hydraulic fracturing units 12.

Some embodiments also may include a data center 60 configured to facilitate receipt and transmission of data communications related to operation of one or more of the components of the hydraulic fracturing system 10. Such data communications may be received and/or transmitted via hard-wired communications cables and/or wireless communications, for example, according to known communications protocols as will be understood by those skilled in the art. For example, the data center 60 may contain at least some components of the hydraulic fracturing control assembly 14, such as a power output controller 62 configured to receive signals from components of the hydraulic fracturing system 10 and/or communicate control signals to components of the hydraulic fracturing system 10, for example, to at least partially control operation of one or more components of the hydraulic fracturing system 10, such as, for example, the internal combustion engines 18, the transmissions 20, and/or the hydraulic fracturing pumps 16 of the hydraulic fracturing units 12, the chemical additive units 24, the hydration units 28, the blender 30, the conveyers 32, the fracturing manifold 38, the manifold assembly 46, the wellhead manifold 48, and/or any associated valves, pumps, and/or other components of the hydraulic fracturing system 10.

Figure 2:
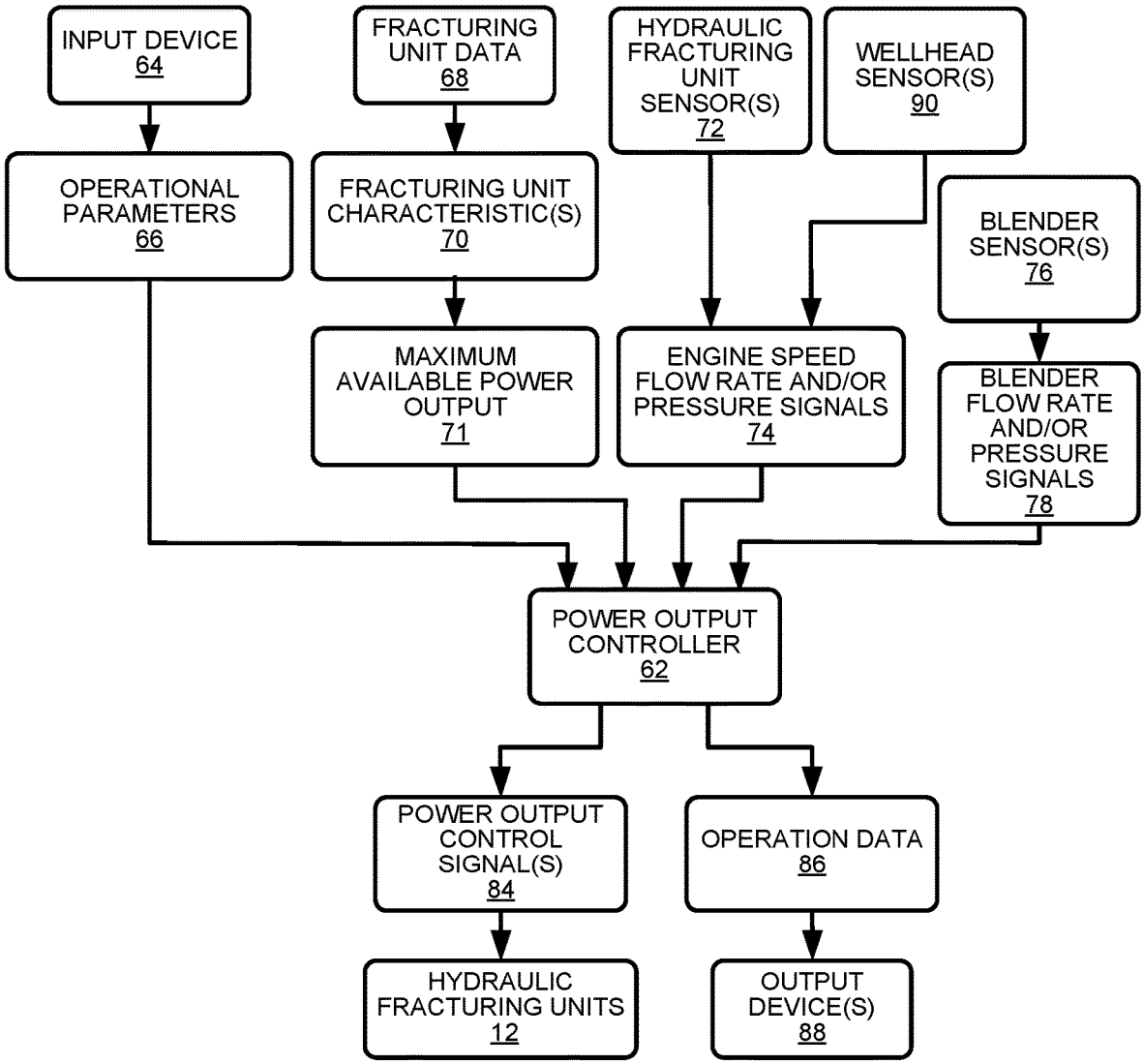
FIG. 2 is a block diagram of an example hydraulic fracturing control assembly according to an embodiment of the disclosure.

FIGS. 1 and 2 also include block diagrams of example hydraulic fracturing control assemblies 14 according to embodiments of the disclosure. Although FIGS. 1 and 2 depict certain components as being part of the example hydraulic fracturing control assemblies 14, one or more of such components may be separate from the hydraulic fracturing control assemblies 14. In some embodiments, the hydraulic fracturing control assembly 14 may be configured to semi- or fully-autonomously monitor and/or control operation of one or more of the hydraulic fracturing units 12 and/or other components of the hydraulic fracturing system 10, for example, as described herein. For example, the hydraulic fracturing control assembly 14 may be configured to operate a plurality of the hydraulic fracturing units 12, each of which may include a hydraulic fracturing pump 16 to pump fracturing fluid into a wellhead 50 and an internal combustion engine 18 to drive the hydraulic fracturing pump 16 via the transmission 20.

As shown in FIGS. 1 and 2, some embodiments of the hydraulic fracturing control assembly 14 may include an input device 64 configured to facilitate communication of operational parameters 66 to the power output controller 62. In some embodiments, the input device 64 may include a computer configured to provide one or more operational parameters 66 to the power output controller 62, for example, from a location remote from the hydraulic fracturing system 10 and/or a user input device, such as a keyboard linked to a display associated with a computing device, a touchscreen of a smartphone, a tablet, a laptop, a handheld computing device, and/or other types of input devices. In some embodiments, the operational parameters 66 may include, but are not limited to, a target flow rate, a target pressure, a maximum flow rate, a maximum available power output, and/or a minimum flow rate associated with fracturing fluid supplied to the wellhead 50. In some examples, one or more operators associated with a hydraulic fracturing operation performed by the hydraulic fracturing system 10 may provide one more of the operational parameters 66 to the power output controller 62, and/or one or more of the operational parameters 66 may be stored in computer memory and provided to the power output controller 62 upon initiation of at least a portion of the hydraulic fracturing operation.

For example, an equipment profiler (e.g., a fracturing unit profiler) may calculate, record, store, and/or access data related each of the hydraulic fracturing units 12 including fracturing unit characteristics 70, which may include, but not limited to, fracturing unit data including, maintenance data associated with the hydraulic fracturing units 12 (e.g., maintenance schedules and/or histories associated with the hydraulic fracturing pump 16, the internal combustion engine 18, and/or the transmission 20), operation data associated with the hydraulic fracturing units 12 (e.g., historical data associated with horsepower (e.g., hydraulic horsepower), fluid pressures, fluid flow rates, etc. associated with operation of the hydraulic fracturing units 12), data related to the transmissions 20 (e.g., hours of operation, efficiency, and/or installation age), data related to the internal combustion engines 18 (e.g., hours of operation, maximum rated available power output (e.g., hydraulic horsepower), and/or installation age), information related to the hydraulic fracturing pumps 16 (e.g., hours of operation, plunger and/or stroke size, maximum speed, efficiency, health, and/or installation age), equipment health ratings (e.g., pump, engine, and/or transmission condition), and/or equipment alarm history (e.g., life reduction events, pump cavitation events, pump pulsation events, and/or emergency shutdown events). In some embodiments, the fracturing unit characteristics 70 may include, but are not limited to minimum flow rate, maximum flow rate, harmonization rate, pump condition, and/or the maximum available power output 71 (e.g., the maximum rated available power output (e.g., hydraulic horsepower) of the internal combustion engines 18.

In the embodiments shown in FIGS. 1 and 2, the hydraulic fracturing control assembly 14 may also include one or more sensors 72 configured to generate one or more sensor signals 74 indicative of a flow rate of fracturing fluid supplied by a respective one of the hydraulic fracturing pump 16 of a hydraulic fracturing unit 12 and/or supplied to the wellhead 50, a pressure associated with fracturing fluid provided by a respective hydraulic fracturing pump 16 of a hydraulic fracturing unit 12 and/or supplied to the wellhead 50, and/or an engine speed associated with operation of a respective internal combustion engine 18 of a hydraulic fracturing unit 12. For example, one or more sensors 72 may be connected to one or more of the hydraulic fracturing units 12 and may be configured to generate signals indicative of a fluid pressure supplied by an individual hydraulic fracturing pump 16 of a hydraulic fracturing unit 12, a flow rate associated with fracturing fluid supplied by a hydraulic fracturing pump 16 of a hydraulic fracturing unit 12, and/or an engine speed of an internal combustion engine 18 of a hydraulic fracturing unit 12. In some examples, one or more of the sensors 72 may be connected to the wellhead 50 and may be configured to generate signals indicative of fluid pressure of hydraulic fracturing fluid at the wellhead 50 and/or a flow rate associated with the fracturing fluid at the wellhead 50. Other sensors (e.g., other sensor types for providing similar or different information) at the same or other locations of the hydraulic fracturing system 10 are contemplated.

As shown in FIG. 2, in some embodiments, the hydraulic fracturing control assembly 14 also may include one or more blender sensors 76 associated with the blender 30 and configured to generate blender signals 78 indicative of an output of the blender 30, such as, for example, a flow rate and/or a pressure associated with fracturing fluid supplied to the hydraulic fracturing units 12 by the blender 30. Operation of one or more of the hydraulic fracturing units 12 may be controlled, for example, to prevent the hydraulic fracturing units 12 from supplying a greater flow rate of fracturing fluid to the wellhead 50 than the flow rate of fracturing fluid supplied by the blender 30, which may disrupt the fracturing operation and/or damage components of the hydraulic fracturing units 12 (e.g., the hydraulic fracturing pumps 16).

As shown in FIGS. 1 and 2, some embodiments of the hydraulic fracturing control assembly 14 may include the power output controller 62, which may be in communication with the plurality of hydraulic fracturing units 12, the input device 64, and/or one or more of the sensors 72 and/or 76. For example, communications may be received and/or transmitted between the power output controller 62, the hydraulic fracturing units 12, and/or the sensors 72 and/or 76, via hard-wired communications cables and/or wireless communications, for example, according to known communications protocols, as will be understood by those skilled in the art.

In some embodiments, the power output controller 62 may be configured to receive one or more operational parameters 66 associated with pumping fracturing fluid into the one or more wellheads 50. For example, the operational parameters 66 may include a target flow rate, a target pressure, a maximum pressure, a maximum flow rate, a duration of fracturing operation, a volume of fracturing fluid to supply to the wellhead 50, and/or a total work performed during the fracturing operation, etc. The power output controller 62 also may be configured to receive one or more fracturing unit characteristics 70, for example, associated with each of the hydraulic fracturing pumps 16 and/or the internal combustion engines 18 of the respective hydraulic fracturing units 12. As described previously herein, in some embodiments, the fracturing unit characteristics 70 may include a minimum flow rate, a maximum flow rate, a harmonization rate, a pump condition 82 (individually or collectively), an internal combustion engine condition, a maximum power output of the internal combustion engines 18 (e.g., the maximum rated power output) provided by the corresponding hydraulic fracturing pump 16 and/or internal combustion engine 18 of a respective hydraulic fracturing unit 12. The fracturing unit characteristics 70 may be provided by an operator, for example, via the input device 64 and/or via a fracturing unit profiler, as described previously herein.

In some embodiments, the power output controller 62 may be configured to determine whether the hydraulic fracturing units 12 have a capacity sufficient to achieve the operational parameters 66. For example, the power output controller 62 may be configured to make such determinations based at least in part on one or more of the fracturing unit characteristics 70, which the power output controller 62 may use to calculate (e.g., via summation) the collective capacity of the hydraulic fracturing units 12 to supply a sufficient flow rate and/or a sufficient pressure to achieve the operational parameters 66 at the wellhead 50. For example, the power output controller 62 may be configured to determine an available power to perform the hydraulic fracturing operation (e.g., hydraulic horsepower) and/or a total pump flow rate by combining at least one of the fracturing unit characteristics 70 for each of the plurality of hydraulic fracturing pumps 16 and/or internal combustion engines 18, and comparing the available power to a required fracturing power sufficient to perform the hydraulic fracturing operation. In some embodiments, determining the available power may include adding the maximum available power output of each of the internal combustion engines 18.

In some embodiments, the power output controller 62 may be configured to receive one or more operational signals indicative of operational parameters 66 associated with pumping fracturing fluid into a wellhead 50 according to performance of a hydraulic fracturing operation. The power output controller 62 also may be configured to determine, based at least in part on the one or more operational signals, an amount of required fracturing power sufficient to perform the hydraulic fracturing operation. The power output controller 62 further may be configured to receive one or more characteristic signals indicative of the fracturing unit characteristics 70 associated with at least some of the plurality of hydraulic fracturing units 12. The power output controller 62 still further may be configured to determine, based at least in part on the one or more characteristic signals, an available power to perform the hydraulic fracturing operation. The power output controller 62 also may be configured to determine a power difference between the available power and the required power, and control operation of the at least some of the hydraulic fracturing units 12 (e.g., including the internal combustion engines 18) based at least in part on the power difference.

In some embodiments, the power output controller 62 may be configured to cause one or more of the at least some hydraulic fracturing units 12 to idle during the fracturing operation, for example, when the power difference is indicative of excess power available to perform the hydraulic fracturing operation. For example, the power output controller 62 may be configured to generate one or more power output control signals 84 to control operation of the hydraulic fracturing units 12, including the internal combustion engines 18. In some embodiments, the power output controller 62 may be configured to idle at least a first one of the hydraulic fracturing units 12 (e.g., the associated internal combustion engine 18) while operating at least a second one of the hydraulic fracturing units 12, wait a period of time, and idle at least a second one of the hydraulic fracturing units while operating the first one of the hydraulic fracturing units 12. For example, the power output controller 62 may be configured to cause alternating between idling and operation of the hydraulic fracturing units 12 to reduce idling time for any one of the hydraulic fracturing units. This may reduce or prevent wear and/or damage to the internal combustion engines 18 of the associated hydraulic fracturing units 12 due to extended idling periods.

In some embodiments, the power output controller 62 may be configured to receive one or more wellhead signals 74 indicative of a fracturing fluid pressure at the wellhead 50 and/or a fracturing fluid flow rate at the wellhead 50, and control idling and operation of the at least some hydraulic fracturing units based at least in part on the one or more wellhead signals 74. In this example manner, the power output controller 62 may be able to dynamically adjust (e.g., semi- or fully-autonomously) the power outputs of the respective hydraulic fracturing units 12 in response to changing conditions associated with pumping fracturing fluid into the wellhead 50. This may result in relatively more responsive and/or more efficient operation of the hydraulic fracturing system 10 as compared to manual operation by one or more operators, which in turn, may reduce machine wear and/or machine damage.

In some embodiments, when the power difference is indicative of a power deficit to perform the hydraulic fracturing operation, the power output controller 62 may be configured to increase a power output of one or more of the hydraulic fracturing units 12, which in some embodiments may include respective gas turbine engines (e.g., the associated internal combustion engine 18) to supply power to a respective hydraulic fracturing pump 14 of a respective hydraulic fracturing unit 12. For example, the power output controller 62 may be configured to increase the power output of the hydraulic fracturing units 12 including a gas turbine engine by increasing the power output from a first power output ranging from about 80% to about 95% of maximum rated power output (e.g., about 90% of the maximum rated power output) to a second power output ranging from about 90% to about 110% of the maximum rated power output (e.g., about 105% or 108% of the maximum rated power output).

For example, in some embodiments, the power output controller 62 may be configured to increase the power output of the hydraulic fracturing units 12 including a gas turbine engine 18 by increasing the power output from a first power output ranging from about 80% to about 95% of maximum rated power output to a maximum continuous power (MCP) or a maximum intermittent power (MIP) available from the GTE-powered fracturing units 12. In some embodiments, the MCP may range from about 95% to about 105% (e.g., about 100%) of the maximum rated power for a respective GTE-powered hydraulic fracturing unit 12, and the MIP may range from about 100% to about 110% (e.g., about 105% or 108%) of the maximum rated power for a respective GTE-powered hydraulic fracturing unit 12.

In some embodiments, for hydraulic fracturing units 12 including a non-GTE, such as a reciprocating-piston diesel engine, when the power difference is indicative of a power deficit to perform the hydraulic fracturing operation, the power output controller 62 may be configured to increase a power output of one or more of the hydraulic fracturing units 12 (e.g., the associated diesel engine) to supply power to a respective hydraulic fracturing pump 14 of a respective hydraulic fracturing unit 12. For example, the power output controller 62 may be configured to increase the power output of the hydraulic fracturing units 12 including a diesel engine by increasing the power output from a first power output ranging from about 60% to about 90% of maximum rated power output (e.g., about 80% of the maximum rated power output) to a second power output ranging from about 70% to about 100% of the maximum rated power output (e.g., about 90% of the maximum rated power output).

In some embodiments, when the power difference is indicative of a power deficit to perform the hydraulic fracturing operation, the power output controller 62 may be configured to store operation data 86 associated with operation of hydraulic fracturing units 12 operated at an increased power output. Such operation data 86 may be communicated to one or more output devices 88, for example, as previously described herein. In some examples, the operation data 86 may be communicated to a fracturing unit profiler for storage. The fracturing unit profiler, in some examples, may use at least a portion of the operation data 86 to update a fracturing unit profile for one or more of the hydraulic fracturing units 12, which may be used as fracturing unit characteristics 70 for the purpose of future fracturing operations.

In some examples, the power output controller 62 may calculate the required hydraulic power required to complete the fracturing operation (e.g., one or more fracturing stage) and may receive fracturing unit data 68 from a fracturing unit profiler for each hydraulic fracturing unit 12, for example, to determine the available power output. The fracturing unit profiler associated with each fracturing unit 12 may be configured to take into account any detrimental conditions the hydraulic fracturing unit 12 has experienced, such as cavitation or high pulsation events, and reduce the available power output of that hydraulic fracturing unit 12. The reduced available power output may be used by the power output controller 62 when determining a total power output available from all the hydraulic fracturing units 12 of the hydraulic fracturing system 10. The power output controller 62 may be configured to cause utilization of hydraulic fracturing units 12 including non-GTE-engines (e.g., reciprocating piston-diesel engines) at 80% of maximum power output (e.g., maximum rated power output), and hydraulic fracturing units including a GTE at 90% of maximum power output (e.g., maximum rated power output). The power output controller 62 may be configured to subtracts the total available power output by the required power output, and determine if it there is a power deficit or excess available power. If an excess of power is available, the power output controller 62 may be configured to cause some hydraulic fracturing units 12 to go to idle and only utilize hydraulic fracturing units 12 sufficient to achieve the previously mentioned power output percentages. Because, in some examples, operating the internal combustion engines 18 at idle for a prolonged period of time may not be advisable and may be detrimental to the health of the internal combustion engines 18, the power output controller 62 may be configured to cause the internal combustion engines 18 to be idled for an operator-configurable time period before completely shutting down.

If there is a deficit of available power, the power output controller 62 may be configured to facilitate the provision of choices for selection by an operator for addressing the power output deficit, for example, via the input device 64. For example, for hydraulic fracturing units 12 including a GTE, the GTE may be operated at maximum continuous power (e.g., 100% of the total power maximum power output) or at maximum intermittent power (MIP, e.g., ranging from about 105% to about 110% of the total maximum power output). If the increase the available power output is insufficient and other non-GTE-powered (e.g., diesel engine-powered) hydraulic fracturing units 12 are operating in combination with the GTE-powered hydraulic fracturing units 12, the power output controller 62 may be configured to utilize additional non-GTE-powered hydraulic fracturing units 12 to achieve the required power output.

Because, in some examples, operating the hydraulic fracturing units 12 (e.g., the internal combustion engines 18) at elevated power output levels may increase maintenance cycles, which may be recorded in the associated hydraulic fracturing unit profiler and/or the power output controller 62, during the hydraulic fracturing operation, the power output controller 62 may be configured to substantially continuously (or intermittently) provide a preferred power output utilization of the internal combustion engines 18 and may be configured to initiate operation of hydraulic fracturing units 12, for example, to (1) reduce the power loading on the internal combustion engines 18 if an increase in fracturing fluid flow rate is required and/or (2) idle at least some of the internal combustion engines 18 if a reduction in fracturing fluid flow rate is experienced. In some examples, this operational strategy may increase the likelihood that the hydraulic fracturing units 12 are operated at a shared load and/or that a particular one or more of the hydraulic fracturing units 12 is not being over-utilized, which may result in premature maintenance and/or wear. It may not be desirable for operation hours for each of the hydraulic fracturing units 12 to be the same as one another, which might result in a substantially-simultaneous or concurrent fleet-wide maintenance being advisable, which would necessitate shutdown of the entire fleet for maintenance. In some embodiments, the power output controller 62 may be configured to stagger idling cycles associated with the hydraulic fracturing units 12 to reduce the likelihood or prevent maintenance being required substantially simultaneously.

FIGS. 3, 4A, 4B, 4C, 4D, 4E, and 4F are block diagrams of example methods 300 and 400 of operating a plurality of hydraulic fracturing units according to embodiments of the disclosure, illustrated as a collection of blocks in a logical flow graph, which represent a sequence of operations. In the context of software, the blocks represent computer-executable instructions stored on one or more computer-readable storage media that, when executed by one or more processors, perform the recited operations. Generally, computer-executable instructions include routines, programs, objects, components, data structures, and the like that perform particular functions or implement particular data types. The order in which the operations are described is not intended to be construed as a limitation, and any number of the described blocks can be combined in any order and/or in parallel to implement the methods.

Figure 3:
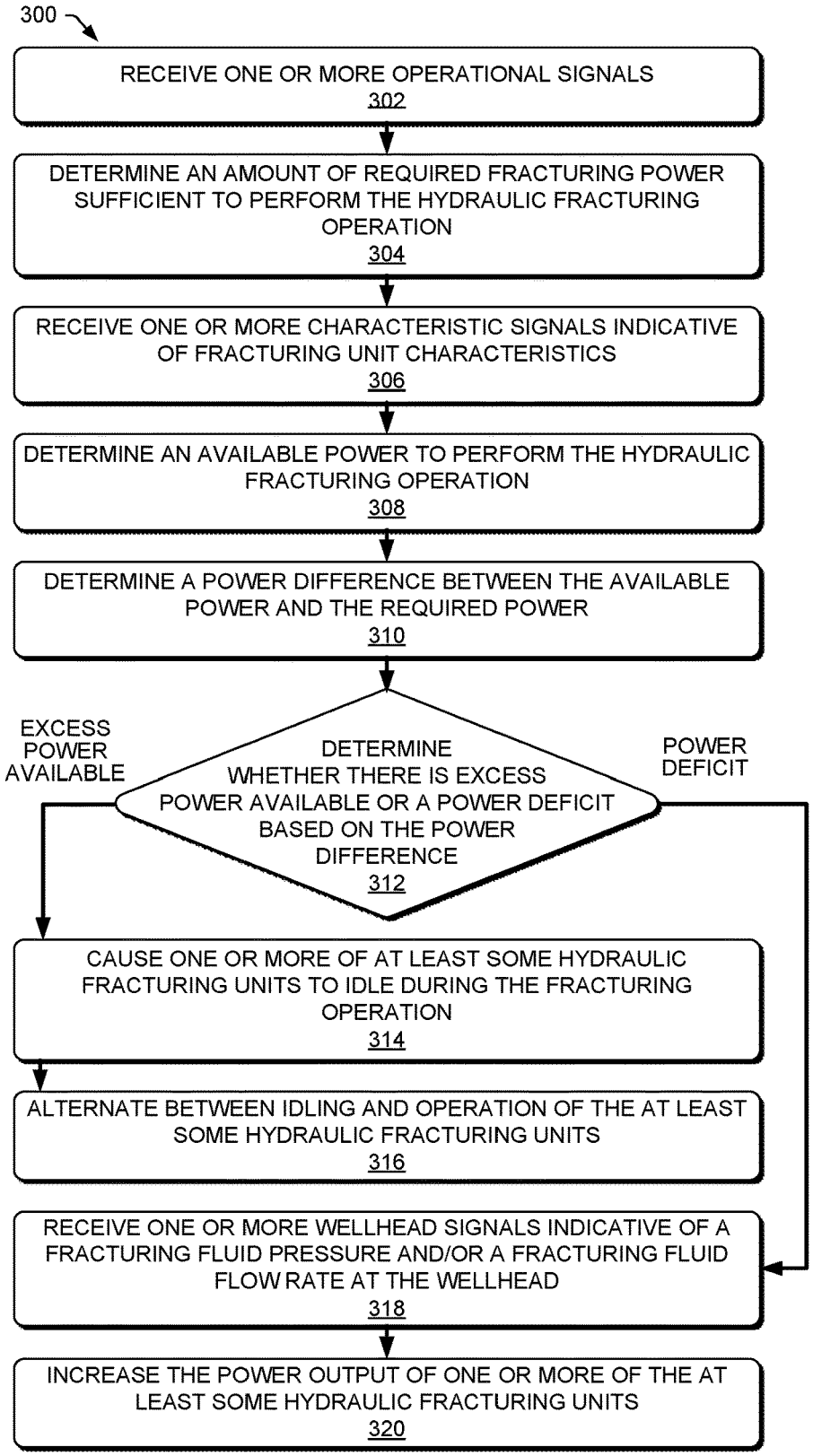
FIG. 3 is a block diagram of an example method of operating a plurality of hydraulic fracturing units according to embodiments of the disclosure.
Figure 4A:
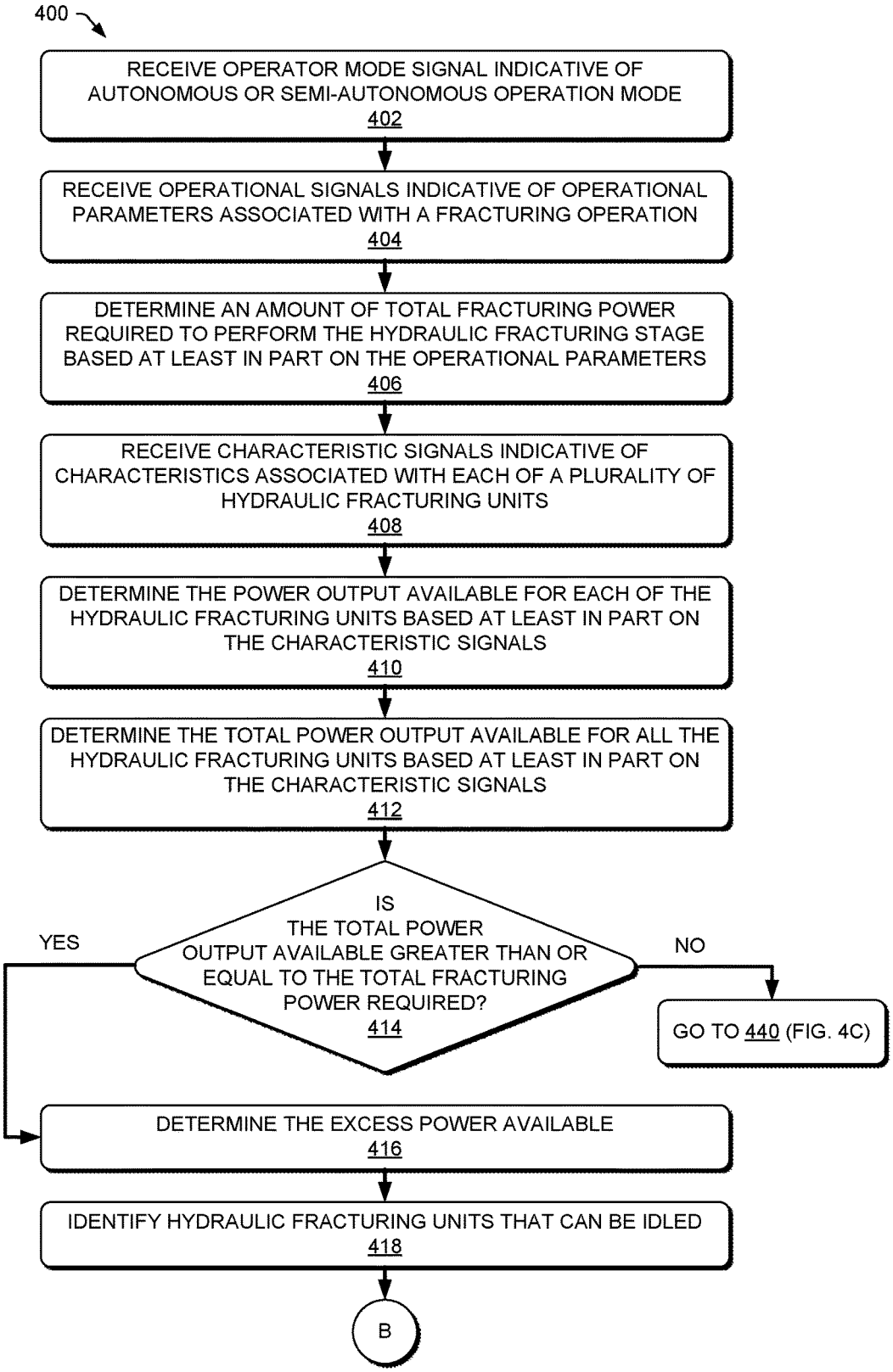
FIG. 4A is a block diagram of an example method of operating a plurality of hydraulic fracturing units according to embodiments of the disclosure.
Figure 4B:
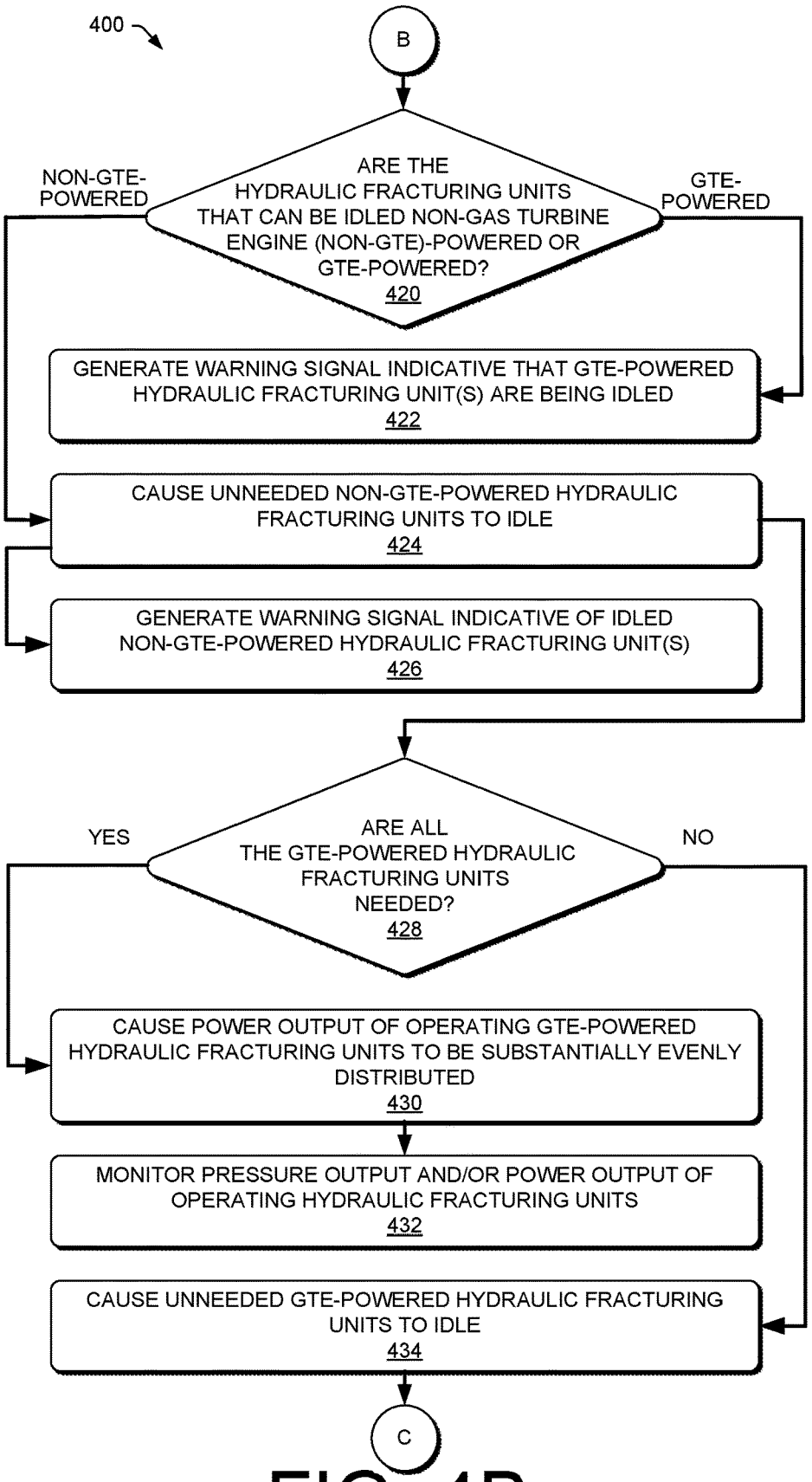
FIG. 4B is a continuation of the block diagram of the example method of operating a plurality of hydraulic fracturing units shown in FIG. 4A, according to embodiments of the disclosure.
Figure 4C:
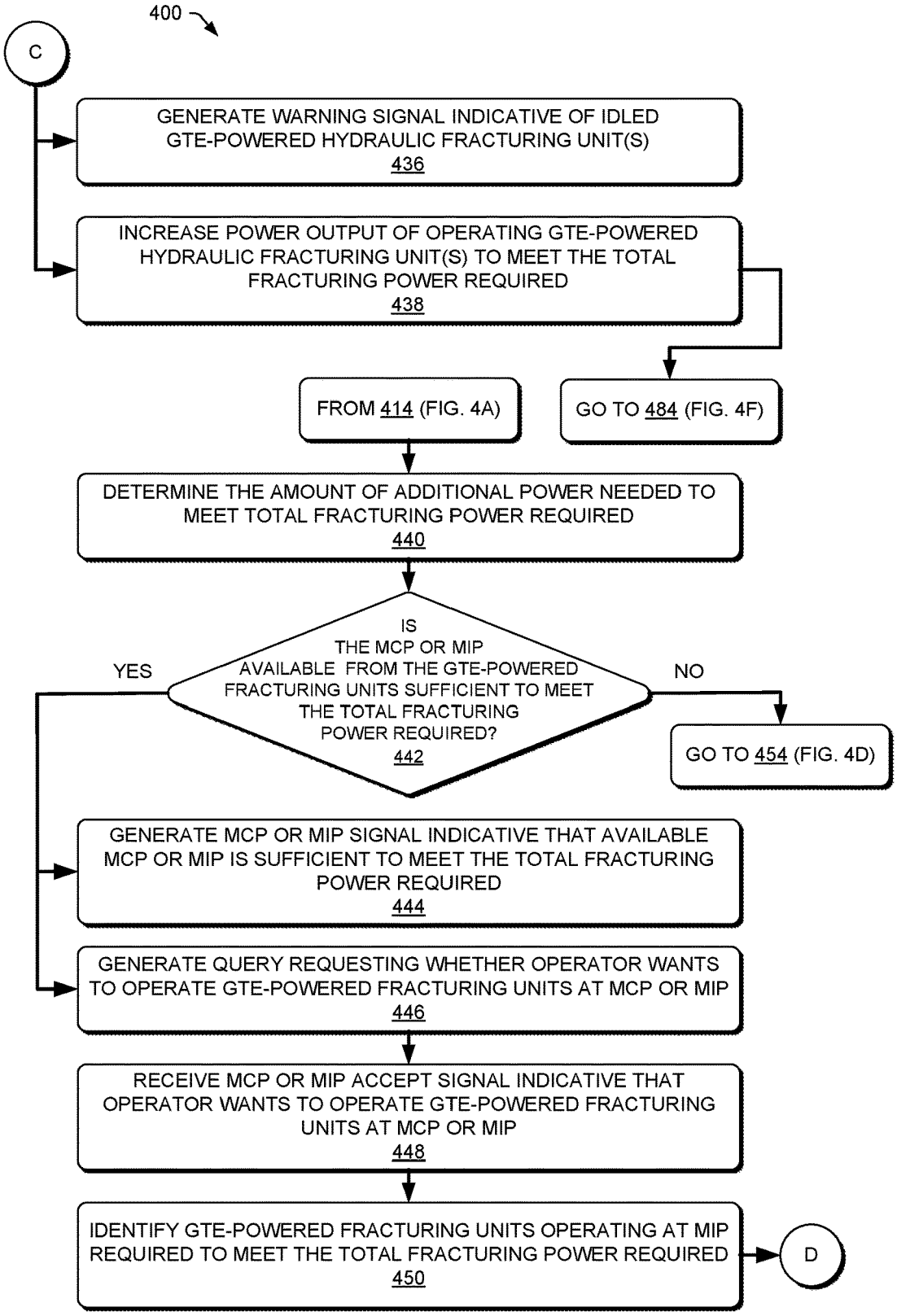
FIG. 4C is a continuation of the block diagram of the example method of operating a plurality of hydraulic fracturing units shown in FIGS. 4A and 4B, according to embodiments of the disclosure.
Figure 4D:
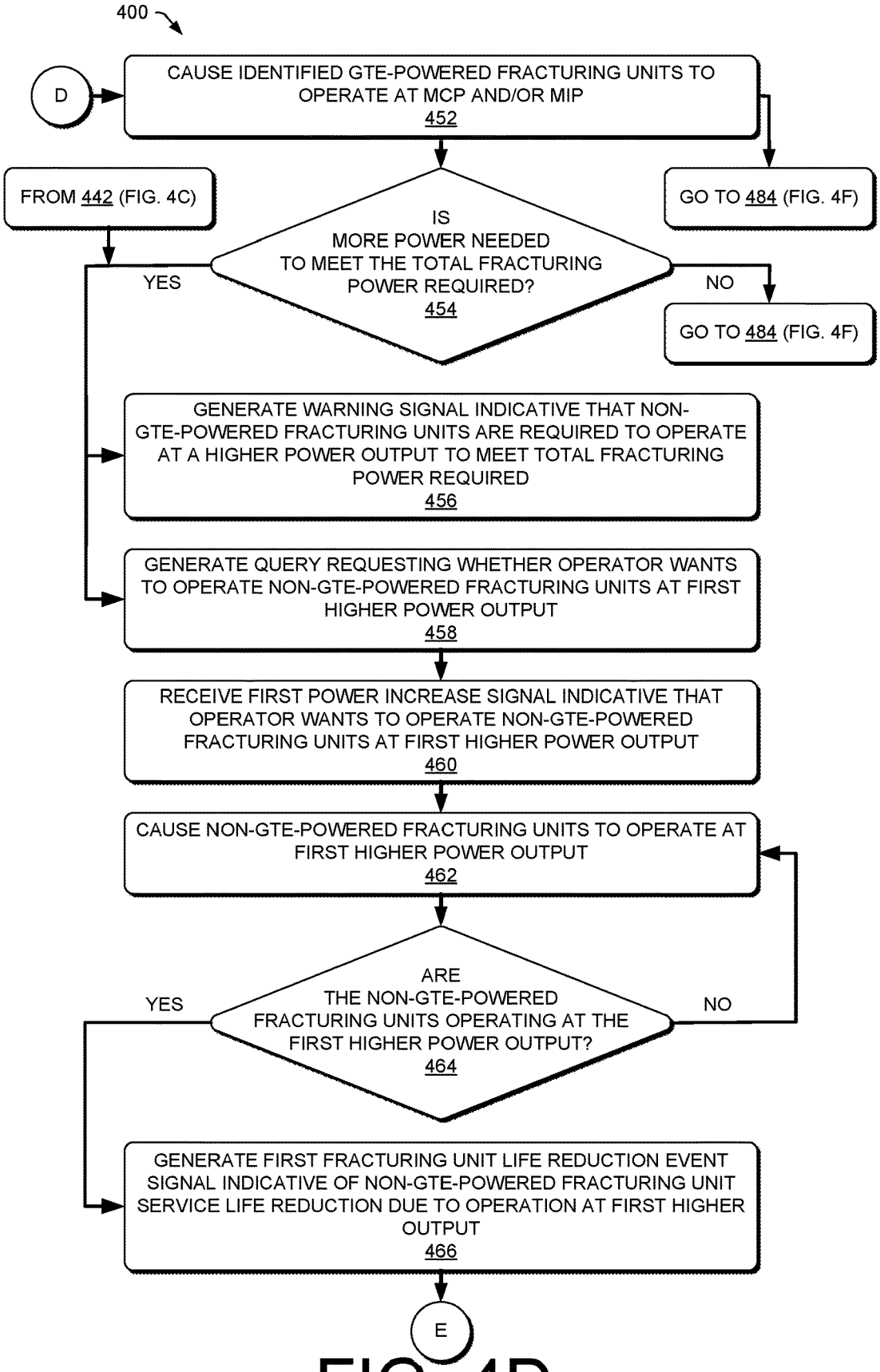
FIG. 4D is a continuation of the block diagram of the example method of operating a plurality of hydraulic fracturing units shown in FIGS. 4A, 4B, and 4C, according to embodiments of the disclosure.
Figure 4E:
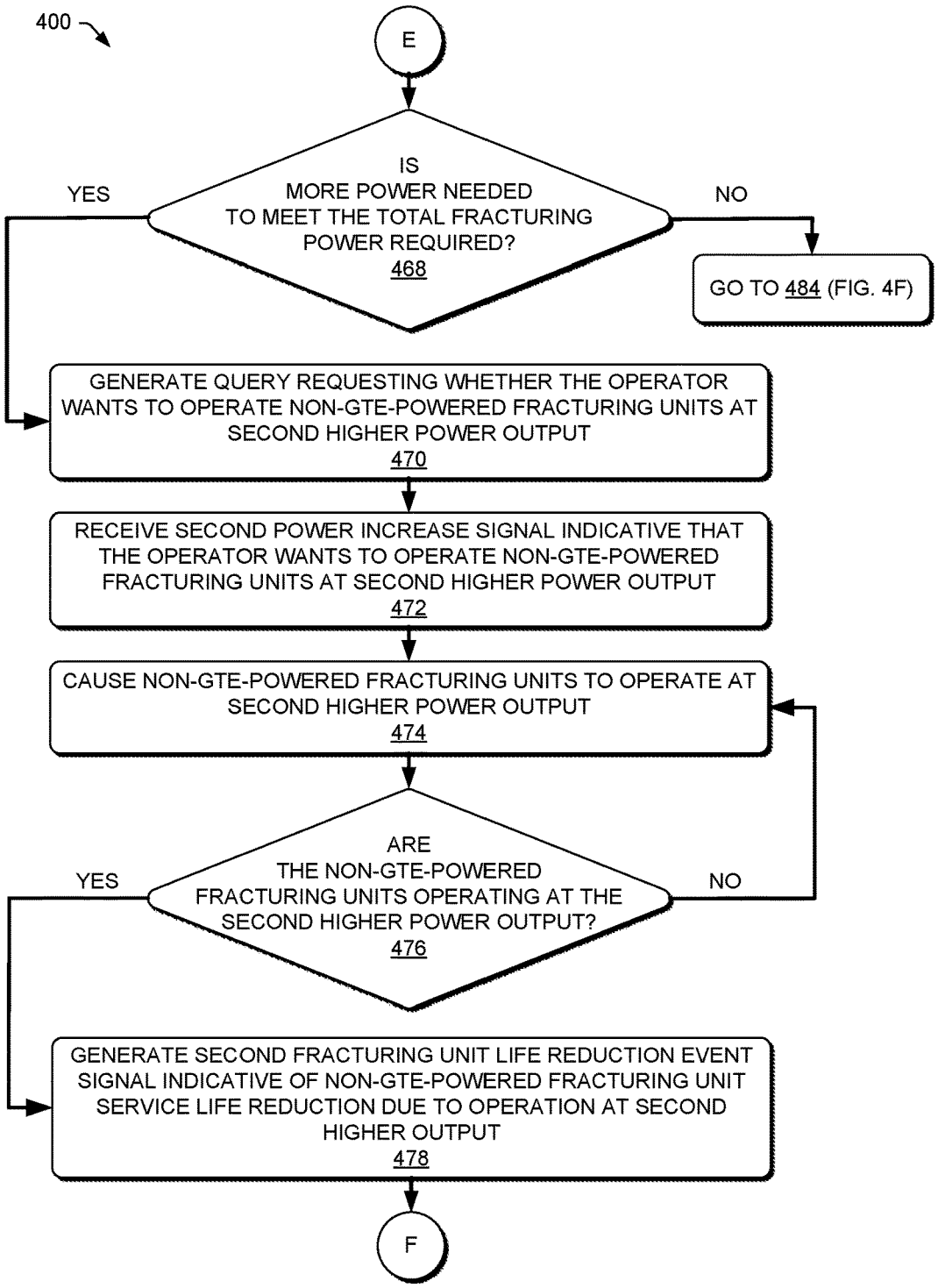
FIG. 4E is a continuation of the block diagram of the example method of operating a plurality of hydraulic fracturing units shown in FIGS. 4A, 4B, 4C, and 4D, according to embodiments of the disclosure.
Figure 4F:
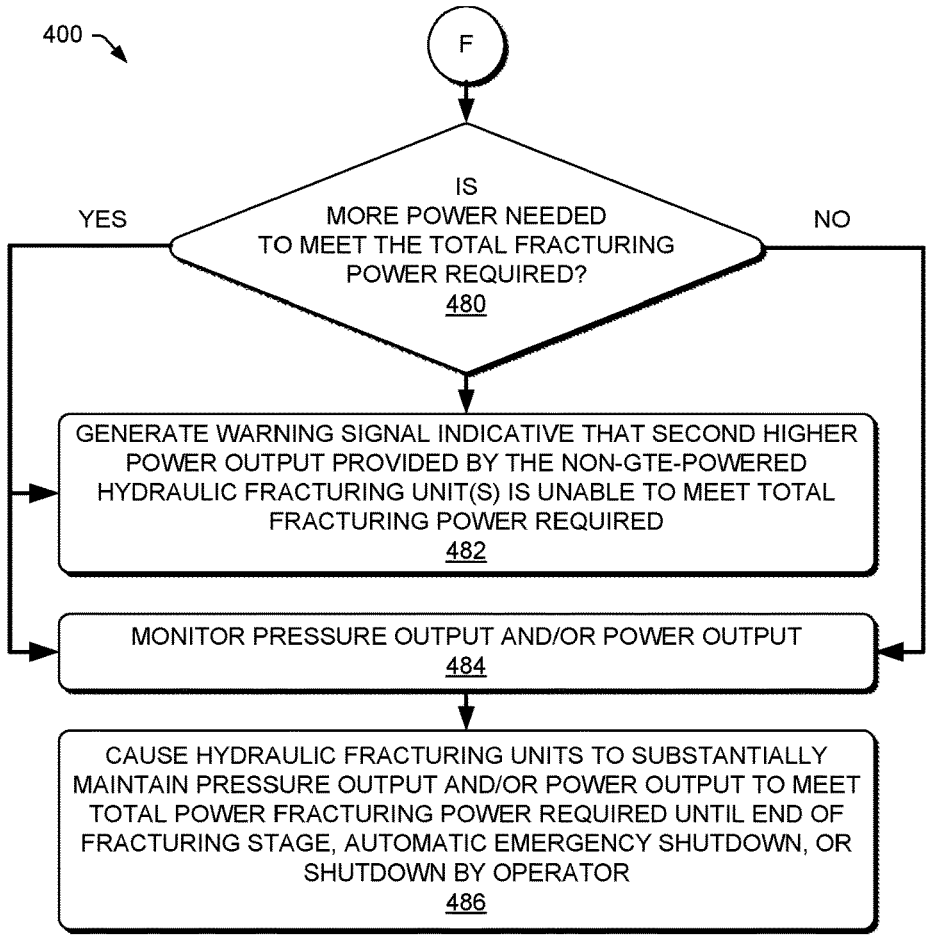
FIG. 4F is a continuation of the block diagram of the example method of operating a plurality of hydraulic fracturing units shown in FIGS. 4A, 4B, 4C, 4D, and 4E, according to embodiments of the disclosure

FIG. 3 depicts a flow diagram of an embodiment of a method 300 of operating a plurality of hydraulic fracturing units, according to an embodiment of the disclosure. For example, the example method 300 may be configured to control operation of one or more hydraulic fracturing units depending, for example, on an amount of available power from operation of the hydraulic fracturing units and an amount of required fracturing power sufficient to perform a hydraulic fracturing operation, for example, as previously described herein.

The example method 300, at 302, may include receiving one or more operational signals indicative of operational parameters associated with pumping fracturing fluid into a wellhead according to performance of a hydraulic fracturing operation. For example, an operator of the hydraulic fracturing system may use an input device to provide operational parameters associated with the fracturing operation. A power output controller may receive the operational parameters as a basis for controlling operation of the hydraulic fracturing units.

At 304, the example method 300 further may include determining, via the power output controller based at least in part on the one or more operational signals, an amount of required fracturing power sufficient to perform the hydraulic fracturing operation. For example, the power output controller may be configured to calculate the total power output available based at least in part on fracturing unit characteristics received from a fracturing unit profiler, for example, as previously described herein.

At 306, the example method 300 also may include receiving, at the power output controller, one or more characteristic signals indicative of fracturing unit characteristics associated with at least some of the plurality of hydraulic fracturing units, for example, as discussed herein.

At 308, the example method 300 may also include determining, for example, via the power output controller, based at least in part on the one or more characteristic signals, an available power to perform the hydraulic fracturing operation, for example, as described previously herein.

The example method 300, at 310, also may include determining, for example, via the power output controller, a power difference between the available power and the required power, for example, as previously described herein.

At 312, the example method 300 also may include determining, for example, via the power output controller, whether there is excess power available or a power deficit based on the power difference, for example, as described herein.

If, at 312, it is determined that excess power is available, the example method 300, at 314 may include causing one or more of the hydraulic fracturing units to idle during the fracturing operation, for example, as described herein.

At 316, the example, method 300 may include alternating between idling and operation of the hydraulic fracturing units to reduce idling time for any one of the hydraulic fracturing units, for example, as previously described herein. Depending on, for example, changing conditions associated with the fracturing operation, this may be continued substantially until completion of the fracturing operation. For example, this may include receiving, for example, at the power output controller, one or more wellhead signals indicative of a fracturing fluid pressure at the wellhead and/or a fracturing fluid flow rate at the wellhead, and controlling idling and operation of the hydraulic fracturing units based at least in part on the one or more wellhead signals.

If at 312, it is determined that a power deficit exists, the example method 300, at 318, may include receiving, for example, at the power output controller, one or more wellhead signals indicative of a fracturing fluid pressure at the wellhead and/or a fracturing fluid flow rate at the wellhead.

At 320, the example method 300 may include increasing a power output of one or more of the hydraulic fracturing units, for example, as described previously herein.

FIGS. 4A, 4B, 4C, 4D, 4E, and 4F depict a flow diagram of an embodiment of a method 400 of operating a plurality of hydraulic fracturing units, according to an embodiment of the disclosure. For example, the example method 400 may be configured to control operation of one or more hydraulic fracturing units depending, for example, on an amount of available power from operation of the hydraulic fracturing units and an amount of required fracturing power sufficient to perform a hydraulic fracturing operation, for example, as previously described herein.

The example method 400, at 402, may include receiving one or more operator mode signals indicative of an autonomous or a semi-autonomous operation mode associated with pumping fracturing fluid into a wellhead according to performance of a hydraulic fracturing operation. For example, an operator of the hydraulic fracturing system may use an input device to provide operator mode signals identifying the mode of operation of the hydraulic fracturing system as being either autonomous or semi-autonomous, for example, so that an operator of the hydraulic fracturing system does not need to manually adjust power outputs and/or fluid outputs of the hydraulic fracturing system on a regular basis during the fracturing operation. In some embodiments of the method 400, a power output controller may receive the operator mode signals and, based at least in part on the operator mode signals, cause one or more of the hydraulic fracturing units to autonomously or semi-autonomously control the power output (e.g., the hydraulic horsepower output) and/or fluid output associated with one or more of the hydraulic fracturing units, for example, in response to the conditions of the fracturing operation dynamically changing, for example, as described herein.

At 404, the example method 400 may include receiving one or more operational signals indicative of operational parameters associated with the fracturing operation. For example, an operator of the hydraulic fracturing system may use an input device to provide operational parameters associated with the fracturing operation. The power output controller may receive the operational parameters and use one or more of the operational parameters as a basis for controlling operation of the hydraulic fracturing units, for example, as previously described herein. In some embodiments, the operational signals may include the one or more operator mode signals mentioned above.

The example method 400, at 406, may include determining an amount of total fracturing power required (e.g., the total hydraulic horsepower required) to perform the hydraulic fracturing stage based at least in part on the operational parameters. For example, the power output controller may receive the operational parameters and calculate a total power required to complete the fracturing operation, for example, as described previously herein.

At 408, the example method 400 may include receiving characteristic signals indicative of characteristics associated with one or more (e.g., each) of a plurality of hydraulic fracturing units. For example, one or more equipment profilers (e.g., pump profilers) associated with one or more of the hydraulic fracturing units may communicate information relating to performance capabilities and/or limitations of the one or more hydraulic fracturing units. For example, an equipment profiler (e.g., a pump profiler) associated with each of the hydraulic fracturing units may communicate information to the power output controller indicative of the power output and/or pumping capabilities of the respective hydraulic fracturing unit, for example, as described previously herein.

At 410, the example method 400 may include determining the power output (e.g., the hydraulic horsepower) available for each of the hydraulic fracturing units based at least in part on the characteristic signals. For example, the power output controller, based at least in part on information included in the characteristic signals (e.g., the characteristics associated with the respective hydraulic fracturing unit), may be configured to calculate the power output and/or pumping capability of the respective hydraulic fracturing unit, for example, as described previously herein.

The example method 400, at 412, may include determining the total power output (e.g., the hydraulic horsepower output) available for all the hydraulic fracturing units based at least in part on the characteristic signals. For example, the power output controller may be configured to calculate the total power output available for all the operational hydraulic fracturing units by adding or summing the respective power output capabilities of each of the operational hydraulic fracturing units of the hydraulic fracturing system, for example, as previously described herein. In some embodiments, the total power output available may be determined based at least in part on the pump pressure provided during a previous job (e.g., an immediately previous job) multiplied by the maximum rate provided during the previous job. In some embodiments, the power output controller may be configured to calculate the total power output available by multiplying each of the respective rated maximum power outputs of each of the non-GTE-powered hydraulic fracturing units (e.g., the diesel-powered hydraulic fracturing units) by a non-GTE power factor (e.g., ranging from about 70% to about 90% (e.g., about 80%)) and summing each of the non-GTE power outputs to determine a total non-GTE-powered fracturing unit power output, and multiplying each of the respective rated maximum power outputs of each of the GTE-powered hydraulic fracturing units by a GTE power factor (e.g., ranging from about 85% to about 95% (e.g., about 90%)) and summing each of the GTE power outputs to determine a total GTE-powered fracturing unit power output. Thereafter, the power output controller may be configured to determine the total power output available for the hydraulic fracturing system by adding the total non-GTE power output to the total GTE power output.

At 414, the example method 400 may include determining whether the total power output available is greater than or equal to the total fracturing power required. For example, the power output controller may be configured to subtract the total fracturing power required from the total power output available and determine whether the result is greater than or equal to zero. If not, example method may go to 440 (see FIG. 4C).

If at 414, it is determined that the total power output available is greater than or equal to the total fracturing power required, at 416, the example method 400 may include determining the excess power available (if any).

At 418, the example method 400 may include identifying hydraulic fracturing units that may be idled, for example, while the remaining operational hydraulic fracturing units have the capacity to provide the total fracturing power required. For example, if at 416, it is determined that excess power is available, based at least in part on the characteristic signals received from the equipment profilers, the power output controller may be configured to identify the hydraulic fracturing units that may be idled while still having a sufficient amount of fracturing power available from the remaining (non-idled) hydraulic fracturing units to provide the total fracturing power required to successfully complete the fracturing operation (e.g., a fracturing stage).

At 420 (FIG. 4B), the example method 400 may include determining whether the hydraulic fracturing units that can be idled are non-gas turbine engine (non-GTE)-powered (e.g., reciprocating-piston diesel-powered) or GTE-powered fracturing units. For example, the power output controller may be configured to determine whether the total fracturing power required can be provided solely by GTE-powered hydraulic fracturing units. In some embodiments, using only GTE-powered hydraulic fracturing may result in more efficient completion of the fracturing stage relative to the use of non-GTE-powered fracturing units, such as diesel-powered fracturing units.

If, at 420, it is determined that GTE-powered fracturing units will be idled, at 422, the example method 400 may include generating warning signal indicative that one or more GTE-powered hydraulic fracturing unit(s) are being idled. For example, the power output controller may be configured to generate such a warning signal, which may be communicated to an operator, for example, via a communication device, such as a visual display configured communicate the warning to the operator. The warning may be visual, audible, vibrational, haptic, or a combination thereof.

If, at 420, it is determined that only non-GTE-powered hydraulic fracturing units will be idled, at 424, the example method may include causing unneeded non-GTE-powered hydraulic fracturing units to idle. In some embodiments, for non-GTE-powered fracturing units being idled, the method may also include idling one or more of the fracturing units for a period of time and thereafter shutting down the non-GTE engines of those one or more idled fracturing units.

At 426, the method may further include generating a warning signal indicative of the idling of the one or more non-GTE-powered hydraulic fracturing units being idled. For example, the power output controller may be configured to communicate such a warning signal to a communication device, for example, as described above.

At 428, the example method 400 may include determining whether all the GTE-powered hydraulic fracturing units are needed to meet the total power required for successfully completing the hydraulic fracturing operation (e.g., the fracturing stage). For example, the power output controller may be configured to determine the total power output available from all the GTE-powered fracturing units not idled and determining whether that is greater than or equal to the total power required.

If, at 428, it is determined that all the GTE-powered hydraulic fracturing units are needed to meet the total power required, at 430, the example method 400 may include causing the power output of the operating GTE-powered hydraulic fracturing units to be substantially evenly distributed to meet the total power required. For example, the power output controller may be configured to communicate control signals to the GTE-powered hydraulic fracturing units to cause the appropriate power output (e.g., hydraulic horsepower output) by the respective GTE-powered hydraulic fracturing units.

At 432, the example method 400 may include monitoring pressure output and/or power output of operating GTE-powered hydraulic fracturing units during the hydraulic fracturing operation and, in some examples, dynamically adjusting the power output of the GTE-powered hydraulic fracturing units autonomously or semi-autonomously as fracturing conditions change.

At 434, the example method 400 may include causing unneeded GTE-powered hydraulic fracturing units to idle. For example, the power output controller may be configured to communicate control signals to the GTE-powered hydraulic fracturing units to cause the appropriate respective GTE-powered hydraulic fracturing units to idle. Also, if, at 428, it is determined that not all the GTE-powered hydraulic fracturing units are needed to meet the total power required, the example method 400 may advance to 434, and the example method 400 may include causing unneeded GTE-powered hydraulic fracturing units to idle. In some embodiments, the power output controller may be configured to cause one or more of the idled hydraulic fracturing units to shut down, for example, after a period of time. In some embodiments, the power output controller may be configured to cause all, or a subset, of the hydraulic fracturing units to alternate between operation and idling, for example, while continuing to perform the fracturing operation.

At 436 (FIG. 4C), the example method 400 may include generating a warning signal indicative of idled GTE-powered hydraulic fracturing units being idled. For example, the power output controller may be configured to communicate such a warning signal to a communication device, for example, as described above.

At 438, the example method 400 may include increasing the power output of one or more of the operating (un-idled) GTE-powered hydraulic fracturing units to meet the total fracturing power required. For example, the power output controller may be configured to communicate control signals to the un-idled GTE-powered hydraulic fracturing units to cause one or more of the GTE-powered hydraulic fracturing units to increase, if necessary, to collectively provide sufficient power to meet the total fracturing power required. Thereafter, the example method 400, in some embodiments, may advance to 484 (see FIG. 4F) and may include monitoring the pressure output and/or the power output of the operating hydraulic fracturing units, and, at 486, causing the operating hydraulic fracturing units to substantially maintain pressure output and/or power output to meet the total power fracturing power required until the end of the fracturing stage, an automatic emergency shutdown occurs, or shut down by an operator occurs.

If, at 414 (see FIG. 4A), it is determined that the total power output available is less than the total fracturing power required, at 440, the example method 400 may include determining the amount of additional power needed to meet the total fracturing power required. For example, the power output controller may be configured to calculate the difference between the total power output available and the total fracturing power required to arrive at the additional power needed to meet the total fracturing power required.

At 442, the example method 400 may include determining whether the maximum continuous power (MCP) or the maximum intermittent power (MIP) available from the GTE-powered fracturing units is sufficient to meet the total fracturing power required. In some embodiments, the MCP may range from about 95% to about 105% (e.g., about 100%) of the maximum rated power for a respective GTE-powered hydraulic fracturing unit, and the MIP may range from about 100% to about 110% (e.g., about 105% or 108%) of the maximum rated power for a respective GTE-powered hydraulic fracturing unit. In some embodiments, the power output controller may be configured to determine the MCP and/or the MIP for each of the respective GTE-powered hydraulic fracturing units, for example, based at least in part in the characteristic signals for each of the respective hydraulic fracturing units, and calculate the total MCP output and/or the total MIP output available for all the GTE-powered hydraulic fracturing units and determine whether the total available MCP and/or MIP is greater than or equal to the total fracturing power required.

If, at 442, it is determined that the MCP or MIP available from the GTE-powered fracturing units is not sufficient to meet the total fracturing power required, the example method 400 may include advancing to 454 (FIG. 4D), and may include determining whether more power is needed to meet the total fracturing power required. If not, the example method may further include advancing to 484 (see FIG. 4F) and monitoring the pressure output and/or the power output of the operating hydraulic fracturing units. Thereafter, at 486, the example method 400 may further include causing the operating hydraulic fracturing units to substantially maintain pressure output and/or power output to meet the total power fracturing power required until the end of the fracturing stage, an automatic emergency shutdown occurs, or shut down by an operator occurs.

If, at 442, it is determined that the MCP or MIP available from the GTE-powered fracturing units is sufficient to meet the total fracturing power required, the example method 400, at 444, may include generating one or more MCP or MIP signals indicative that available MCP or MIP of the GTE-powered hydraulic fracturing units is sufficient to meet the total fracturing power required. For example, the power output controller may be configured to communicate an MCP or MIP signal to a communication device, for example, as described above, for advising an operator that the MCP or MIP available from the GTE-powered fracturing units is sufficient to meet the total fracturing power required.

At 446, the example method 400 may include generating a query requesting whether an operator wants to operate the GTE-powered fracturing units at MCP or MIP. For example, the power output controller may be configured to communicate a prompt or query to a communication device, for example, as described above, for requesting whether an operator wants to operate the GTE-powered fracturing units at MCP or MIP to meet the total fracturing power required.

The example method, at 448, may include receiving an MCP or MIP accept signal indicative that operator wants to operate GTE-powered fracturing units at MCP or MIP, for example, to meet the total fracturing power required. For example, the power output controller may be configured to receive a response to the query at 446 from an operator via a communications link.

At 450, if the MCP or MIP accept signal is received, the example method 400 may include identifying the GTE-powered fracturing units operating at MCP or MIP required to meet the total fracturing power required. For example, the power output controller may be configured to determine the GTE-powered hydraulic fracturing units required to be operated at MCP or MIP to meet the total fracturing power required. In some embodiments, all the operating GTE-powered fracturing units may be operated at MCP, some of the operating GTE-powered fracturing units may be operated at MCP, all the operating GTE-powered fracturing units may be operated at MIP, some of the operating GTE-powered fracturing units may be operated at MIP, or some of the operating GTE-powered fracturing units may be operated at MCP while the other operating GTE-powered fracturing units may be operated at MIP.

At 452, the example method may include causing the GTE-powered hydraulic fracturing units identified at 450 to operate at MCP and/or MIP. For example, the power output controller may be configured to communicate control signals to the identified GTE-powered hydraulic fracturing units such that they operate at MCP and/or MIP. Thereafter, the example method 400 may include advancing to 484 (FIG. 4F), and the pressure output and/or the power output of the GTE-powered hydraulic fracturing units may be monitored, including those operating at MCP and/or MIP. Thereafter, at 486, the example method 400 may further include causing the operating hydraulic fracturing units to substantially maintain pressure output and/or power output to meet the total power fracturing power required until the end of the fracturing stage, automatic emergency shutdown, or shut down by operator.

At 454, the example method 400 may include determining whether more power is needed (e.g., beyond the GTE-powered hydraulic fracturing units operating at MCP and/or MIP and the non-GTE-powered operating at the rated maximum power discounted by the first non-GTE power factor (e.g., at about 80% of maximum rated power)) to meet the total fracturing power required. For example, if all the GTE-powered hydraulic fracturing units are operating at MCP or MIP and all the non-GTE-powered hydraulic fracturing units are operating at rated maximum power discounted by the first non-GTE power factor, and this is still insufficient to meet the total fracturing power required, the method 400, at 454, may include determining whether more power is needed to meet the total fracturing power required.

If, at 454, it is determined that no additional power is need to meet the total fracturing power required, the example method 400 may advance to 484 (FIG. 4F), and the pressure output and/or the power output of the GTE-powered hydraulic fracturing units operating at MCP and/or MIP may be monitored. Thereafter, at 486, the example method 400 may further include causing the operating hydraulic fracturing units to substantially maintain pressure output and/or power output to meet the total power fracturing power required until the end of the fracturing stage, an automatic emergency shutdown occurs, or shut down by an operator occurs.

If, at 454, or at 442, it is determined that the MCP and/or MIP available from the GTE-powered fracturing units is not sufficient to meet the total fracturing power required, the example method 400 may advance to 456, and may include generating a warning signal indicative that non-GTE-powered fracturing units are required to operate at a higher power output (e.g., higher than maximum rated output discounted by the first non-GTE power factor) to meet the total fracturing power required. Since the GTE-powered hydraulic fracturing units operating at MCP and/or MIP, combined with the non-GTE-powered hydraulic fracturing units operating at maximum rated power discounted by the first non-GTE power factor, are not able to meet the total fracturing power required, the power output controller may determine that additional power is required to meet the total fracturing power required, and thus, an option may be operating the non-GTE-powered hydraulic fracturing units a power output higher than the maximum rated power discounted by the first non-GTE power factor. Thus, the power output controller, in some embodiments, may be configured to communicate a warning signal to a communication device, for example, as described above, indicative that non-GTE-powered fracturing units are required to operate at a higher power output to meet the total fracturing power required.

At 458, the example method 400 may include generating a query requesting whether an operator wants to operate non-GTE-powered fracturing units at a first higher power output, such as, for example, a power output ranging from about 80% to about 90% of the maximum rated power output. For example, the power output controller may be configured to communicate a prompt or query to a communication device, for example, as described above, for requesting whether an operator wants to operate the non-GTE-powered hydraulic fracturing units at the first higher power output to meet the total fracturing power required.

The example method, at 460, may include receiving a first power increase signal indicative that the operator wants to operate non-GTE-powered hydraulic fracturing units at the first higher power output. For example, the power output controller may be configured to receive a response to the query at 456 from an operator via a communications link. If no first power increase signal is received, the example method 400 may include advancing to 484 (FIG. 4F), and the pressure output and/or the power output of the GTE-powered and non-GTE-powered hydraulic fracturing units may be monitored. Thereafter, at 486, the example method 400 may further include causing the operating hydraulic fracturing units to substantially maintain the available pressure output and/or power output until the end of the fracturing stage, an automatic emergency shutdown occurs, or shut down by an operator occurs.

At 462, if at 460 the first power increase signal is received, the example method 400 may include causing the non-GTE-powered fracturing units to operate at the first higher power output. For example, the power output controller may be configured to communicate control signals to the non-GTE-powered hydraulic fracturing units to cause one or more of the non-GTE-powered hydraulic fracturing units to increase power output to the first increased power output level.

The example method 400, at 464, may include determining whether the non-GTE-powered fracturing units are operating at the first higher power output. If not, the example method 400 may return to 462 to cause the non-GTE-powered hydraulic fracturing units to operate at the first higher power output and/or or communicate a signal to the operator indicative of the failure of the non-GTE-powered hydraulic fracturing units to operate at the first higher output.

If, at 464, it is determined that the non-GTE-powered fracturing units are operating at the first higher power output, at 466, the example method 400 may include generating a first fracturing unit life reduction event signal indicative of a reduction of the service life of the non-GTE-powered fracturing units operating at the first higher output. Because operating the non-GTE-powered hydraulic fracturing units at the first higher output may increase the wear rate of the affected hydraulic fracturing units, the power output controller may generate one or more first fracturing unit life reduction event signals, which may be communicated and/or stored in the equipment profiler(s) associated with each of the affected hydraulic fracturing units. This may be taken into account in the future when determining unit health metrics and/or service intervals for one or more components of the affected units.

At 468 (FIG. 4E), the example method 400 may include determining whether more power is needed to meet the total fracturing power required. If it is determined that no additional power is needed to meet the total fracturing power required, the example method 400 may advance to 484 (FIG. 4F), and the pressure output and/or the power output of the GTE-powered hydraulic fracturing units operating at MCP and/or MIP and the non-GTE-powered hydraulic fracturing units operating at the first higher output may be monitored. Thereafter, at 486, the example method 400 may further include causing the operating hydraulic fracturing units to substantially maintain pressure output and/or power output to meet the total power fracturing power required until the end of the fracturing stage, an automatic emergency shutdown occurs, or shut down by an operator occurs.

If at 468, it is determined that additional power is needed to meet the total fracturing power required, the example method 400, at 470, may include generating a query requesting whether an operator wants to operate non-GTE-powered fracturing units at a second higher power output, such as, for example, ranging from about 85% to about 95% (e.g., at about 90%) of the maximum rated power output. For example, the power output controller may be configured to communicate a prompt or query to a communication device, for example, as described above, for requesting whether an operator wants to operate the non-GTE-powered hydraulic fracturing units at the second higher power output to meet the total fracturing power required.

The example method, at 472, may include receiving a second power increase signal indicative that the operator wants to operate non-GTE-powered hydraulic fracturing units at the second higher power output. For example, the power output controller may be configured to receive a response to the query at 470 from an operator via a communications link. If no second power level signal is received, the example method 400 may include advancing to 484 (FIG. 4F), and the pressure output and/or the power output of the GTE-powered and non-GTE-powered hydraulic fracturing units may be monitored. Thereafter, at 486, the example method 400 may further include causing the operating hydraulic fracturing units to substantially maintain the available pressure output and/or power output until end of the fracturing stage, an automatic emergency shutdown occurs, or shut down by the operator occurs.

At 474, if at 472 the second power increase signal is received, the example method 400 may include causing the non-GTE-powered fracturing units to operate at the second higher power output. For example, the power output controller may be configured to communicate control signals to the non-GTE-powered hydraulic fracturing units to cause one or more of the non-GTE-powered hydraulic fracturing units to increase power output to the second increased power output level.

The example method 400, at 476, may include determining whether the non-GTE-powered fracturing units are operating at the second higher power output. If not, the example method 400 may return to 474 to cause the non-GTE-powered hydraulic fracturing units to operate at the second higher power output and/or or communicate a signal to the operator indicative of the failure of the non-GTE-powered hydraulic fracturing units to operate at the second higher output.

If, at 476, it is determined that the non-GTE-powered fracturing units are operating at the second higher power output, at 478, the example method 400 may include generating a second fracturing unit life reduction event signal indicative of a reduction of the service life of the non-GTE-powered fracturing units operating at the second higher output. Because operating the non-GTE-powered hydraulic fracturing units at the second higher output may increase the wear rate of the affected hydraulic fracturing units, the power output controller may generate one or more second fracturing unit life reduction event signals, which may be communicated and/or stored in the equipment profiler(s) associated with each of the affected hydraulic fracturing units. This may be taken into account in the future when determining unit health metrics and/or service intervals for one or more components of the affected units.

At 480 (FIG. 4F), the example method 400 may include determining whether more power is needed to meet the total fracturing power required. For example, the power output controller may be configured to determine whether, with the GTE-powered hydraulic fracturing units operating at MCP and/or MIP and the non-GTE-powered hydraulic fracturing units operating at the second higher output, the hydraulic fracturing units are still providing insufficient power output.

If so, at 482, the example method 400 may include generating a warning signal indicative that a second higher power output provided by the non-GTE-powered hydraulic fracturing units is unable to meet the total fracturing power required, and at 484, the example method 400 may include monitoring the pressure output and/or power output of the hydraulic fracturing units. If, at 480, it is determined that no additional power is needed to meet the total fracturing power required, the example method 400 may advance to 484 (e.g., without generating the warning signal of 482), and the example method 400 may include monitoring the pressure output and/or power output of the hydraulic fracturing units.

At 486, the example method 400 may include causing the hydraulic fracturing units to substantially maintain pressure output and/or power output to meet the total power fracturing power required until the end of the fracturing stage, an automatic emergency shutdown occurs, or shut down by an operator occurs. For example, the power output controller may be configured to communicate control signals to the non-GTE-powered and GTE-powered hydraulic fracturing units to cause the hydraulic fracturing units to substantially maintain pressure output and/or power output to meet the total power fracturing power required until the end of the fracturing stage, automatic emergency shutdown occurs, or shut down by operator occurs.

It should be appreciated that subject matter presented herein may be implemented as a computer process, a computer-controlled apparatus, a computing system, or an article of manufacture, such as a computer-readable storage medium. While the subject matter described herein is presented in the general context of program modules that execute on one or more computing devices, those skilled in the art will recognize that other implementations may be performed in combination with other types of program modules. Generally, program modules include routines, programs, components, data structures, and other types of structures that perform particular tasks or implement particular abstract data types.

Those skilled in the art will also appreciate that aspects of the subject matter described herein may be practiced on or in conjunction with other computer system configurations beyond those described herein, including multiprocessor systems, microprocessor-based or programmable consumer electronics, minicomputers, mainframe computers, handheld computers, mobile telephone devices, tablet computing devices, special-purposed hardware devices, network appliances, and the like.

Figure 5:
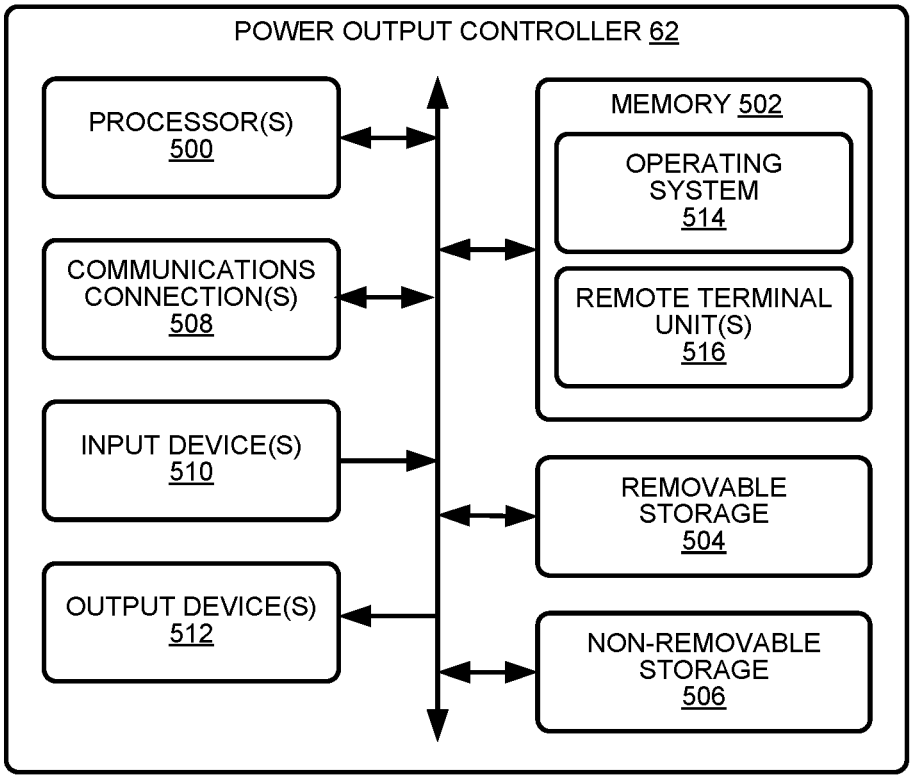
FIG. 5 is a schematic diagram of an example power output controller configured to operate a plurality of hydraulic fracturing units according to embodiments of the disclosure.

FIG. 5 illustrates an example power output controller 62 configured for implementing certain systems and methods for controlling operation of a plurality of hydraulic fracturing units that may each include a non-GTE-engine or a GTE (e.g., a dual- or bi-fuel GTE configured to operate using two different types of fuel) according to embodiments of the disclosure, for example, as described herein. The power output controller 62 may include one or more processor(s) 500 configured to execute certain operational aspects associated with implementing certain systems and methods described herein. The processor(s) 500 may communicate with a memory 502. The processor(s) 500 may be implemented and operated using appropriate hardware, software, firmware, or combinations thereof. Software or firmware implementations may include computer-executable or machine-executable instructions written in any suitable programming language to perform the various functions described. In some examples, instructions associated with a function block language may be stored in the memory 502 and executed by the processor(s) 500.

The memory 502 may be used to store program instructions that are loadable and executable by the processor(s) 500, as well as to store data generated during the execution of these programs. Depending on the configuration and type of the power output controller 62, the memory 502 may be volatile (such as random access memory (RAM)) and/or non-volatile (such as read-only memory (ROM), flash memory, etc.). In some examples, the memory devices may include additional removable storage 504 and/or non-removable storage 506 including, but not limited to, magnetic storage, optical disks, and/or tape storage. The disk drives and their associated computer-readable media may provide non-volatile storage of computer-readable instructions, data structures, program modules, and other data for the devices. In some implementations, the memory 502 may include multiple different types of memory, such as static random access memory (SRAM), dynamic random access memory (DRAM), or ROM.

The memory 502, the removable storage 504, and the non-removable storage 506 are all examples of computer-readable storage media. For example, computer-readable storage media may include volatile and non-volatile, removable and non-removable media implemented in any method or technology for storage of information such as computer-readable instructions, data structures, program modules or other data. Additional types of computer storage media that may be present may include, but are not limited to, programmable random access memory (PRAM), SRAM, DRAM, RAM, ROM, electrically erasable programmable read-only memory (EEPROM), flash memory or other memory technology, compact disc read-only memory (CD-ROM), digital versatile discs (DVD) or other optical storage, magnetic cassettes, magnetic tapes, magnetic disk storage or other magnetic storage devices, or any other medium which may be used to store the desired information and which may be accessed by the devices. Combinations of any of the above should also be included within the scope of computer-readable media.

The power output controller 62 may also include one or more communication connection(s) 508 that may facilitate a control device (not shown) to communicate with devices or equipment capable of communicating with the power output controller 62. The power output controller 62 may also include a computer system (not shown). Connections may also be established via various data communication channels or ports, such as USB or COM ports to receive cables connecting the power output controller 62 to various other devices on a network. In some examples, the power output controller 62 may include Ethernet drivers that enable the power output controller 62 to communicate with other devices on the network. According to various examples, communication connections 508 may be established via a wired and/or wireless connection on the network.

The power output controller 62 may also include one or more input devices 510, such as a keyboard, mouse, pen, voice input device, gesture input device, and/or touch input device. The one or more input device(s) 510 may correspond to the one or more input devices 64 described herein with respect to FIGS. 1 and 2. It may further include one or more output devices 512, such as a display, printer, and/or speakers. In some examples, computer-readable communication media may include computer-readable instructions, program modules, or other data transmitted within a data signal, such as a carrier wave or other transmission. As used herein, however, computer-readable storage media may not include computer-readable communication media.

Turning to the contents of the memory 502, the memory 502 may include, but is not limited to, an operating system (OS) 514 and one or more application programs or services for implementing the features and embodiments disclosed herein. Such applications or services may include remote terminal units 516 for executing certain systems and methods for controlling operation of the hydraulic fracturing units 12 (e.g., semi- or full-autonomously controlling operation of the hydraulic fracturing units 12), for example, upon receipt of one or more control signals generated by the power output controller 62. In some embodiments, each of the hydraulic fracturing units 12 may include a remote terminal unit 516. The remote terminal units 516 may reside in the memory 502 or may be independent of the power output controller 62. In some examples, the remote terminal unit 516 may be implemented by software that may be provided in configurable control block language and may be stored in non-volatile memory. When executed by the processor(s) 500, the remote terminal unit 516 may implement the various functionalities and features associated with the power output controller 62 described herein.

As desired, embodiments of the disclosure may include a power output controller 62 with more or fewer components than are illustrated in FIG. 5. Additionally, certain components of the example power output controller 62 shown in FIG. 5 may be combined in various embodiments of the disclosure. The power output controller 62 of FIG. 5 is provided by way of example only.

References are made to block diagrams of systems, methods, apparatuses, and computer program products according to example embodiments. It will be understood that at least some of the blocks of the block diagrams, and combinations of blocks in the block diagrams, may be implemented at least partially by computer program instructions. These computer program instructions may be loaded onto a general purpose computer, special purpose computer, special purpose hardware-based computer, or other programmable data processing apparatus to produce a machine, such that the instructions which execute on the computer or other programmable data processing apparatus create means for implementing the functionality of at least some of the blocks of the block diagrams, or combinations of blocks in the block diagrams discussed.

These computer program instructions may also be stored in a non-transitory computer-readable memory that can direct a computer or other programmable data processing apparatus to function in a particular manner, such that the instructions stored in the computer-readable memory produce an article of manufacture including instruction means that implement the function specified in the block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide task, acts, actions, or operations for implementing the functions specified in the block or blocks.

One or more components of the systems and one or more elements of the methods described herein may be implemented through an application program running on an operating system of a computer. They may also be practiced with other computer system configurations, including hand-held devices, multiprocessor systems, microprocessor-based or programmable consumer electronics, mini-computers, mainframe computers, and the like.

Application programs that are components of the systems and methods described herein may include routines, programs, components, data structures, etc. that may implement certain abstract data types and perform certain tasks or actions. In a distributed computing environment, the application program (in whole or in part) may be located in local memory or in other storage. In addition, or alternatively, the application program (in whole or in part) may be located in remote memory or in storage to allow for circumstances where tasks can be performed by remote processing devices linked through a communications network.

This U.S. Non-Provisional patent application claims priority to and the benefit of, under 35 U.S.C. § 119(e), U.S. Provisional Application No. 62/705,354, filed Jun. 23, 2020, titled "SYSTEMS AND METHODS TO AUTONOMOUSLY OPERATE HYDRAULIC FRACTURING UNITS," the disclosure of which is incorporated herein by reference in its entirety.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims.

What is claimed is:

1. A method of operating a plurality of hydraulic fracturing units, each of the hydraulic fracturing units including a hydraulic fracturing pump to pump fracturing fluid into a wellhead and a gas turbine engine to drive the hydraulic fracturing pump, the method comprising:

receiving, at a power output controller, one or more operational signals indicative of operational parameters associated with pumping fracturing fluid into a wellhead according to performance of a hydraulic fracturing operation;

determining, via the power output controller based at least in part on the one or more operational signals, an amount of required fracturing power sufficient to perform the hydraulic fracturing operation;

receiving, at the power output controller, one or more characteristic signals indicative of fracturing unit characteristics associated with at least some of the plurality of hydraulic fracturing units, at least one of the one or more characteristic signals indicating a detrimental condition any of the plurality of hydraulic fracturing units has experienced;

determining, via the power output controller based at least in part on the one or more characteristic signals, an available power from the gas turbine engine to perform the hydraulic fracturing operation;

determining, via the power output controller, a power difference between the available power and the required power; and controlling operation of the at least some of the plurality of hydraulic fracturing units based at least in part on the power difference, the controlling including, when the power difference is indicative of a power deficit to perform the hydraulic fracturing operation, increasing a power output of one or more gas turbine engines of the at least some of the plurality of hydraulic fracturing units thereby to supply power to a respective hydraulic fracturing pump of a respective hydraulic fracturing unit of the plurality of hydraulic fracturing units, the increasing a power output of the gas turbine engine of one or more of the at least some of the plurality of hydraulic fracturing units comprising increasing a power output from a first power output ranging from about 75% to about 95% of maximum rated power output to a second power output ranging from about 90% to about 110% of the maximum rated power output.

2. The method of claim 1, wherein controlling operation of the at least some of the plurality of hydraulic fracturing units comprises one of:

when the power difference is indicative of excess power available to perform the hydraulic fracturing operation, the method comprises causing one or more of the at least some of the plurality of hydraulic fracturing units to idle during the fracturing operation; or when the power difference is indicative of a power deficit to perform the hydraulic fracturing operation, the method comprises one or more of:

increasing a power output of one or more of the gas turbine engines of at least one additional hydraulic fracturing unit of the plurality of hydraulic fracturing units to supply power to a respective hydraulic fracturing pump of a respective hydraulic fracturing unit; or storing operation data associated with operation of hydraulic fracturing units operated at an increased power output.

3. The method of claim 2, wherein causing one or more of the at least some of the plurality of hydraulic fracturing units to idle during the fracturing operation comprises:

idling at least a first one of the at least some of the plurality of hydraulic fracturing units while operating at least a second one of the at least some of the plurality of hydraulic fracturing units;

waiting a period of time; and idling the at least a second one of the at least some of the plurality of hydraulic fracturing units while operating the at least a first one of the at least some of the plurality of hydraulic fracturing units.

4. The method of claim 3, further comprising alternating between idling and operation of the at least some of the plurality of hydraulic fracturing units to reduce idling time for any one of the at least some of the plurality of hydraulic fracturing units.

5. The method of claim 3, further comprising:

receiving at the power output controller one or more wellhead signals indicative of one or more of a fracturing fluid pressure at the wellhead or a fracturing fluid flow rate at the wellhead; and controlling idling and operation of the at least some of the plurality of hydraulic fracturing units based at least in part on the one or more wellhead signals.

6. The method of claim 2, further comprising:

receiving at the power output controller one or more wellhead signals indicative of one or more of a fracturing fluid pressure at the wellhead or a fracturing fluid flow rate at the wellhead; and increasing the power output based at least in part on the one or more wellhead signals.

7. A hydraulic fracturing control assembly to operate a plurality of hydraulic fracturing units, each of the hydraulic fracturing units including a hydraulic fracturing pump to pump fracturing fluid into a wellhead and a gas turbine_engine to drive the hydraulic fracturing pump, the hydraulic fracturing control assembly comprising:

an input device configured to facilitate communication of one or more operational signals indicative of operational parameters associated with pumping fracturing fluid into a wellhead according to performance of a hydraulic fracturing operation;

one or more sensors configured to generate one or more sensor signals indicative of one or more of a flow rate of fracturing fluid or a pressure associated with fracturing fluid; and a power output controller in communication with one or more of the plurality of hydraulic fracturing units, the input device, or the one or more sensors, the power output controller being configured to:

receive the one or more operational signals indicative of operational parameters associated with pumping fracturing fluid into a wellhead according to performance of a hydraulic fracturing operation;

determine, based at least in part on the one or more operational signals, an amount of required fracturing power sufficient to perform the hydraulic fracturing operation;

receive one or more characteristic signals indicative of fracturing unit characteristics associated with at least some of the plurality of hydraulic fracturing units, at least one of the one or more characteristic signals indicating a detrimental condition any of the plurality of hydraulic fracturing units has experienced;

determine, based at least in part on the one or more characteristic signals, an available power from the gas turbine engine to perform the hydraulic fracturing operation;

determine a power difference between the available power and the required power; and control operation of the at least some of the plurality of hydraulic fracturing units based at least in part on the power difference, and when the power difference is indicative of a power deficit to perform the hydraulic fracturing operation, increase a power output of one or more of the gas turbine engines of the at least some of the plurality of hydraulic fracturing units thereby to supply power to a respective hydraulic fracturing pump of a respective hydraulic fracturing unit of the plurality of hydraulic fracturing units, the increase a power output of one or more gas turbine engines of the at least some of the plurality of hydraulic fracturing units comprising increasing a power output from a first power output ranging from about 75% to about 95% of maximum rated power output to a second power output ranging from about 90% to about 110% of the maximum rated power output.

8. The hydraulic fracturing control assembly of claim 7, wherein the power output controller is configured to one of:

cause one or more of the at least some of the plurality of hydraulic fracturing units to idle during the fracturing operation when the power difference is indicative of excess power available to perform the hydraulic fracturing operation; or when the power difference is indicative of a power deficit to perform the hydraulic fracturing operation, one or more of:

increase a power output of one or more of the gas turbine engines of at least one additional hydraulic fracturing unit of the plurality of hydraulic fracturing units to supply power to a respective hydraulic fracturing pump of a respective hydraulic fracturing unit; or store operation data associated with operation of hydraulic fracturing units operated at an increased power output.

9. The hydraulic fracturing control assembly of claim 8, wherein the power output controller is configured to cause:

idling of at least a first one of the at least some of the plurality of hydraulic fracturing units while operating at least a second one of the at least some of the plurality of hydraulic fracturing units;

waiting a period of time; and idling of the at least a second one of the at least some of the plurality of hydraulic fracturing units while operating the at least a first one of the at least some of the plurality of hydraulic fracturing units.

10. The hydraulic fracturing control assembly of claim 9, wherein the power output controller is configured to cause alternating between idling and operation of the at least some of the plurality of hydraulic fracturing units to reduce idling time for any one of the at least some of the plurality of hydraulic fracturing units.

11. The hydraulic fracturing control assembly of claim 9, wherein the power output controller is configured to:

receive one or more wellhead signals indicative of one or more of a fracturing fluid pressure at the wellhead or a fracturing fluid flow rate at the wellhead; and control idling and operation of the at least some of the plurality of hydraulic fracturing units based at least in part on the one or more wellhead signals.

12. The hydraulic fracturing control assembly of claim 8, wherein the power output controller is configured to:

receive one or more wellhead signals indicative of one or more of a fracturing fluid pressure at the wellhead or a fracturing fluid flow rate at the wellhead; and increase the power output based at least in part on the one or more wellhead signals.

13. A hydraulic fracturing system comprising:

a plurality of hydraulic fracturing units, each of the hydraulic fracturing units including a hydraulic fracturing pump to pump fracturing fluid into a wellhead and a gas turbine engine to drive the hydraulic fracturing pump;

an input device configured to facilitate communication of one or more operational signals indicative of operational parameters associated with pumping fracturing fluid into a wellhead according to performance of a hydraulic fracturing operation;

one or more sensors configured to generate one or more sensor signals indicative of one or more of a flow rate of fracturing fluid or a pressure associated with fracturing fluid; and a power output controller in communication with one or more of the plurality of hydraulic fracturing units, the input device, or the one or more sensors, the power output controller being configured to:

receive the one or more operational signals indicative of operational parameters associated with pumping fracturing fluid into a wellhead according to performance of a hydraulic fracturing operation;

determine, based at least in part on the one or more operational signals, an amount of required fracturing power sufficient to perform the hydraulic fracturing operation;

receive one or more characteristic signals indicative of fracturing unit characteristics associated with at least some of the plurality of hydraulic fracturing units, at least one of the one or more characteristic signals indicating a detrimental condition any of the plurality of hydraulic fracturing units has experienced;

determine, based at least in part on the one or more characteristic signals, an available power from the gas turbine engine to perform the hydraulic fracturing operation;

determine a power difference between the available power and the required power; and control operation of the at least some of the plurality of hydraulic fracturing units based at least in part on the power difference, and when the power difference is indicative of a power deficit to perform the hydraulic fracturing operation, increase a power output of one or more gas turbine engines of the at least some of the plurality of hydraulic fracturing units thereby to supply power to a respective hydraulic fracturing pump of a respective hydraulic fracturing unit of the plurality of hydraulic fracturing units, the increase a power output of one or more gas turbine engines of the at least some of the plurality of hydraulic fracturing units comprising increasing a power output from a first power output ranging from about 75% to about 95% of maximum rated power output to a second power output ranging from about 90% to about 110% of the maximum rated power output.

14. The hydraulic fracturing system of claim 13, wherein the power output controller is configured to one of:

cause one or more of the at least some of the plurality of hydraulic fracturing units to idle during the fracturing operation when the power difference is indicative of excess power available to perform the hydraulic fracturing operation; or when the power difference is indicative of a power deficit to perform the hydraulic fracturing operation, one or more of:

increase a power output of one or more of the gas turbine engines of at least one additional hydraulic fracturing unit of the plurality of hydraulic fracturing units to supply power to a respective hydraulic fracturing pump of a respective hydraulic fracturing unit; or store operation data associated with operation of hydraulic fracturing units operated at an increased power output.

15. The hydraulic fracturing system of claim 14, wherein power output controller is configured to cause:

idling of at least a first one of the at least some of the plurality of hydraulic fracturing units while operating at least a second one of the at least some of the plurality of hydraulic fracturing units;

waiting a period of time; and idling of the at least a second one of the at least some of the plurality of hydraulic fracturing units while operating the at least a first one of the at least some of the plurality of hydraulic fracturing units.

16. The hydraulic fracturing system of claim 15, wherein the power output controller is configured to cause alternating between idling and operation of the at least some of the plurality of hydraulic fracturing units to reduce idling time for any one of the at least some of the plurality of hydraulic fracturing units.

17. The hydraulic fracturing system of claim 15, wherein the power output controller is configured to:

receive one or more wellhead signals indicative of one or more of a fracturing fluid pressure at the wellhead or a fracturing fluid flow rate at the wellhead; and control idling and operation of the at least some hydraulic fracturing units based at least in part on the one or more wellhead signals.

18. The hydraulic fracturing system of claim 14, wherein the power output controller is configured to:

receive one or more wellhead signals indicative of one or more of a fracturing fluid pressure at the wellhead or a fracturing fluid flow rate at the wellhead; and increase the power output based at least in part on the one or more wellhead signals.

* * * * *